US011253771B2

(12) United States Patent
Vito et al.

(10) Patent No.: US 11,253,771 B2
(45) Date of Patent: Feb. 22, 2022

(54) HELMET PADDING SYSTEM

(71) Applicant: Matscitechno Licensing Company, Kennett Square, PA (US)

(72) Inventors: Robert A. Vito, Kennett Square, PA (US); Michael Foerster, Newtown Square, PA (US)

(73) Assignee: Matscitechno Licensing Company, Kennett Square, PA (US)

( * ) Notice: Subject to any disclaimer, the term of this patent is extended or adjusted under 35 U.S.C. 154(b) by 273 days.

(21) Appl. No.: 15/488,650

(22) Filed: Apr. 17, 2017

(65) Prior Publication Data

US 2017/0273388 A1 Sep. 28, 2017

Related U.S. Application Data

(63) Continuation-in-part of application No. 14/729,266, filed on Jun. 3, 2015, now abandoned, which is a continuation-in-part of application No. 14/493,869, filed on Sep. 23, 2014, now Pat. No. 10,993,496, which is a continuation-in-part of application No. 14/275,046, filed on May 12, 2014, now abandoned.

(60) Provisional application No. 61/942,743, filed on Feb. 21, 2014.

(51) Int. Cl.

| | |
|---|---|
| ***A63B 71/10*** | (2006.01) |
| ***A42B 1/08*** | (2006.01) |
| ***A42B 3/20*** | (2006.01) |

(52) U.S. Cl.

CPC ..... *A63B 71/10* (2013.01); *A42B 1/08* (2013.01); *A42B 3/20* (2013.01)

(58) Field of Classification Search

CPC ..... A63B 71/10; A42B 1/08; A42B 3/20

USPC ..... 2/414

See application file for complete search history.

(56) References Cited

U.S. PATENT DOCUMENTS

| | | | |
|---|---|---|---|
| 1,522,952 | A | 1/1925 | Goldsmith |
| 1,602,727 | A | 10/1926 | Turner |
| 2,420,522 | A | 5/1947 | Grand |

(Continued)

FOREIGN PATENT DOCUMENTS

| | | | |
|---|---|---|---|
| CH | 689008 | A5 | 7/1998 |
| CN | 104244755 | A | 12/2014 |

(Continued)

OTHER PUBLICATIONS

Brookman, PVC Thermoplastic Elastomers Journal of Vinyl Technology, vol. 10, Issue 1 (Mar. 1988), pp. 33-36. (Year: 1988).*

(Continued)

*Primary Examiner* — Anne M Kozak
(74) *Attorney, Agent, or Firm* — RatnerPrestia

(57) ABSTRACT

Aspects of the present invention are directed to helmet padding systems. One helmet padding system includes a rigid shell and a spacing pad. The rigid shell is configured to cover a top of a user's head and be worn under a baseball cap. The rigid shell includes an opening formed in an area of the rigid shell opposite the front of the user's head when the rigid shell is worn on the user's head. The spacing pad is positioned within the rigid shell. The spacing pad includes a layer of elastomeric material. The helmet padding system may further include the baseball cap positioned overtop the rigid shell. The baseball cap has a cut-out in a rear portion thereof.

21 Claims, 48 Drawing Sheets

(56) References Cited

U.S. PATENT DOCUMENTS 2,455,797 A 12/1948 Myers
2,532,442 A 12/1950 Daly
2,610,332 A 9/1952 Field
2,753,561 A 7/1956 Mauro
2,969,547 A 1/1961 Dye
3,067,427 A 12/1962 McClintock, Sr.
3,153,792 A 10/1964 Marietta
3,197,784 A 8/1965 Carlisle
3,208,080 A 9/1965 Hirsch
3,290,693 A 12/1966 Wolfe
3,315,273 A 4/1967 Bullard
3,500,473 A 3/1970 Marchello
3,529,306 A 9/1970 Thorne
3,568,210 A 3/1971 Marietta
3,577,562 A 5/1971 Holt
3,582,990 A 6/1971 Frieder
3,609,764 A 10/1971 Morgan
3,665,514 A 5/1972 Durand
3,783,450 A 1/1974 O'Connor
3,845,389 A 10/1974 Phillips
3,897,596 A 8/1975 Aileo
3,906,546 A 9/1975 Gooding
3,994,020 A 11/1976 Villari
3,994,021 A 11/1976 Villari
3,994,023 A 11/1976 Aileo
4,233,687 A 11/1980 Lancellotti
4,282,610 A 8/1981 Steigerwald
D267,287 S 12/1982 Gooding
4,375,108 A 3/1983 Gooding
4,404,690 A 9/1983 Farquharson
4,432,099 A 2/1984 Grick
4,484,364 A 11/1984 Mitchell
4,596,056 A 6/1986 Grick
4,627,114 A 12/1986 Mitchell
4,833,735 A 5/1989 Long
4,856,119 A 8/1989 Haeberle
4,932,076 A 6/1990 Giorgio
4,996,724 A 3/1991 Dextrase
5,012,533 A 5/1991 Raffler
5,014,365 A 5/1991 Schulz
5,035,009 A 7/1991 Wingo, Jr.
5,088,126 A 2/1992 Mathis
5,088,129 A 2/1992 Kamata
5,119,505 A 6/1992 Tisseront
5,119,514 A 6/1992 Woehl
5,119,614 A 6/1992 Rex
5,173,970 A 12/1992 Shifrin
5,177,815 A 1/1993 Andujar
5,226,180 A 7/1993 Leach
5,249,347 A 10/1993 Martinitz
5,269,026 A 12/1993 McManus
5,271,103 A 12/1993 Darnell
5,289,591 A 3/1994 Andersen
5,298,208 A 3/1994 Sibley et al.
5,337,420 A 8/1994 Haysom
D364,496 S 11/1995 Lejuez
5,515,546 A 5/1996 Shifrin
5,517,691 A 5/1996 Blake
5,519,895 A 5/1996 Barnes, Jr.
5,587,239 A 12/1996 Ueba et al.
5,598,588 A 2/1997 Lee
5,603,117 A 2/1997 Hudner et al.
5,625,901 A 5/1997 Healy
5,661,854 A 9/1997 March, II
5,666,670 A 9/1997 Ryan
5,713,082 A 2/1998 Bassette et al.
5,815,847 A * 10/1998 Holden, Jr. ..... A42B 3/125 2/418
5,887,289 A 3/1999 Theoret
D410,768 S 6/1999 Hirsh
5,913,412 A 6/1999 Huber
5,915,537 A 6/1999 Dallas
5,915,538 A * 6/1999 Basson ..... A42B 3/08 2/421
5,987,649 A 11/1999 Robertson
5,996,126 A 12/1999 Barthold
6,073,271 A 6/2000 Alexander
6,073,272 A 6/2000 Ball
6,081,929 A 7/2000 Rothrock
6,093,468 A 7/2000 Toms
6,094,750 A 8/2000 Lee
6,108,824 A 8/2000 Fournier et al.
D431,329 S 9/2000 Chen
6,138,283 A 10/2000 Kress
6,154,889 A 12/2000 Moore
6,219,850 B1 4/2001 Halstead et al.
6,240,571 B1 6/2001 Infusino
6,256,798 B1 7/2001 Egolf et al.
6,256,799 B1 * 7/2001 McGlasson ..... A42B 3/003 2/411
6,282,724 B1 9/2001 Abraham
6,298,497 B1 10/2001 Chartrand
6,301,719 B1 10/2001 Goodhand
6,324,700 B1 12/2001 McDougall
6,349,416 B1 2/2002 Lampe et al.
6,360,376 B1 3/2002 Carrington
6,367,090 B1 4/2002 Im
6,370,697 B1 4/2002 Held
6,374,423 B1 4/2002 Anderson et al.
6,381,759 B1 5/2002 Katz
6,385,780 B1 5/2002 Racine
6,389,607 B1 5/2002 Wood
6,418,564 B1 7/2002 Sheridan
6,434,755 B1 8/2002 Halstead
6,453,476 B1 9/2002 Moore
6,519,781 B1 2/2003 Berns
6,550,071 B2 4/2003 Garneau
D479,020 S 8/2003 Heinrich
6,647,556 B2 11/2003 Grepper
6,694,529 B1 2/2004 Chiu
6,751,808 B2 6/2004 Puchalski
6,883,181 B2 4/2005 Long
6,961,963 B2 11/2005 Rosie
6,996,856 B2 2/2006 Puchalski
7,010,814 B2 * 3/2006 Benziger ..... A42B 1/08 2/171.2
7,096,512 B2 8/2006 Blair
7,159,249 B2 1/2007 Dennis
D556,951 S 12/2007 Gath
D577,866 S 9/2008 Frye
D582,607 S 12/2008 Ferrara et al.
7,475,434 B2 1/2009 Ambuske
D592,380 S 5/2009 McLaughlin
D604,461 S 11/2009 Goldman
D612,545 S 3/2010 Pliszka
7,673,350 B2 3/2010 Mazzoccoli et al.
D617,503 S 6/2010 Szalkowski
7,765,622 B2 * 8/2010 Wiles ..... A42B 3/125 2/410
D637,356 S 5/2011 Green
7,950,073 B2 5/2011 Ferrara
D640,422 S 6/2011 Green et al.
7,958,570 B1 6/2011 Mooney
7,958,573 B2 6/2011 Lewis
8,001,622 B1 8/2011 Culley
8,001,624 B1 8/2011 Leedom
8,042,198 B1 10/2011 Cleveland
8,046,845 B1 11/2011 Garcia et al.
8,087,099 B2 1/2012 Sawabe
8,095,995 B2 1/2012 Alexander
8,146,178 B2 4/2012 Maddux et al.
8,156,574 B2 4/2012 Stokes
D660,519 S 5/2012 Laloy
8,196,226 B1 6/2012 Schuh
8,205,272 B2 6/2012 Green et al.
D663,076 S 7/2012 Parsons
D663,901 S 7/2012 Vito
D666,779 S 9/2012 Harris
D667,592 S 9/2012 Vito
D670,868 S 11/2012 Harris
D670,869 S 11/2012 Harris
D670,870 S 11/2012 Harris
D671,270 S * 11/2012 Ho ..... D29/102
D671,271 S 11/2012 Votel et al.

(56) References Cited

U.S. PATENT DOCUMENTS

D687,215 S 8/2013 Padgett
8,505,113 B2 8/2013 Crye
8,534,279 B2 9/2013 Brace
8,544,118 B2 10/2013 Brine, et al.
8,572,767 B2 11/2013 Bryant et al.
D695,966 S 12/2013 Futterer
D697,267 S 1/2014 Benvegnu
8,640,267 B1 2/2014 Cohen
D701,348 S 3/2014 Thurgood et al.
8,739,316 B1 6/2014 Norton
8,776,273 B2 * 7/2014 Krause ..... A42B 1/08 2/175.3
8,789,212 B2 7/2014 Cleva
8,850,622 B2 * 10/2014 Finiel ..... A42B 3/125 2/410
D724,294 S 3/2015 Vito
8,978,167 B2 3/2015 Blair
9,131,744 B2 9/2015 Erb
9,155,924 B1 10/2015 Grove et al.
D749,272 S 2/2016 Vito
D754,930 S 4/2016 Vito et al.
9,364,039 B2 6/2016 Pusateri
9,414,636 B2 8/2016 Pietrzak
D769,541 S 10/2016 Meier
9,474,318 B2 10/2016 Wesson et al.
9,526,291 B2 12/2016 Beauchamp
9,642,409 B2 5/2017 Roesler
9,861,153 B2 1/2018 Finisdore
D812,313 S 3/2018 Williams
9,907,347 B2 3/2018 Allen
10,092,056 B2 * 10/2018 Durocher ..... A42B 3/125
10,357,077 B2 7/2019 Pietrzak
10,362,829 B2 7/2019 Lowe
D867,672 S 11/2019 Votel et al.
10,779,599 B2 9/2020 Votel et al.
D903,947 S 12/2020 Pietruck
2002/0000004 A1 1/2002 Wise
2002/0002730 A1 1/2002 Dennis
2002/0007508 A1 1/2002 Grepper et al.
2002/0023290 A1 2/2002 Watters
2002/0035748 A1 * 3/2002 Racine ..... A42B 3/12 2/414
2002/0114959 A1 8/2002 Kang et al.
2002/0152542 A1 10/2002 Dennis et al.
2002/0193459 A1 12/2002 Haseyama et al.
2003/0070209 A1 4/2003 Falone
2003/0167558 A1 9/2003 Broersma
2004/0034903 A1 * 2/2004 Blair ..... A42B 1/08 2/411
2004/0107482 A1 6/2004 Picotte
2004/0172739 A1 9/2004 Racine
2004/0181854 A1 9/2004 Primrose
2004/0226077 A1 11/2004 Toth
2005/0034223 A1 2/2005 Durocher
2005/0060908 A1 3/2005 Vito
2005/0166302 A1 8/2005 Dennis
2005/0251899 A1 11/2005 Dennis
2005/0257312 A1 11/2005 Puchalski
2005/0268383 A1 12/2005 Harris
2006/0010579 A1 1/2006 Wiles
2006/0059605 A1 3/2006 Ferrara
2006/0096011 A1 5/2006 Dennis
2006/0143807 A1 7/2006 Udelhofen et al.
2006/0168712 A1 8/2006 Mazzoccoli
2006/0260026 A1 * 11/2006 Doria ..... A42B 3/127 2/414
2007/0130670 A1 * 6/2007 Henf ..... A42B 1/004 2/195.1
2007/0130673 A1 6/2007 Wasserkrug
2007/0157370 A1 * 7/2007 Joubert Des Ouches ..... A42B 3/06 2/410
2007/0163031 A1 7/2007 Lewis
2008/0092279 A1 * 4/2008 Chiang ..... A42B 3/324 2/425
2009/0083890 A1 4/2009 Dempsey
2009/0106882 A1 4/2009 Nimmons et al.
2009/0158506 A1 6/2009 Thompson et al.
2009/0222964 A1 9/2009 Wiles
2010/0258988 A1 10/2010 Darnell et al.
2010/0306904 A1 12/2010 Neid
2011/0047679 A1 * 3/2011 Rogers ..... A42B 3/324 2/414
2011/0047680 A1 * 3/2011 Hoying ..... A42B 3/069 2/414
2011/0113533 A1 5/2011 Guillen
2011/0207997 A1 8/2011 Greenburg
2011/0302700 A1 12/2011 Vito
2011/0307997 A1 12/2011 Blair
2012/0000011 A1 1/2012 Grewall
2012/0036620 A1 2/2012 Harris
2012/0317705 A1 12/2012 Lindsay
2013/0000017 A1 1/2013 Szalkowski
2013/0340146 A1 12/2013 Dekker
2014/0007322 A1 1/2014 Marz et al.
2014/0020158 A1 1/2014 Parsons
2014/0097052 A1 4/2014 Reynolds et al.
2014/0201889 A1 7/2014 Pietrzak et al.
2014/0223644 A1 8/2014 Bologna et al.
2014/0325745 A1 11/2014 Erb
2014/0338104 A1 11/2014 Vito
2015/0000015 A1 * 1/2015 Beauchamp ..... A42B 3/324 2/418
2015/0013050 A1 * 1/2015 Floyd, Jr. ..... A42B 1/08 2/411
2015/0020294 A1 1/2015 Kirshon
2015/0089726 A1 4/2015 Long
2015/0096113 A1 4/2015 Garneau et al.
2015/0245621 A1 9/2015 Stewart
2015/0264993 A1 9/2015 Vito
2015/0282550 A1 * 10/2015 Musal ..... A42B 3/06 2/414
2015/0305423 A1 10/2015 Pusateri
2016/0021965 A1 1/2016 Mayerovitch
2017/0105461 A1 4/2017 Hancock et al.
2017/0224042 A1 8/2017 Abraham
2017/0273388 A1 9/2017 Vito et al.
2017/0280811 A1 10/2017 Pinisdore
2017/0340045 A1 11/2017 Pickett
2018/0049508 A1 2/2018 Terry
2019/0090573 A1 3/2019 Votel et al.
2020/0121016 A1 4/2020 Skemp et al.

FOREIGN PATENT DOCUMENTS

DE 508419 9/1930
DE 2210205 3/1973
DE 8804821 6/1988
DE 29605144 5/1996
DE 202004012916 U1 12/2004
DE 102006058782 A1 6/2008
EP 0217996 4/1987
EP 0623292 11/1994
EP 1136007 9/2001
GB 2342845 A 4/2000
GB 2453775 A 4/2009
JP 2001073218 3/2001
JP 3154479 10/2009
JP 2017150126 A 8/2017
KR 200456037 Y1 10/2011
KR 20130025534 A 3/2013
KR 1020130104004 9/2013
WO 9846095 A2 10/1998
WO 0035307 A1 6/2000
WO 03005843 1/2003
WO 2004016122 2/2004
WO 2005027671 3/2005
WO 2012074400 A1 6/2012
WO 2013068708 A1 5/2013
WO 2016112987 A1 7/2016

(56) References Cited

FOREIGN PATENT DOCUMENTS

| | | |
|---|---|---|
| WO | 2016132227 A1 | 8/2016 |
| WO | 2016196724 | 12/2016 |
| WO | 2017006078 | 1/2017 |

OTHER PUBLICATIONS

International Search Report and Written Opinion for International Application No. PCT/US2018/027729, dated Aug. 3, 2018. 13 pages.
Notice of Allowance for U.S. Appl. No. 14/023,945, dated Aug. 9, 2018, 27 pages.
Non Final Office Action for U.S. Appl. No. 13/740,443, dated Sep. 21, 2017, 53 pages.
Mexican Office Action for Mexican Application No. MX/a/2015/003126, dated Sep. 4, 2017, 4 pages.
Final Office Action for U.S. Appl. No. 14/729,266, dated Dec. 22, 2017, 23 pages.
Final Office Action for U.S. Appl. No. 14/493,869, dated Dec. 27, 2017, 37 pages.
International Preliminary Report on Patentability for International Application No. PCT/US2016/035407, dated Dec. 5, 2017, 14 pages.
Final Office Action for U.S. Appl. No. 14/493,869, dated Feb. 8, 2019, 34 pages.
Entire patent prosecution history of U.S. Appl. No. 13/740,443, filed, Jan. 14, 2013, entitled, "Helmet Padding System."
European Communication for EP Application No. 14798462.9, dated Jan. 9, 2017, 1 page.
European Communication for European Application No. 13837348.5, dated Jun. 20, 2017, 5 pages.
European Communication for European Application No. 13837366.7, dated Mar. 17, 2017, 4 pages.
Extended European Search Report for EP Application No. 13837348.5, dated Apr. 22, 2016.
Extended European Search Report for EP Application No. 13837366.7, dated Apr. 28, 2016.
Extended European Search Report for EP Application No. 13841097.2, dated Feb. 8, 2017, 13 pages.
Extended European Search Report for EP Application No. 14798462.9, dated Dec. 19, 2016, 7 pages.
Final Office Action for U.S. Appl. No. 13/740,443, dated Jul. 26, 2016, 19 pages.
Final Office Action for U.S. Appl. No. 13/803,539, dated Dec. 15, 2016, 16 pages.
Final Office Action dated Sep. 24, 2015 for U.S. Appl. No. 14/275,046.
http://www.amazon.com/Carhartt-Mens-Workflex-Ear-Flap/dp/B00A51XG28.
International Preliminary Report on Patentability and Written Opinion issued in PCT/US2013/060327 dated Mar. 31, 2015.
International Preliminary Report on Patentability for International Application No. PCT/US2015/014352, dated Aug. 23, 2016, 10 pages.
International Search Report and Written Opinion for International Application No. PCT/US2016/035407, dated Sep. 19, 2016, 18 pages.
International Search Report and Written Opinion for PCT/US2013/00327 dated Dec. 23, 2013.
International Search Report and Written Opinion for PCT/US2013/058399 dated Dec. 30, 2013.
International Search Report and Written Opinion for PCT/US2014/067764, dated Sep. 26, 2014.
Intl. Search Report and Written Opinion issued in PCT/US2013/058396 dated Dec. 19, 2013.
Intl. Search Report and Written Opinion issued in PCT/US2015/014352 dated May 29, 2015.
IPER and Written Opinion issued in PCT/US2013/058396 dated Mar. 26, 2015.
IPER and Written Opinion issued in PCT/US2013/058399 dated Mar. 17, 2015.
IPRP issued in PCT/US2014/037764 dated Nov. 26, 2015.
Mexican Office Action dated Oct. 8, 2015 in Mexican Application No. MX/f/2014/002555, including English translation.
Non Final Office Action dated Dec. 17, 2015 for U.S. Appl. No. 13/740,443.
Non Final Office Action dated Mar. 10, 2016 for U.S. Appl. No. 13/803,539.
Non Final Office Action for U.S. Appl. No. 14/023,945, dated Oct. 7, 2016, 39 pages.
Non Final Office Action for U.S. Appl. No. 14/493,869, dated Apr. 11, 2017, 45 pages.
Non Final Office Action for U.S. Appl. No. 14/729,266, dated Jun. 13, 2017, 47 pages.
Notice of Allowance dated Dec. 9, 2015 in U.S. Appl. No. 29/537,184.
Notice of Allowance dated Nov. 12, 2015 in U.S. Appl. No. 29/537,185.
Notice of Allowance dated Sep. 25, 2015 in U.S. Appl. No. 29/482,916.
Partial European Search Report for EP Application No. 13841097.2, dated Oct. 12, 2016, 6 pages.
USPTO Final Office Action issued in U.S. Appl. No. 13/803,539 dated Aug. 18, 2015.
USPTO Non-Final Office Action issued in U.S. Appl. No. 13/803,539 dated Feb. 20, 2015.
USPTO Non-Final Office Action issued in U.S. Appl. No. 14/275,046 dated Jul. 20, 2015.
USPTO Notice of Allowance issued in U.S. Appl. No. 29/448,874 dated Sep. 16, 2014.
USPTO Notice of Allowance issued in U.S. Appl. No. 29/448,876 dated May 27, 2014.
USPTO Notice of Allowance issued in U.S. Appl. No. 29/449,385 dated Feb. 13, 2015.
USPTO Notice of Allowance issued in U.S. Appl. No. 29/449,389 dated Feb. 17, 2015.
Extended European Search Report for European Application No. 16804386.7, dated Dec. 19, 2018, 7 pages.
Final Office Action for U.S. Appl. No. 14/729,266, dated Jun. 13, 2019, 27 pages.
International Search Report and Written Opinion for International Application No. PCT/US2019/019507, dated Jun. 12, 2019, 10 pages.
European Communication pursuant to Article 94(3) for European Application No. 13837366.7, dated Feb. 12, 2018, 3 pages.
Non Final Office Action for U.S. Appl. No. 13/803,539, dated Jan. 24, 2018, 46 pages.
Non Final Office Action for U.S. Appl. No. 14/729,266, dated Oct. 4, 2018, 26 pages.
Final Office Action for U.S. Appl. No. 13/803,539, dated Feb. 25, 2019, 26 pages.
International Search Report and Written Opinion for International Application No. PCT/US2018/040741, dated Mar. 7, 2019, 9 pages.
Final Office Action for U.S. Appl. No. 14/023,945, dated Jul. 7, 2017, 42 pages.
European Communication pursuant to Article 94(3) for European Application No. 13841097.2, dated Nov. 22, 2017, 4 pages.
Final Office Action for U.S. Appl. No. 14/493,869, dated Aug. 22, 2019, 31 pages.
International Preliminary Report on Patentability for International Application No. PCT/US2018/040741, dated Jan. 7, 2020, 7 pages.
International Preliminary Report on Patentability for International Application No. PCT/US2018/027729, dated Oct. 22, 2019, 9 pages.
Non Final Office Action for U.S. Appl. No. 15/644,145, dated Dec. 11, 2019, 46 pages.
Non Final Office Action for U.S. Appl. No. 14/729,266, dated Feb. 6, 2020, 29 pages.
European Communication for European Application No. 16804386.7, dated Nov. 7, 2019, 4 pages.
Non Final Office Action for U.S. Appl. No. 14/493,869, dated Apr. 1, 2020, 36 pages.

(56) References Cited

OTHER PUBLICATIONS

Chinese Office Action for Chinese Application No. 20160039517.9, dated Feb. 25, 2020 with translation, 26 pages.
Extended European Searach Report for European Application No. 19213884.0, dated May 13, 2020, 9 pages.
Non Final Office Action for U.S. Appl. No. 15/898,814, dated Jun. 25, 2020, 81 pages.
Extended European Search Report for European Application No. 18787617.2, dated Dec. 10, 2020, 6 pages.
Non Final Office Action for U.S. Appl. No. 16/774,494, dated Sep. 1, 2021, 101 pages.
Final Office Action for U.S. Appl. No. 16/183,839, dated Aug. 20, 2021, 22 pages.
Final Office Action for U.S. Appl. No. 15/898,814, dated Mar. 12, 2021, 49 pages.
Mexican Office Action for Mexican Application No. MX/a/2015/003961, dated Jul. 16, 2020, 4 pages.
Taiwan Office Action with Search Report for Taiwanese Applciation No. 103117352, dated Jul. 26, 2017, 6 pages.
Final Office Action for U.S. Appl. No. 15/923,117, dated Jan. 25, 2021, 54 pages.
ABS vs Polycarbonate: Which Helmet Shell Material is Better? Helmets [online]. Things That Fold, retrieved from the internet at https://thingsthatfold.com/abs-vs-polycarbonate, 2020, 14 pages.
Notice of Allowance for U.S. Appl. No. 14/493,869, dated Jan. 11, 2021, 23 pages.
Final Office Action for U.S. Appl. No. 15/644,145, dated Sep. 22, 2020, 28 pages.
International Search Report and Written Opinion for International Application No. PCT/US2021/021807, dated Jun. 24, 2021, 9 pages.
Non Final Office Action for U.S. Appl. No. 16/210,271, dated May 12, 2021, 114 pages.
International Preliminary Report on Patentability for International Application No. PCT/US2019/019507, dated Sep. 22, 2020, 7 pages.
Non Final Office Action for U.S. Appl. No. 16/183,839, dated Dec. 3, 2020, 58 pages.
Non Final Office Action for U.S. Appl. No. 15/644,145, dated Nov. 26, 2021, 34 pages.
Non Final Office Action for U.S. Appl. No. 15/898,814, dated Dec. 2, 2021, 31 pages.
Non Final Office Action for U.S. Appl. No. 16/210,271, dated Nov. 24, 2021, 33 pages.

* cited by examiner

130b

130c

300

300

300

HELMET PADDING SYSTEM

CROSS REFERENCE TO RELATED APPLICATIONS

This application is a continuation-in-part of U.S. patent application Ser. No. 14/729,266, filed Jun. 3, 2015, which is a continuation-in-part of U.S. patent application Ser. No. 14/493,869, filed Sep. 23, 2014, which is a continuation-in-part of U.S. patent application Ser. No. 14/275,046, filed May 12, 2014. U.S. patent application Ser. No. 14/493,869 is also a non-provisional application of U.S. Patent Application No. 61/942,743, filed Feb. 21, 2014. The contents of each of the above applications are incorporated by reference herein in their entireties.

FIELD OF THE INVENTION

The invention relates generally to the field of protective headgear, and more particularly, to impact-resistant padding for protective headgear.

BACKGROUND OF THE INVENTION

Conventionally, participants in "contact" sports (e.g., wrestling, football, rugby) wear protective headgear to cushion the force of impacts that are regularly received during those events. In recent years, the negative health effects of the impacts to the head experienced during such contact sports have been a matter of focus. These negative health effects can be diminished or minimized by effectively cushioning participants from the forces of impacts. Accordingly, improved structures, such as impact-resistant headgear, are desired to lessen the impact forces experienced by those participants.

SUMMARY OF THE INVENTION

Aspects of the present invention are directed to helmet padding systems.

In accordance with one aspect of the present invention, a helmet padding system is disclosed. The helmet padding system includes a rigid shell and a spacing pad. The rigid shell is configured to cover a top of a user's head and be worn under a baseball cap. The rigid shell includes an opening formed in an area of the rigid shell opposite the front of the user's head when the rigid shell is worn on the user's head. The spacing pad is positioned within the rigid shell. The spacing pad includes a layer of elastomeric material.

In accordance with another aspect of the present invention, another helmet padding system is disclosed. The helmet padding system includes a cap, a rigid shell, and a spacing pad. The cap has a cut-out in a rear portion thereof. The rigid shell is configured to be worn under the cap. The rigid shell comprises an opening formed in an area of the rigid shell directly beneath the cut-out in the cap when the rigid shell is worn under the cap. The spacing pad is positioned within the rigid shell. The spacing pad includes a layer of elastomeric material.

In accordance with yet another aspect of the present invention, another helmet padding system is disclosed. The helmet padding system includes a rigid shell, a facemask, and a spacing pad. The rigid shell includes a body portion and a pair of side portions. The body portion is configured to cover a top of a user's head and be worn under a baseball cap. The body portion has a lower front edge between the pair of side portions. The pair of side portions extend downward below the lower front edge of the body portion. The facemask is coupled to the rigid shell, and is configured to cover the user's face when the rigid shell is worn by the user. The spacing pad is positioned within the rigid shell, and includes a layer of elastomeric material.

BRIEF DESCRIPTION OF THE DRAWINGS

The invention is best understood from the following detailed description when read in connection with the accompanying drawings, with like elements having the same reference numerals. When a plurality of similar elements are present, a single reference numeral may be assigned to the plurality of similar elements with a small letter designation referring to specific elements. When referring to the elements collectively or to a non-specific one or more of the elements, the small letter designation may be dropped. According to common practice, the various features of the drawings are not drawn to scale unless otherwise indicated. To the contrary, the dimensions of the various features may be expanded or reduced for clarity. Included in the drawings are the following figures.

DETAILED DESCRIPTION OF THE INVENTION

The embodiments of the invention described herein relate to helmet padding and protective headgear systems that incorporate impact-resistant pads beneath a user's helmet to cushion impacts on the helmet from the user's head. As used herein, the term "helmet" is not intended to be limited, but is meant to encompass any headgear worn for protection during an activity in which an impact to the head may occur. Additionally, as used herein, the term "impact-resistant" is intended to encompass any object that partially or fully lessens, diminishes, dissipates, deflects, or absorbs the mechanical force of an impact.

The exemplary systems and apparatus disclosed herein are configured to lessen the force of an impact on the user's head. This makes them particularly suitable for use by participants in athletic activities, and particularly suitable for participants in traditional "contact" sports, such as wrestling, American football, or rugby, where high-force impacts may be commonly experienced. While the exemplary embodiments of the invention are described herein with respect to athletic activities, it will be understood that the invention is not so limited. Suitable applications for the systems and apparatus of the present invention include, for example, military helmets or construction helmets. Other suitable applications will be readily understood by one of ordinary skill in the art from the description herein.

Figure 1:
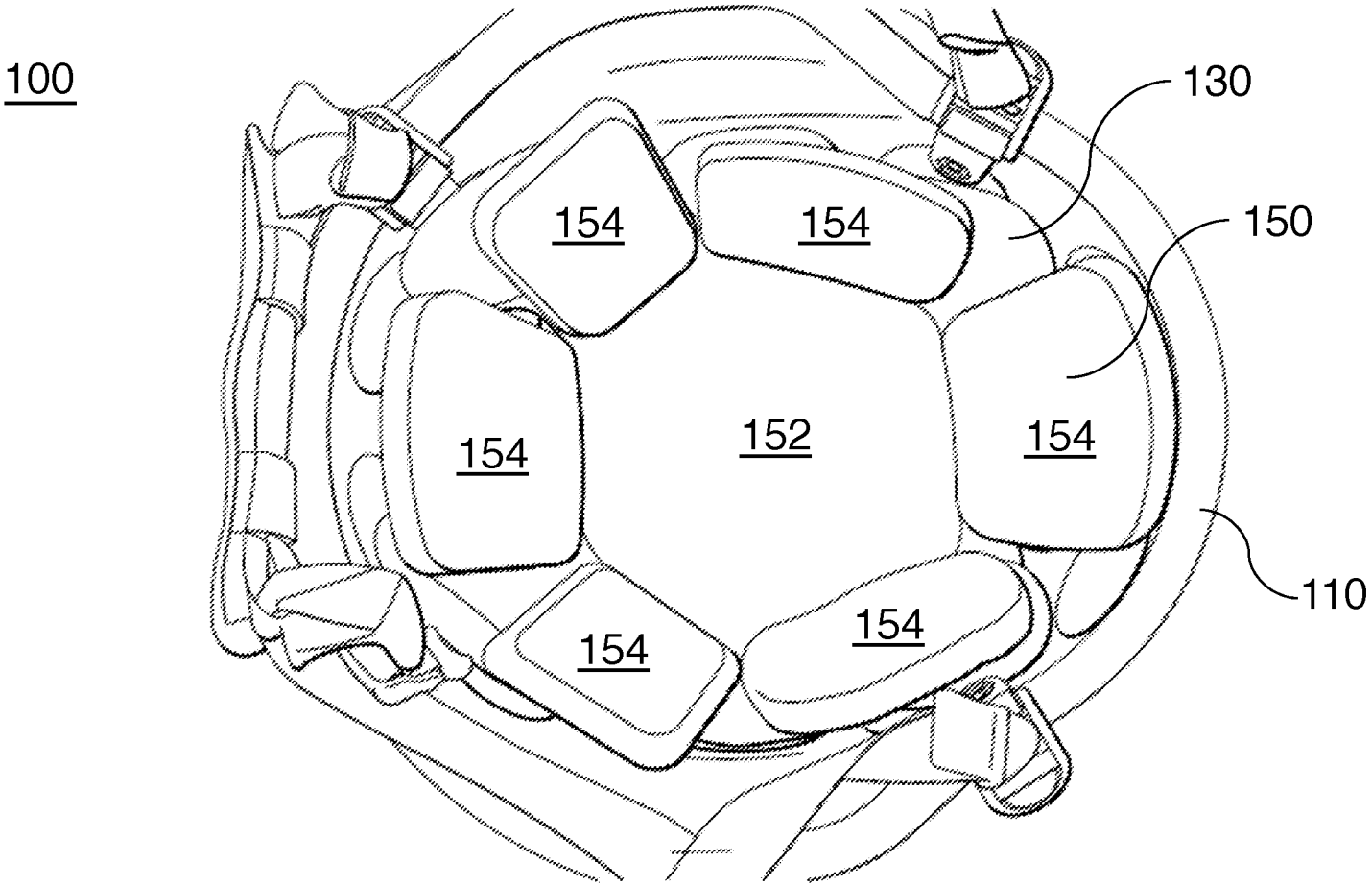
FIG. 1 is an image illustrating an exemplary helmet padding system in accordance with aspects of the present invention.

Referring now to the drawings, FIG. 1 illustrates an exemplary helmet padding system 100 in accordance with aspects of the present invention. Helmet padding system 100 may be worn by a user during an athletic activity. As a general overview, system 100 includes a helmet shell 110, a spacing pad 130, and a plurality of absorption pads 150. Additional details of system 100 are described herein.

Figure 2:
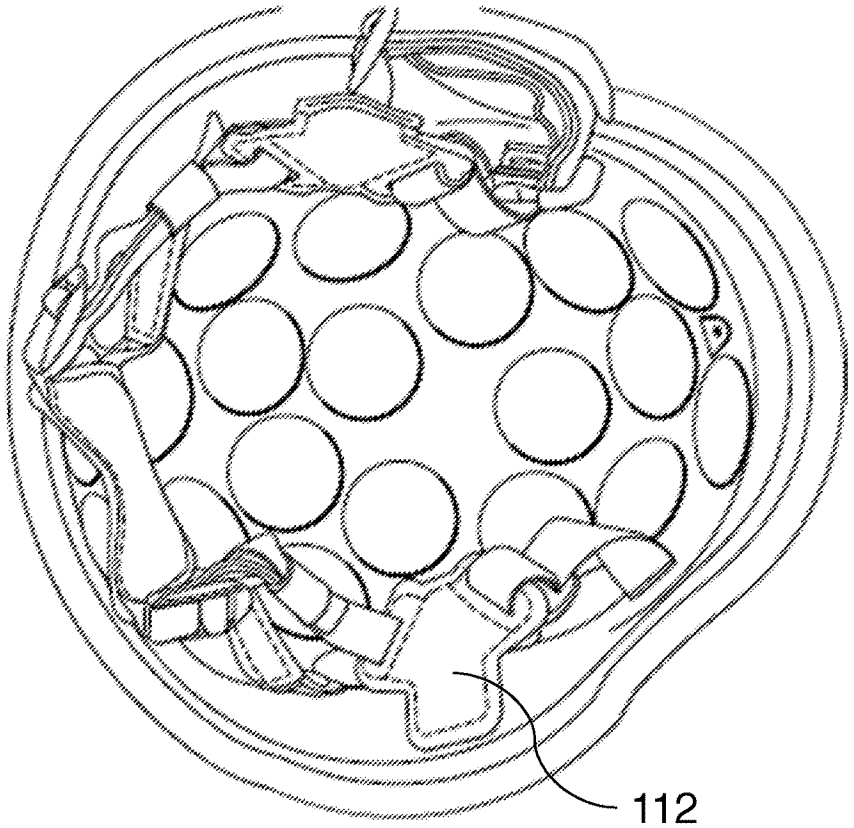
FIG. 2 is an image illustrating an exemplary helmet shell of the helmet padding system of FIG. 1.

Helmet shell 110 is configured to be positioned on a user's head. As shown in FIGS. 1 and 2, helmet shell 110 completely encloses the upper portion of the user's head. This may be desirable in order to ensure any impacts to the user's head are absorbed by helmet padding system 100. Helmet shell 110 may include one or more straps 112 for securing helmet shell 110 to the user's head. The size of helmet shell 110 is selected such that helmet shell 110 can accommodate the remaining components of system 100 while still being securely positioned on the user's head. Where helmet shell 110 is a conventional helmet shell, it will be understood that helmet shell 110 may include its own integral, connected foam pads in addition to the pads described with respect to system 100. It will be understood that the pads described with respect to system 100 may be pads provided in addition to the pads provided in conventional helmet shells 110. Suitable helmet shells 110 for use with the present invention will be known to one of ordinary skill in the art from the description herein.

Spacing pad 130 is positioned within the interior of helmet shell 110. As shown in FIGS. 4-8, spacing pad 130 comprises a central portion 132 and a plurality of extending portions 134 projecting outward from the central portion. Spacing pad 130 may or may not be coupled to the interior of helmet shell 110. When spacing pad 130 is coupled to helmet shell 110, central portion 132 is coupled to a central region of the interior of helmet shell 110, such that extending portions 134 project toward the peripheral edges of helmet shell 110.

Spacing pad 130 is formed from impact-resistant materials. For example, spacing pad 130 may include a layer of elastomeric material. The elastomeric material may provide impact-resistance by absorbing and dissipating the force of impacts laterally along the surface of the elastomeric material. In one exemplary embodiment, spacing pad 130 consists of only a single layer of elastomeric material. In another exemplary embodiment, spacing pad 130 comprises two or more layers of elastomeric material. Spacing pad 130 may include the layers of elastomeric material directly adjacent each other, or in a more preferred embodiment, may include a layer of high tensile strength fibrous material between the layers of elastomeric material.

Suitable materials for forming the elastomeric layer(s) include, but are not limited to, urethane rubbers, silicone rubbers, nitrile rubbers, butyl rubbers, acrylic rubbers, natural rubbers, styrene-butadiene rubbers, and the like. In general, any suitable elastomer material can be used to form the above-described elastomeric layers without departing from the scope of the present invention. Suitable materials for forming the layer of high tensile strength fibrous material include, but are not limited to, aramid fibers, fiberglass, or other high tensile strength fibers. The fibers may be woven to form a cloth layer that is disposed between and generally separates the opposing elastomeric layers. The high tensile strength fibrous material layer may desirably block and redirect impact energy that passes through one of the elastomeric layers. Additional description of materials for forming spacing pad 130 may be found in co-pending U.S. patent application Ser. No. 13/331,004, the contents of which are incorporated herein by reference in their entirety.

Figure 4:
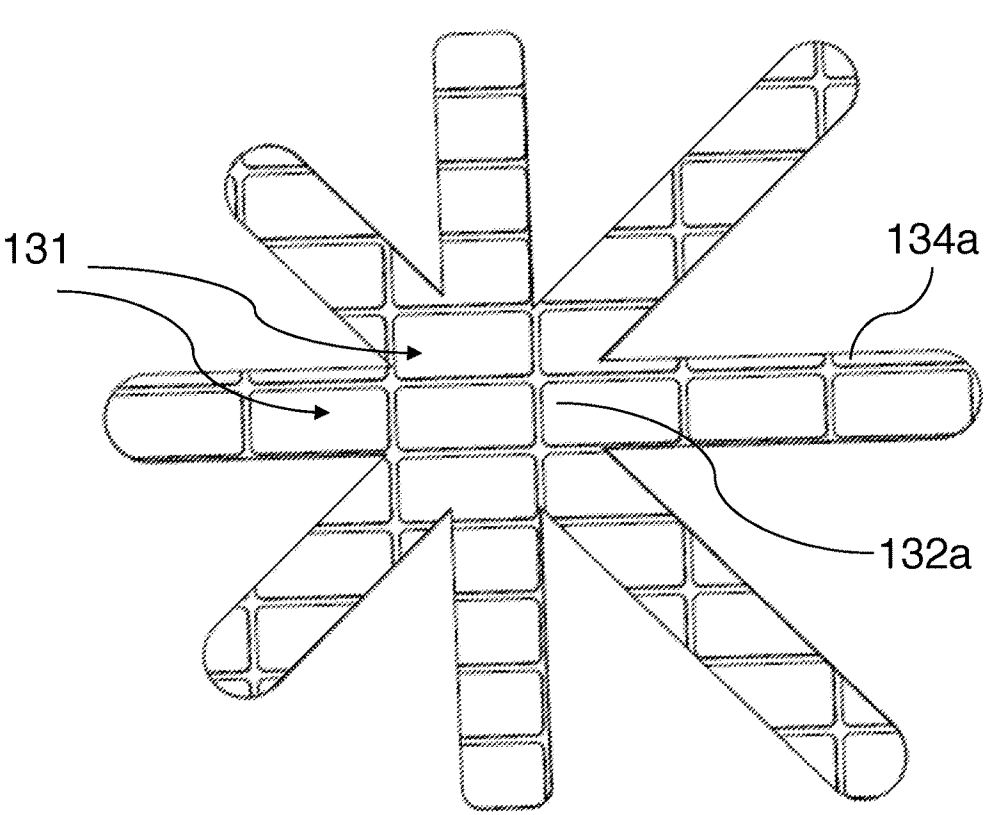
FIG. 4 is an image illustrating an exemplary spacing pad of the helmet padding system of FIG. 1.

As shown in FIG. 4, spacing pad 130 may comprise an array of raised portions 131 formed on a surface thereof. Raised portions 131 may have a rectangular shape, as shown in FIG. 4. However, one of ordinary skill in the art will understand that other shapes may be chosen. For example, raised portions 131 may have a square shape or a diamond shape. Raised portions 130 desirably enable air circulation across spacing pad 130 and concentrate the load from an impact on spacing pad 130. An array of raised portions 131 having a diamond shape may be particular desirable, as these raised portions 131 may enable greater flexibility of spacing pad 130.

As set forth above, spacing pad 130 may or may not be coupled to the interior helmet shell 110. When spacing pad 130 is coupled to the interior of helmet shell 110, such coupling may be effected, for example, using adhesive. It may be desirable that the surface of spacing pad 130, including the entire lengths of extending portions 134, be adhered to the interior of helmet shell 110. The lengths of extending portions 134 may be limited, to prevent separation of extending portions 134 from helmet shell 110 during an impact that deforms helmet shell 110.

Figure 3:
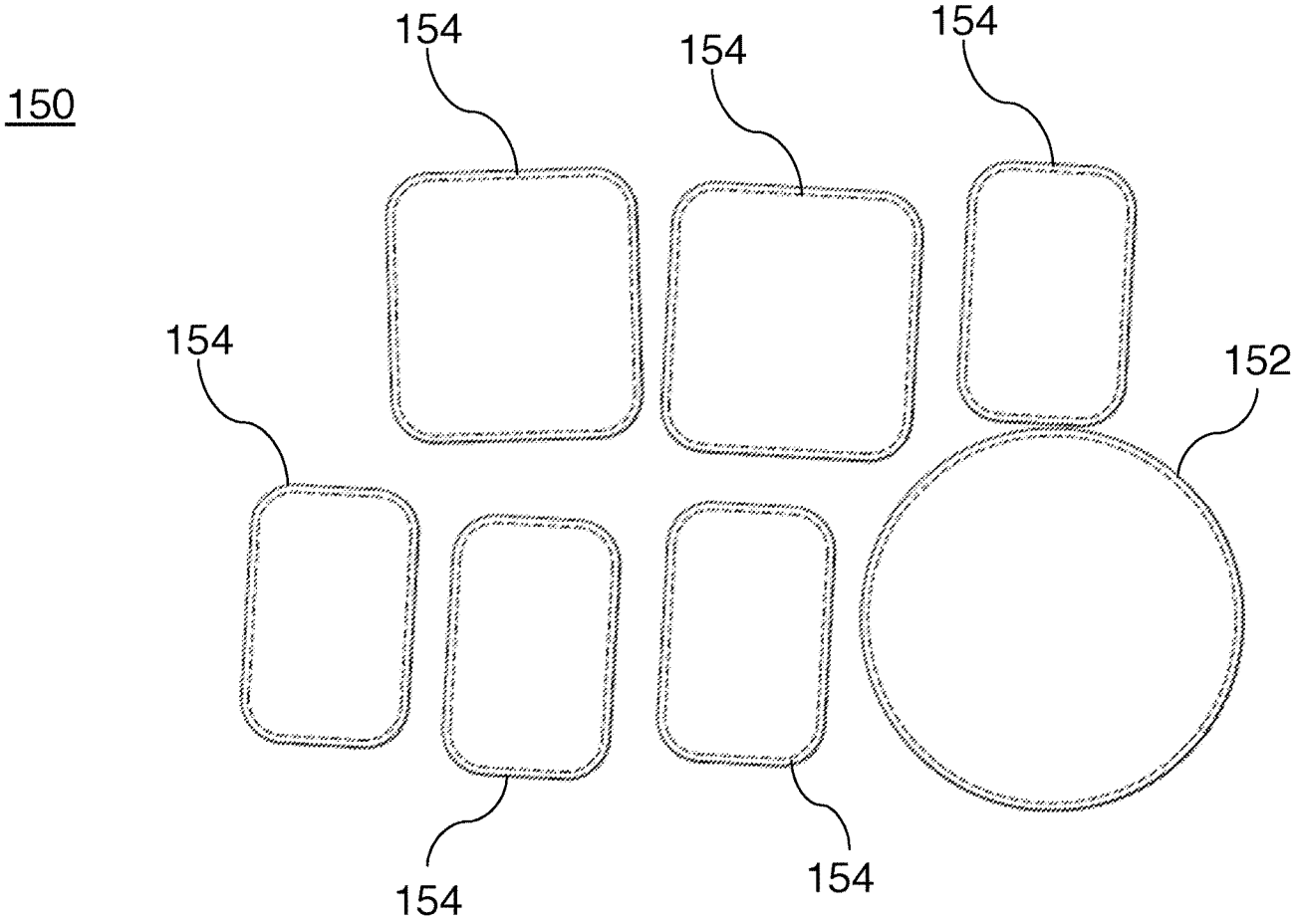
FIG. 3 is an image illustrating exemplary absorption pads of the helmet padding system of FIG. 1.

Absorption pads 150 may be coupled to spacing pad 130. As shown in FIG. 3, the plurality of absorption pads 150 includes a first large absorption pad 152 and a number of remaining absorption pads 154. As shown in FIG. 1, absorption pad 152 is configured to be coupled to the central portion of spacing pad 130, and absorption pads 154 are configured to be coupled to the ends of the extending portions of spacing pad 130.

Absorption pads 150 are desirably shaped such that they do not directly contact helmet shell 110 when spacing pad 130 is coupled to helmet shell 110. Absorption pads 150 may be insulated from helmet shell 110 by the ends of spacing pad 130, and/or may be formed with a preferential curve, in order to create a gap between the outer surfaces of pads 150 and the interior of helmet shell 110. Suitable materials for use in forming absorption pads 150 include, for example, conventional closed or open-cell foams, elastomeric and/or polymer materials. Other materials will be known to one of ordinary skill in the art from the description herein.

FIGS. 4-8 and 13 show different embodiments of spacing pads 130*a*, 130*b*, 130*c*, 130*d* for use with the present invention. Each spacing pad 130*a*, 130*b*, 130*c*, 130*d* includes a respective central portion 132*a*, 132*b*, 132*c*, 132*d* and a respective plurality of extending portions 134*a*, 134*b*, 134*c*, 134*d*. Features of these extending portions 134 will be described herein. It will be understood by one of ordinary skill in the art that any of the features described herein with respect to one embodiment of spacing pad 130 may be provided in any of the other embodiments.

Figure 5:
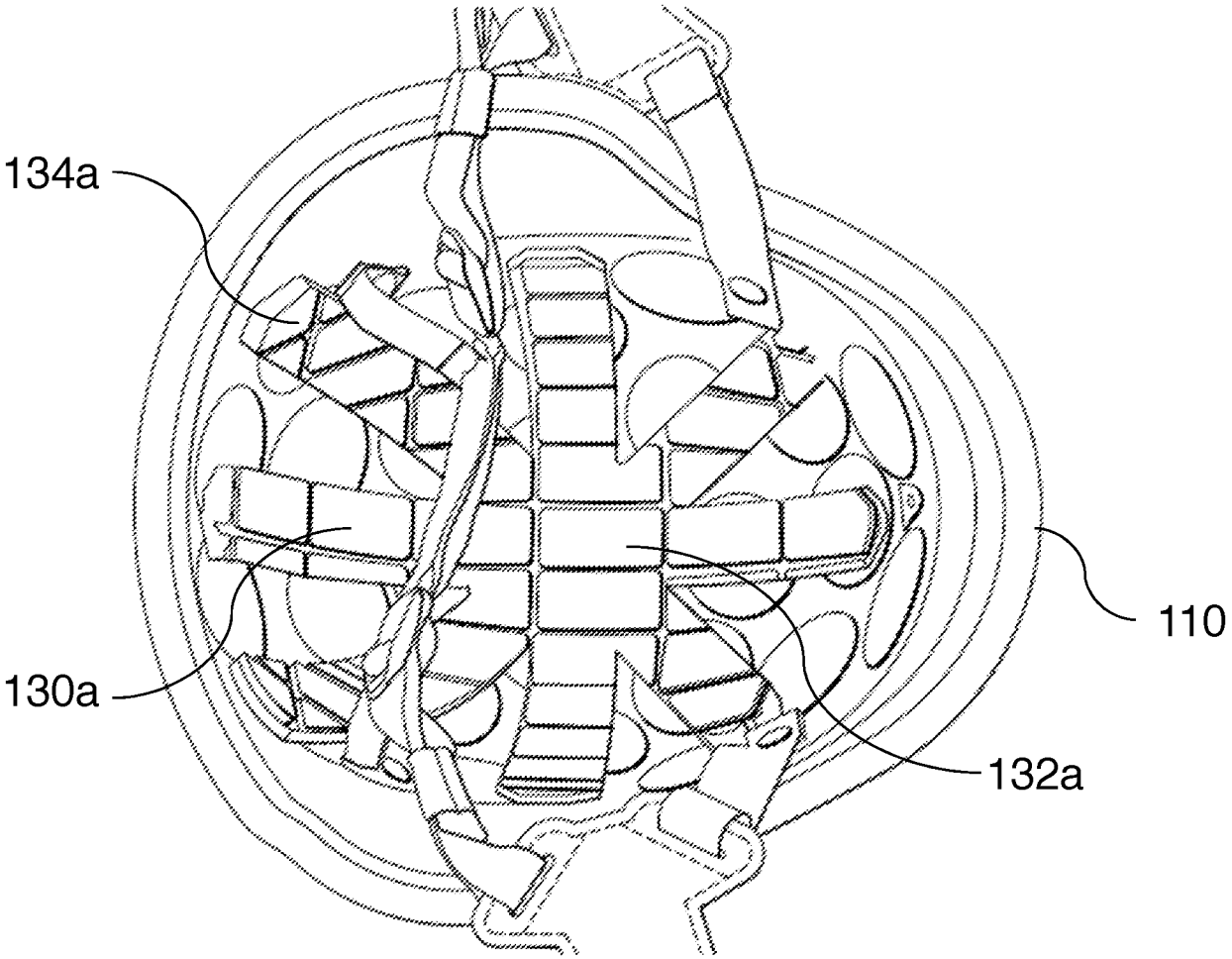
FIG. 5 is an image of the exemplary spacing pad of FIG. 4 in a helmet shell.
Figure 6:
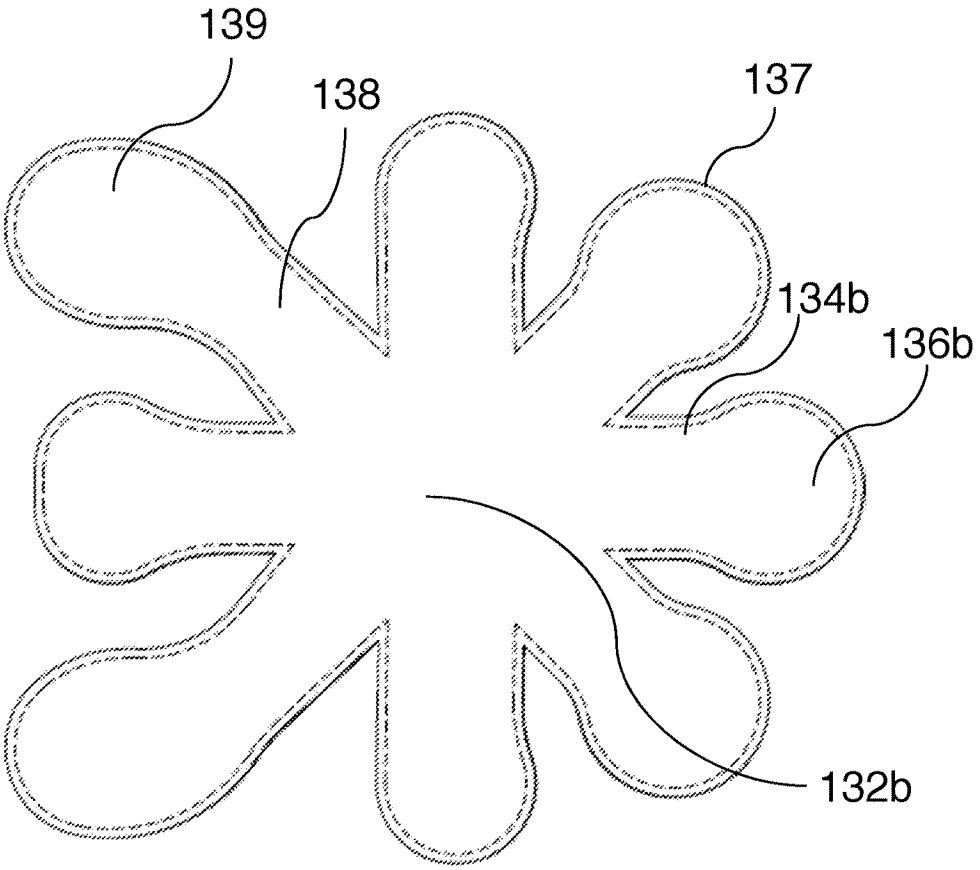
FIG. 6 is an image illustrating another exemplary spacing pad of the helmet padding system of FIG. 1.
Figure 7:
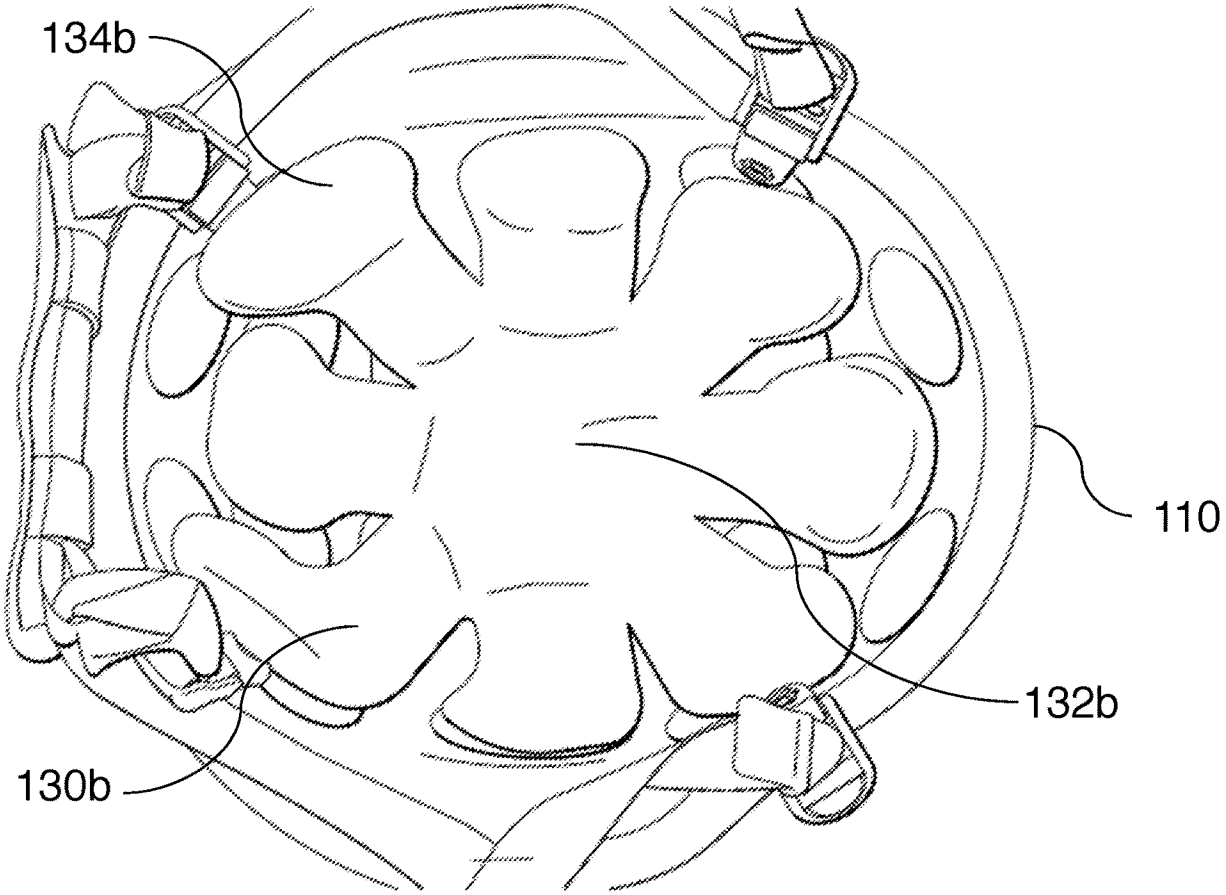
FIG. 7 is an image of the exemplary spacing pad of FIG. 6 in a helmet shell.
Figure 8:
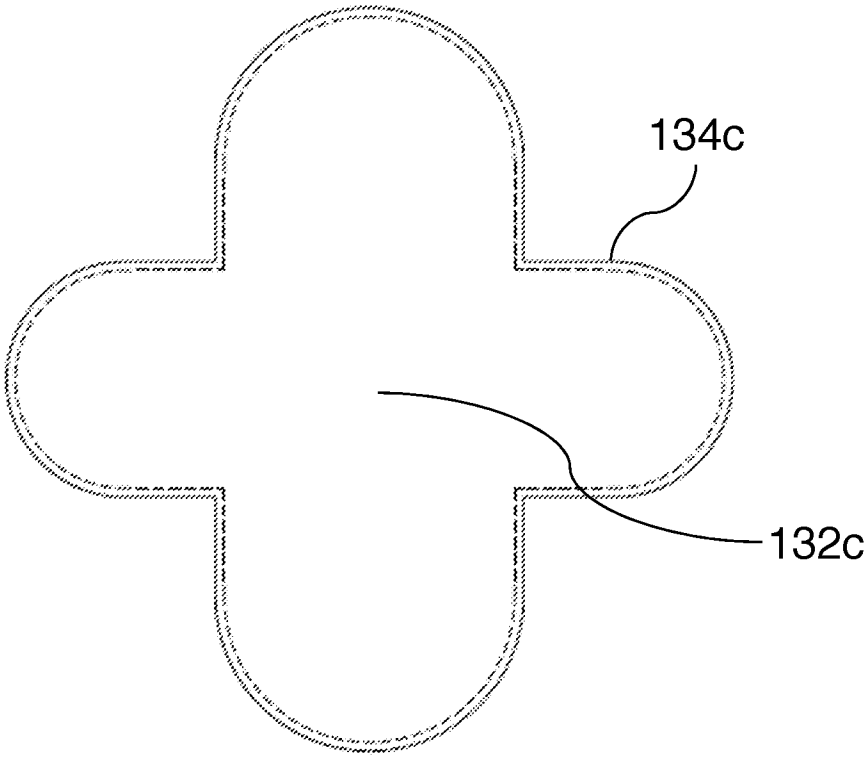
FIG. 8 is an image illustrating yet another exemplary spacing pad of the helmet padding system of FIG. 1.

As shown in FIGS. 4-8, extending portions 134 project outward at regular intervals from their respective central portions 132. As shown in FIGS. 4 and 6, the regular intervals may be approximately every 45°. As shown in FIG. 8, the regular intervals may be approximately every 90°.

As shown in FIGS. 6 and 7, extending portions 134*b* of spacing pad 130*b* have end portions 136*b*. End portions 136*b* have a width greater than the width of the remainder of the respective extending portion 134*b*. The wider end portions 136*b* of spacing pad 130*b* may be desirable in order to provide a large base for absorption pads 150. The wide end portions 136*b* may be made sufficiently wide that the end portions 136*b* of adjacent extending portions 134*b* overlap with each other when spacing pad 130*b* is positioned within the helmet shell.

Additionally, as shown in FIGS. 6 and 7, spacing pad 130*b* may be contained in a liner 137. Liner 137 may be configured to surround spacing pad 130*b* in order to provide a comfortable contact between the user and spacing pad 130*b*.

As shown in FIG. 8, extending portions 134*c* may be arranged axially symmetrically relative to central portion 132*c*. Alternatively, as shown in FIG. 4, extending portions 134*a* may be arranged axially asymmetrically. Additionally, as shown in FIG. 4, extending portions 134*a* may have varying lengths projecting from central portion 132*a*.

The shapes and sizes of extending portions 134*a*, 134*b*, 134*c* may also be dependent on the configuration of helmet shell 110, as set forth below.

As shown in FIGS. 5 and 7, the varying lengths of extending portions 134 may be selected to correspond to a peripheral contour of helmet shell 110. In other words, if the periphery of the helmet shell 110 has a varying contour, the lengths of extending portions 134 may be selected such that, when spacing pad 130 is coupled to helmet shell 110, the end of each extending portion 134 projects to within a specified distance of the periphery of helmet shell 110. In an exemplary embodiment, extending portions 134 project to within 0.125-2.0 inches of the periphery of helmet shell 110.

Helmet shell 110 may include features that would interfere with the path of extending portions 134. Accordingly, as shown in FIGS. 6 and 7, extending portions 134*b* may be shaped to avoid interfering features in helmet shell 110, i.e., by changing direction. As shown in FIG. 6, at least one of the extending portions 134*b* may have a first portion 138 extending in a first direction and a second portion 139 extending from the first portion 138 in a second direction different from the first direction. This may desirably ensure that the entire length of extending portion 134*b* is adhered to the interior of helmet shell 110.

Figure 13:
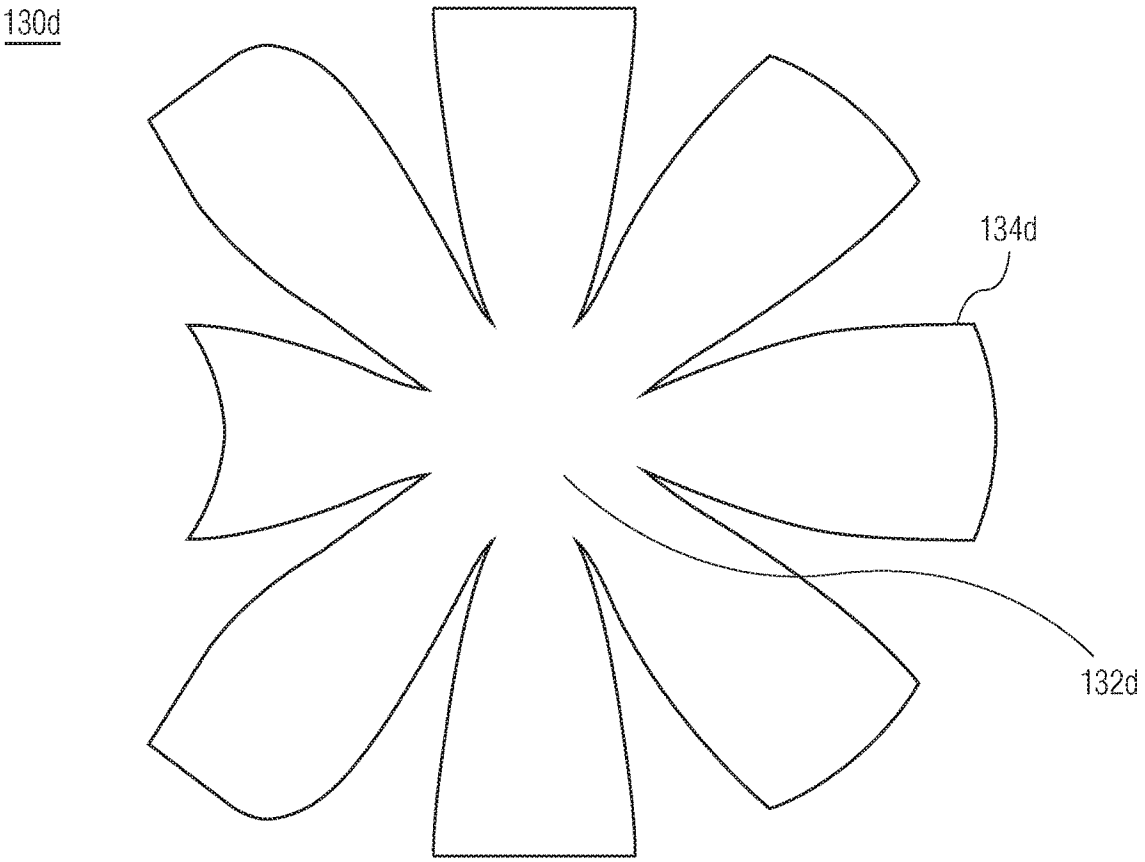
FIG. 13 is an image illustrating another exemplary spacing pad of the helmet padding system of FIG. 1.

Additionally, as shown in FIG. 13, a spacing pad 130*d* may be intended for use in a baseball cap having a rear cut-out (e.g., for access to an adjustable strap). In this embodiment, one of extending portions 134*d* may be shortened and have a rounded edge relative to the other extending portions. This extending portion may be positioned to extend toward the rear cut-out of the baseball cap. This feature may desirably enable all of spacing pad 130*d* to fit comfortably within the baseball cap.

The width and number of extending portions 134 may be selected based on the circumference and size of helmet shell 110. As shown in FIGS. 4 and 6, spacing pad 130 may include a relatively large number of thin extending portions 134. Alternatively, as shown in FIG. 8, spacing pad 130 may include a relatively small number of thick extending portions 134. In an exemplary embodiment, extending portions 134 have a width of approximately 1" to approximately 4".

It will be understood that the number, shape, and size of extending portions 134 in FIGS. 4-8 is shown merely for the purposes of illustration, and is not intended to be limiting. Spacing pads 130 having different numbers of extending portions 134 or differently shaped and sized extending portions 134 may be used without departing from the scope of the present invention, as would be understood by one of ordinary skill in the art from the description herein.

FIGS. 9A-9D illustrate an exemplary impact-resistant pad 200 in accordance with aspects of the present invention. Impact-resistant pad 200 may be worn by a user as part of a protective headgear system during an athletic activity, such as a wrestling match. As a general overview, impact-resistant pad 200 includes a top portion 220 and side portions 240 and 250. Additional details of impact-resistant pad 200 are described herein.

Top portion 220 is configured to be positioned covering a top of the user's head. As shown in FIGS. 9A-9D top portion 220 may be approximately circular, and is sized to cover substantially the entire top of the user's head. In an exemplary embodiment, top portion 220 includes a plurality of openings 222. Openings 222 desirably provide ventilation to the user's head during use of impact-resistant pad 200. As shown in FIG. 9D, openings 222 are formed around the periphery of top portion 220.

Side portions 240 and 250 extend downward from top portion 220. As used herein, the term "side portion" is not intended to mean that portions 240 and 250 are on the "side" of the user's head (as opposed to the front or back). To the contrary, portions 240 and 250 may be located on any side of the user's head. As shown in FIGS. 9B and 9C side portions 240 and 250 cover a front portion and a back portion of the user's head, respectively. As further illustrated in FIG. 9A, back portion 250 extends a greater distance from top portion 220 than front portion 240. This may be desirable in order to provide greater protection to the back of the user's head, and to prevent obstructing the user's view.

Figure 9A:
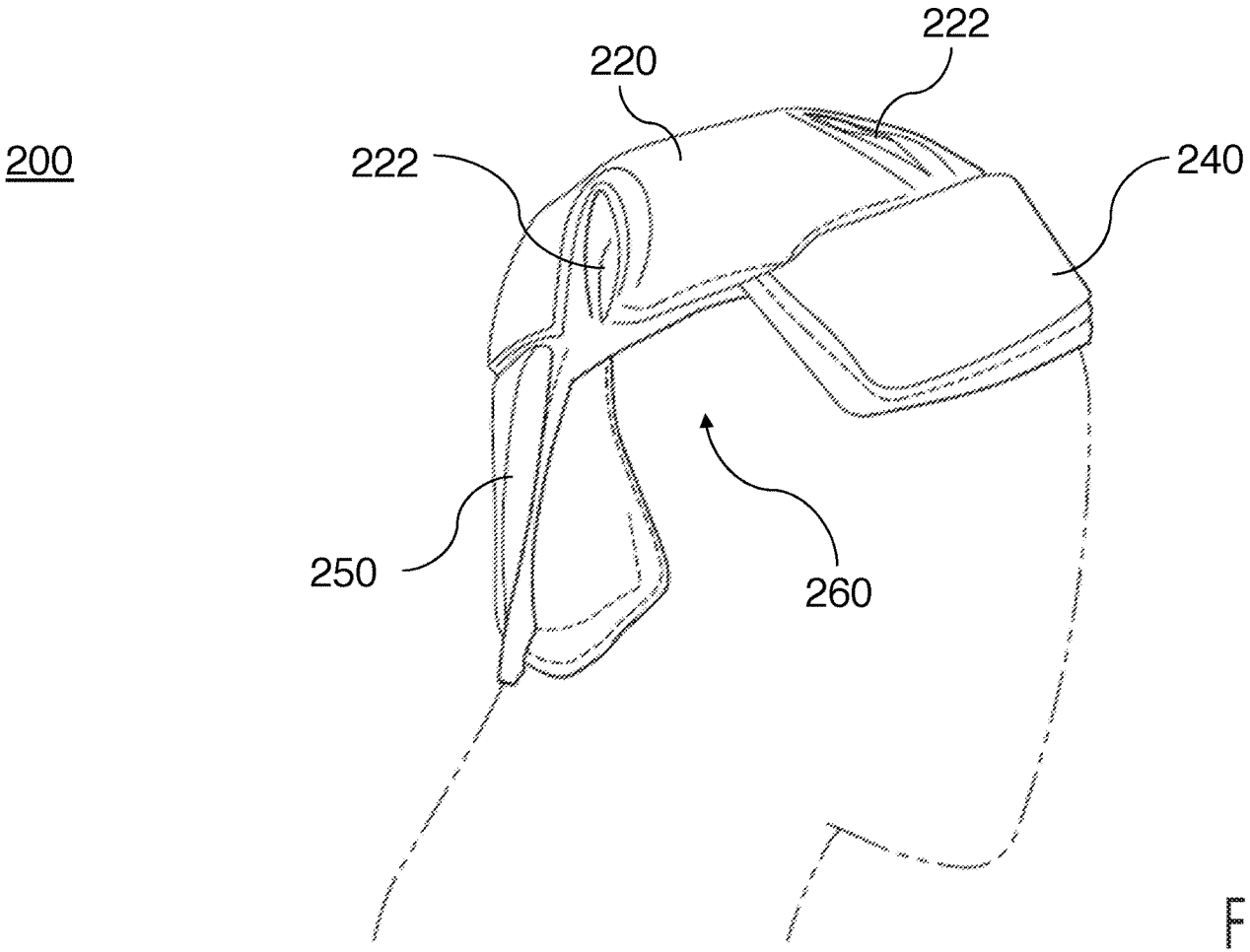
FIGS. 9A-9D are images illustrating an exemplary impact-resistant pad in accordance with aspects of the present invention.
Figure 9B:
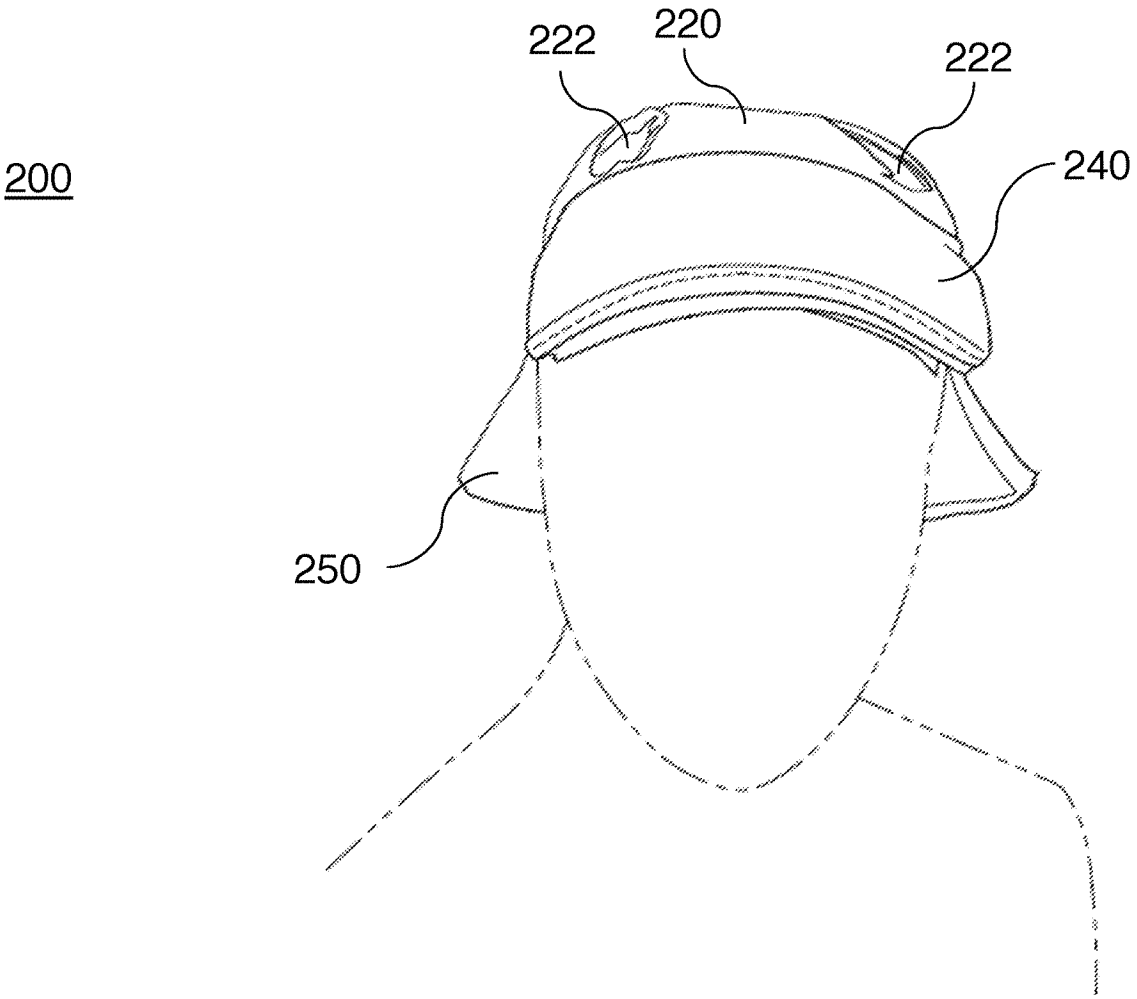
Figure 9C:
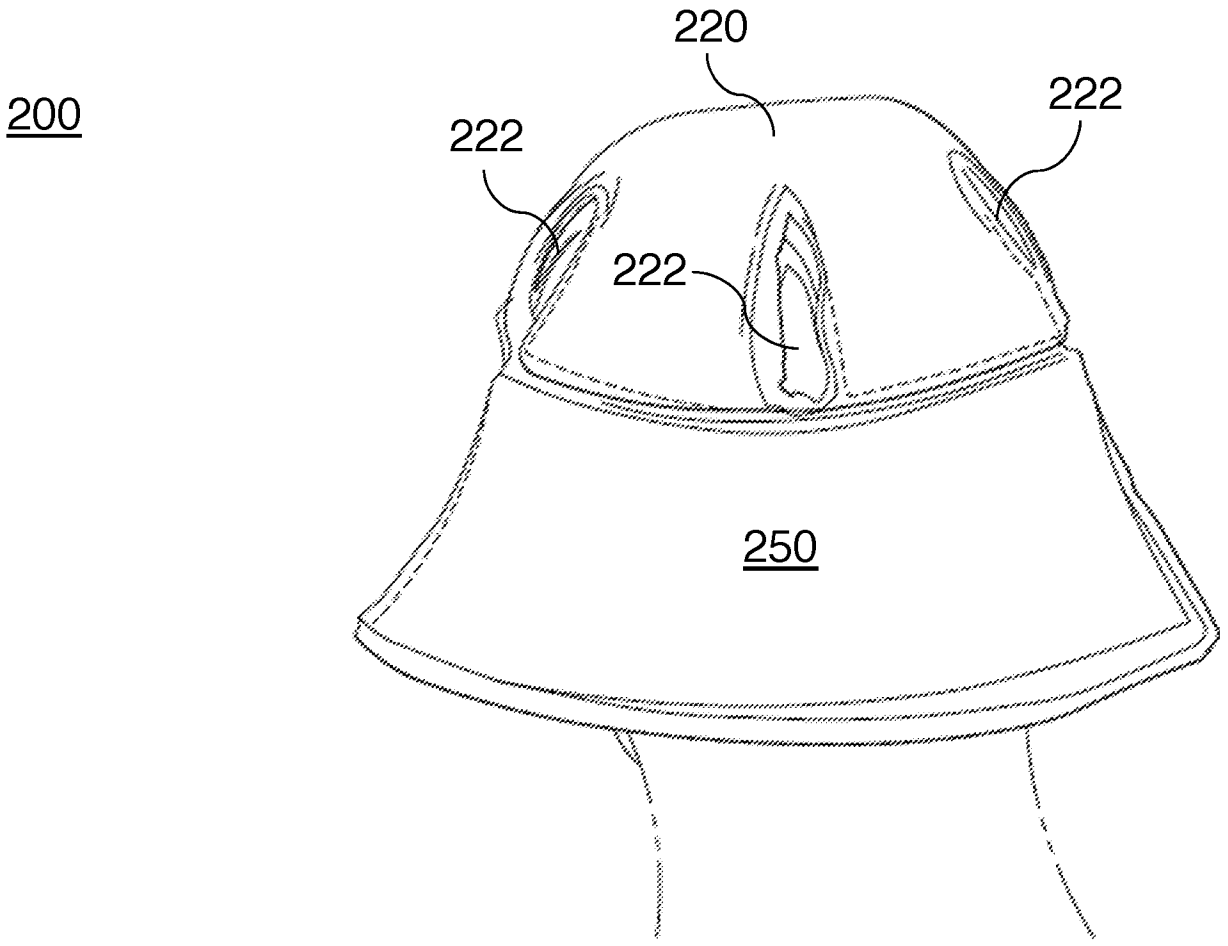
Figure 9D:
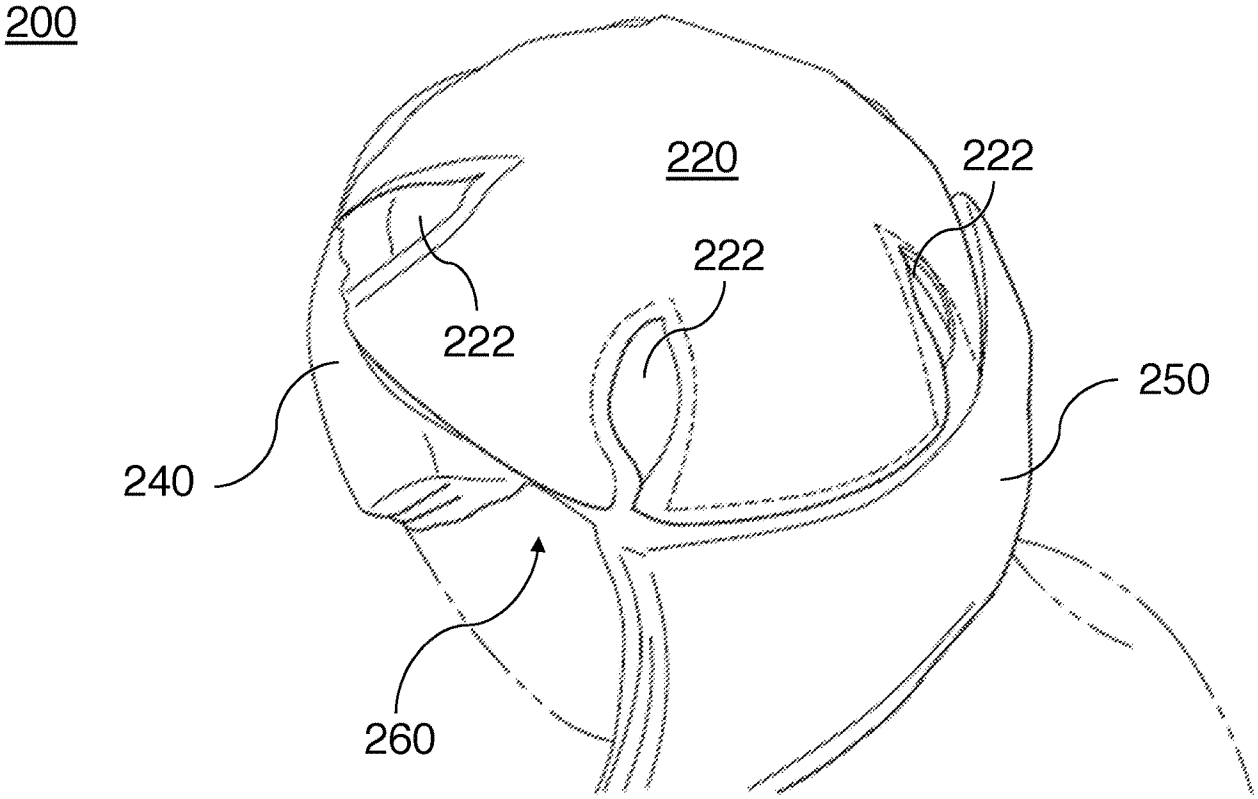

Side portions 240 and 250 are not directly connected to each other, as shown in FIG. 9A. In particular, a circumferential gap 260 is formed between side portions 240 and 250. This may be particularly desirable so that impact-resistant pad 200 may be worn by users of different head sizes. For example, when a user has a relatively small head, the gap 260 will be relatively narrow, and side portions 240 and 250 will sit close to each other (or possibly in contact with each other) when placed on the user's head. However, when a user has a relatively large head, the gap 260 will be relatively large, and side portions 240 and 250 will sit far from each other when placed on the user's head.

It will be understood that the number, shape, and size of side portions 240 and 250 in FIGS. 9A-9D is shown merely for the purposes of illustration, and is not intended to be limiting. Side portions 240 and 250 in different numbers or having different shapes or sizes may be used without departing from the scope of the present invention, as would be understood by one of ordinary skill in the art from the description herein. Impact-resistant pad 200 is formed from substantially the same materials described above with respect to spacing pad 130.

Impact-resistant pad 200 is unconnected to any supporting structure. As will be discussed in further detail herein, impact-resistant pad 200 is configured to be worn under a helmet. To this end, impact-resistant pad 200 is desirably thin. In an exemplary embodiment, impact-resistant pad 200 has a thickness of no greater than approximately 23 mm, and even more preferably, a thickness of no greater than approximately 3 mm. The thickness of impact-resistant pad 200 may be selected based on a number of factors, including for example the type of helmet, the desired level of impact protection, and the type of material encasing the pad (such as moisture-wicking, moisture-absorbent, cloth, or neoprene).

Figure 10A:
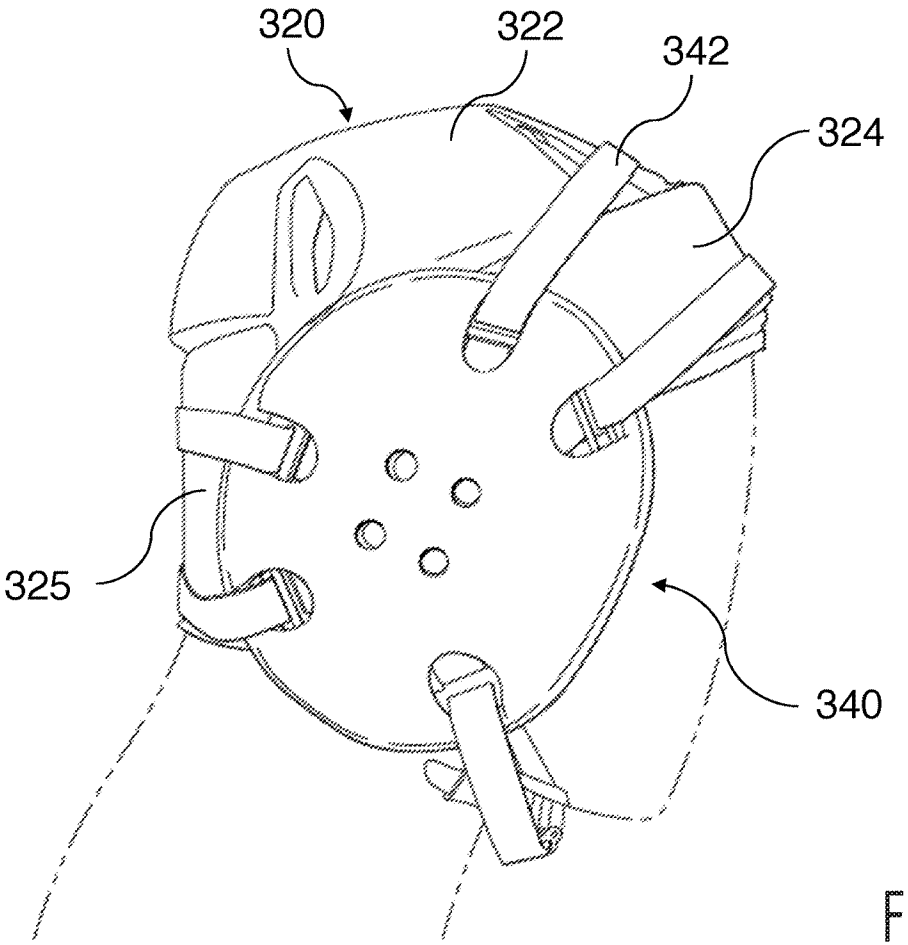
FIG. 10A-10C are images illustrating an exemplary protective headgear system in accordance with aspects of the present invention.
Figure 10B:
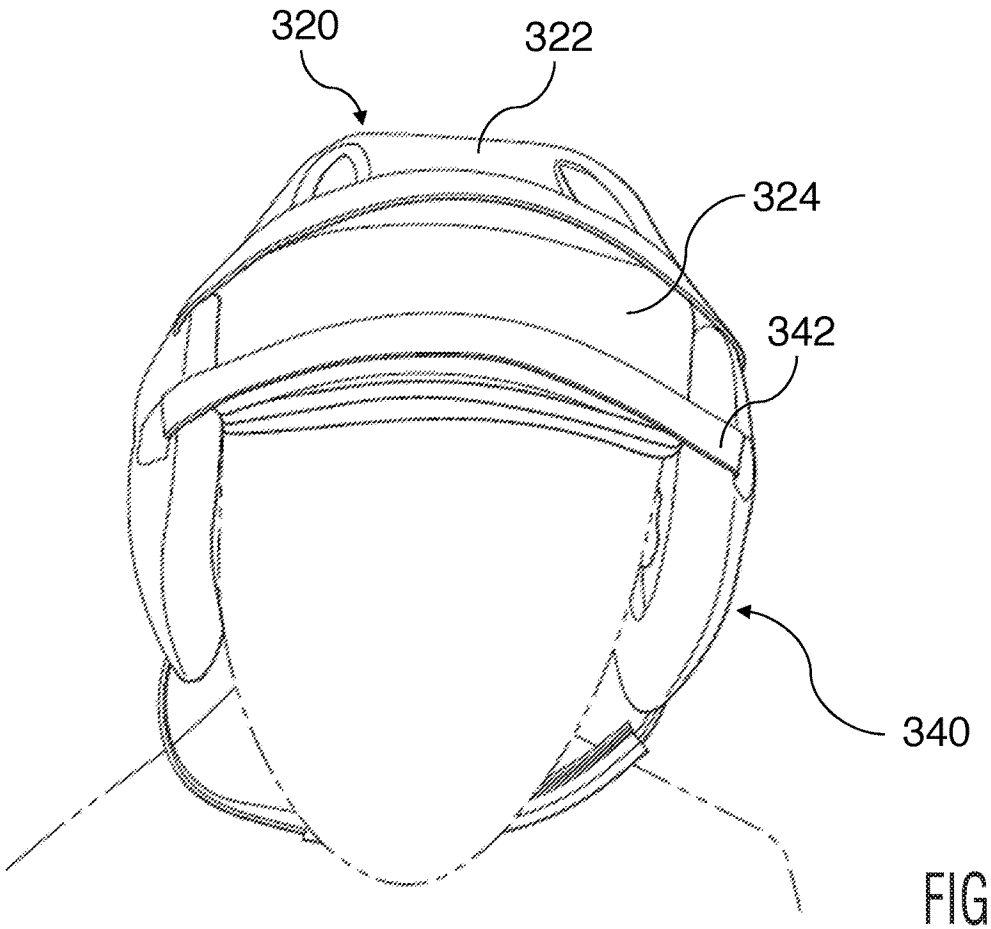
Figure 10C:
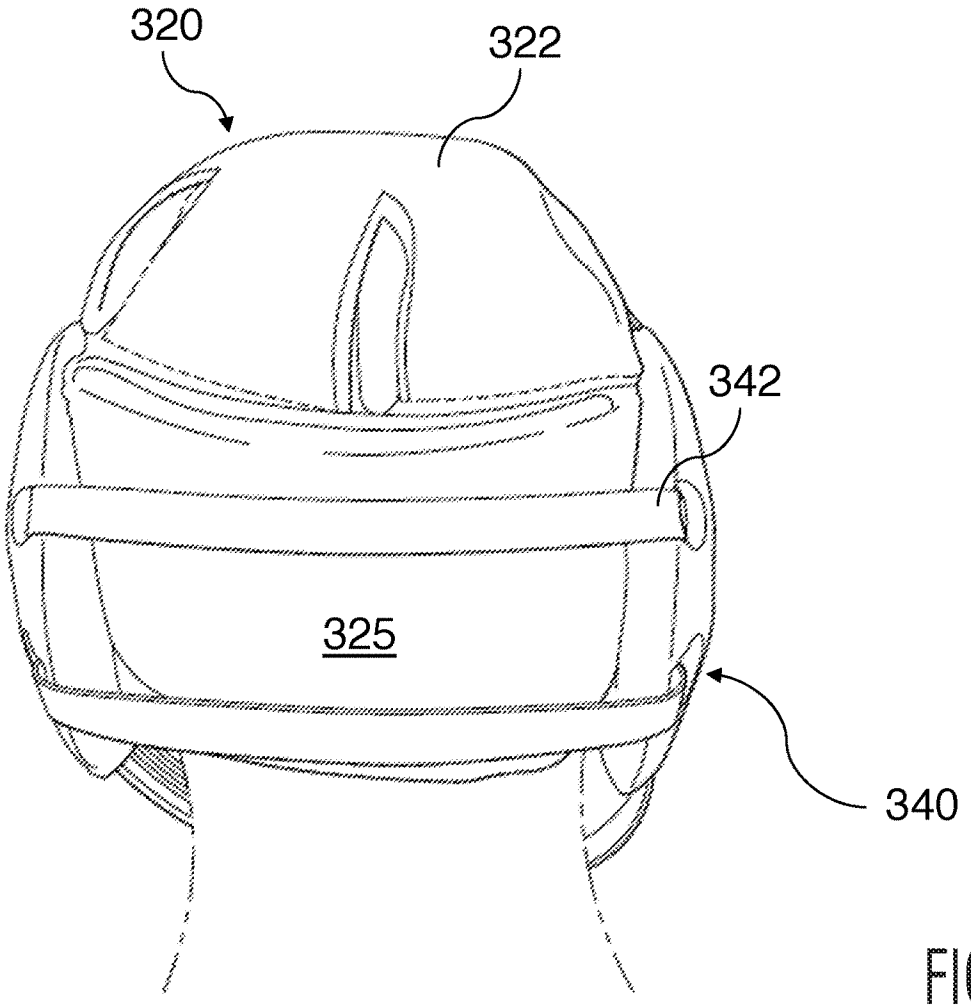

FIGS. 10A-10C illustrate an exemplary protective headgear system 300 in accordance with aspects of the present invention. Protective headgear system 300 may be worn by a user during an athletic activity, such as a wrestling match. As a general overview, protective headgear system 300 includes an impact-resistant pad 320 and a helmet 340. Additional details of protective headgear system 300 are described herein.

Impact-resistant pad 320 is formed from materials designed to dissipate the force of impacts on the user's head. In an exemplary embodiment, impact-resistant pad 320 is an impact-resistant pad substantially as described above with respect to impact-resistant pad 200. In particular, impact-resistant pad 320 includes a top portion 322 configured to be positioned covering a top of the user's head, and side portions 324 and 325 extending downward from top portion 322. Side portions 324 and 325 are not directly connected to each other, and define a circumferential gap (not shown) therebetween.

Helmet 340 is configured to be positioned on a user's head overtop of impact-resistant pad 320. Helmet 340 is unconnected to impact-resistant pad 320. When helmet 340 is positioned overtop of impact-resistant pad 320, helmet 340 covers the circumferential portions of impact-resistant pad 320. In an exemplary embodiment, helmet 340 comprises conventional wrestling headgear, as shown in FIGS. 10A-10C. Helmet 340 includes a plurality of straps 342 for securing helmet 340 to the user's head. Straps 342 extend over top portion 322 of impact-resistant pad 320. Impact-resistant pad 320 may include guide portions (not shown) for receiving and properly positioning straps 342 of helmet 340.

Figure 11:
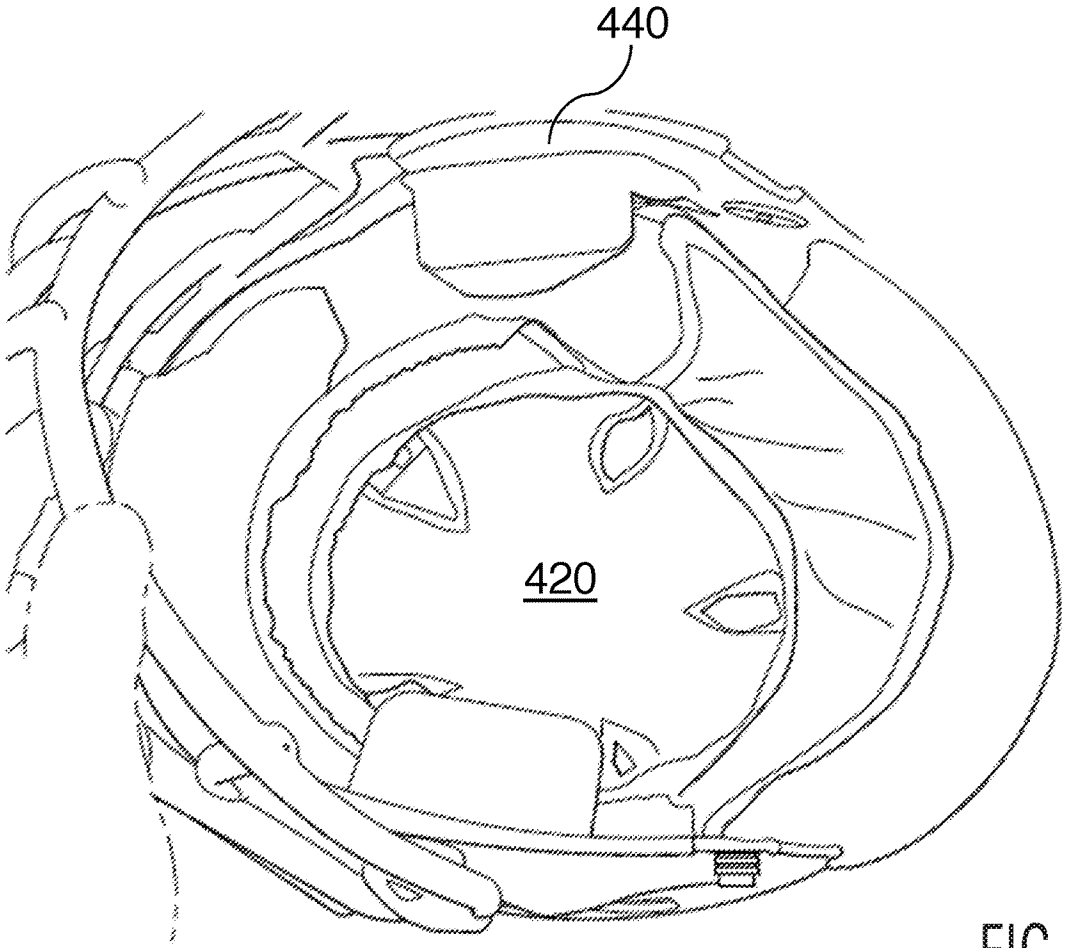
FIG. 11 is an image illustrating another exemplary protective headgear system in accordance with aspects of the present invention.

It will be understood by one of ordinary skill in the art that helmet 340 is not limited to the embodiment shown in FIGS. 10A-10C FIG. 11 illustrates another exemplary protective headgear system 400 in accordance with aspects of the present invention. As a general overview, protective headgear system 400 includes an impact-resistant pad 420 and a helmet shell 440, as shown in FIG. 11. Helmet shell 440 is configured to completely cover the user's head. This may be desirable in order to provide an additional layer of impact-resistance on top of impact-resistant pad 420. The size of helmet shell 440 is selected such that helmet 440 can accommodate impact-resistant pad 420 therein while still being securely positioned on the user's head. In an exemplary embodiment, helmet shell 440 is a helmet shell substantially as described with respect to helmet shell 110. Suitable helmet shells 440 for use with the present invention will be known to one of ordinary skill in the art from the description herein.

Figure 12:
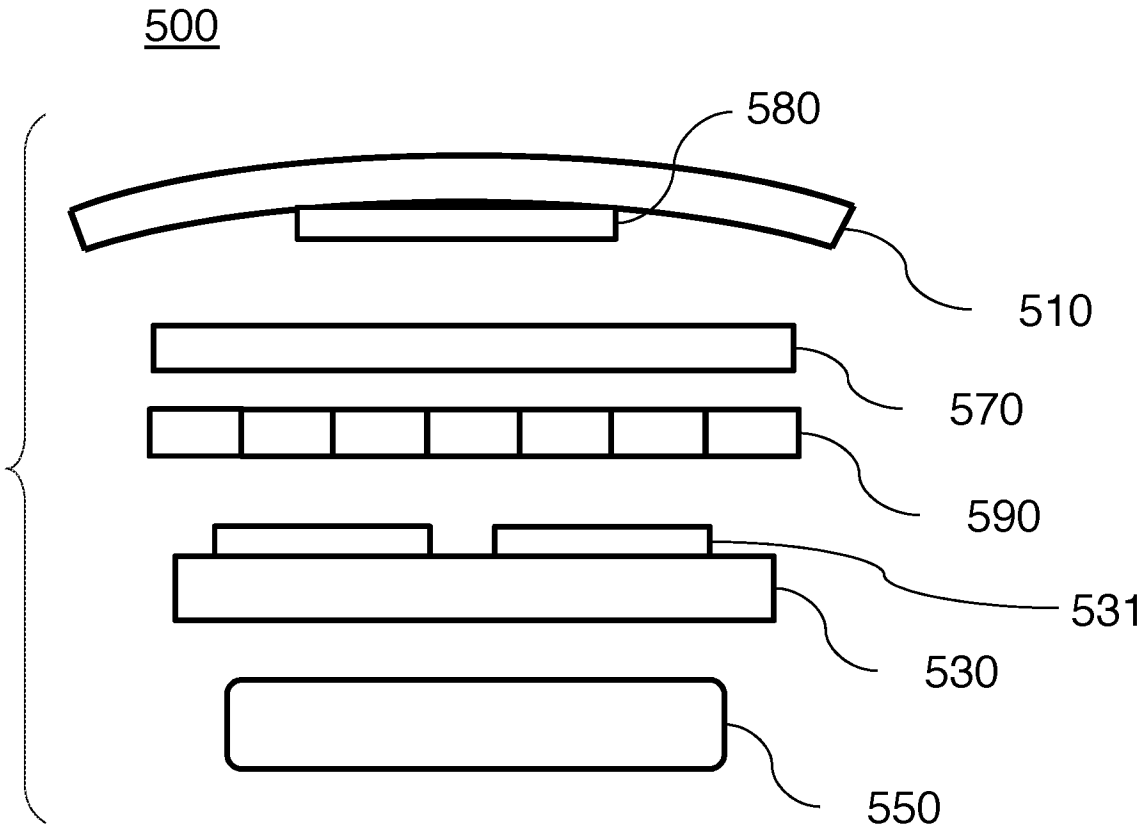
FIG. 12 is a cross-sectional diagram illustrating another exemplary helmet padding system in accordance with aspects of the present invention.

FIG. 12 illustrates an exemplary helmet padding system 500 in accordance with aspects of the present invention. FIG. 12 shows an exploded cross-sectional diagram of helmet padding system 500 through a central portion thereof. Helmet padding system 500 may also be worn by a user during an athletic activity. As a general overview, system 500 includes a helmet shell 510, a spacing pad 530, and a deflection layer 570. Additional details of system 500 are described herein.

Helmet shell 510 is configured to be positioned on a user's head. Helmet shell 510 may be a helmet shell substantially as described with respect to helmet shell 110, or may be a helmet substantially as described above with respect to helmet 340. The size of helmet shell 510 is selected such that helmet shell 510 can accommodate the remaining components of system 500 while still be securely positioned on the user's head.

Spacing pad 530 is positioned within the interior of helmet shell 510. Spacing pad 530 may be a spacing pad substantially as described with respect to spacing pad 130. Alternatively, spacing pad 530 may be an impact-resistant pad substantially as described above with respect to impact-resistant pad 200. Likewise, spacing pad 530 may be formed from any of the materials set forth above with respect to spacing pad 130 or impact-resistant pad 200, and may take any of the shapes described above with respect to spacing pad 130 and/or impact-resistant pad 200. Alternatively, spacing pad 530 may have any other shape suitable for covering a space between the user's head and the helmet shell 510. Spacing pad 530 may also comprise an array of raised portions 531 formed on a surface thereof, as described above with respect to raised portions 131.

Spacing pad 530 is not adapted to be coupled to the interior of helmet shell 510. In other words, spacing pad 530 remains unconnected to helmet shell 510 (or from any other component that is connected to helmet shell 510, e.g., conventional helmet padding provided with helmet shell 510). This enables relative movement between spacing pad 530 and helmet shell 510, which may be important to assist in dissipation of the force from impacts, as explained in further detail below with respect to deflection layer 570.

Helmet padding system 500 may include a plurality of absorption pads 550 coupled to spacing pad 530. Absorption pads 550 may be substantially the same as those described above with respect to absorption pads 150.

Deflection layer 570 is positioned between helmet shell 510 and spacing pad 530. Deflection layer 570 is formed from a material that is less flexible (i.e. stiffer) than spacing pad 530. This enables the hard surface of deflection layer 570 to deflect a portion of the force from impacts along a surface thereof, rather than transmitting that force through deflection layer 570 to spacing pad 530. In other words, it assists in converting forces from impacts into tangential forces (which propagate along the surface) as opposed to normal forces (which propagate through the surface to the user's head). In an exemplary embodiment, deflection layer 570 comprises a sheet of polycarbonate material. Deflection layer 570 may have a shape corresponding to the shape of spacing pad 530, such that the deflection layer 570 completely covers the space between spacing pad 530 and helmet shell 510.

Deflection layer 570 is also not coupled to the interior of helmet shell 510. This creates a "slip plane" between deflection layer 570 and helmet shell 510, and enables relative movement between the two components. Put another way, this allows independent movement of the user's head (with which spacing pad 530 and deflection layer 570 are in contact) and helmet shell 510.

Helmet padding system 500 may also include a plurality of deflection plates 580. Deflection plates 580 may be coupled to the interior of helmet shell 510 in positions such that they slidably abut deflection layer 570. Deflection plates 580 may be coupled to helmet shell 510, e.g., with an adhesive. Deflection plates 580 are formed from the same materials as deflection layer 570. The use of deflection plates 580 coupled to helmet shell 510 may further promote a sliding interface between deflection layer 570 and helmet shell 510, and thereby promote deflecting the force of impacts in a tangential direction along deflection layer 570, rather than through deflection layer 570 to spacing pad 530.

Helmet padding system 500 may also include a deformation layer 590. Deformation layer 590 may be positioned between deflection layer 570 and spacing pad 530. Deformation layer 590 is configured to deform upon experiencing the force from an impact. Deformation layer 590 may undergo elastic (i.e. reversible) or plastic (i.e. irreversible) deformation. In an exemplary embodiment, deformation layer 590 comprises a sheet of corrugated plastic material configured to undergo plastic deformation. As shown in FIG. 12, the sheet of corrugated plastic material may comprise a pair of plastic surface layers separated by a plurality of plastic ridges defining air gaps therebetween. Like deflection layer 570, deformation layer 590 may have a shape corresponding to the shape of spacing pad 530, such that the deformation layer 590 completely covers the space between spacing pad 530 and deflection layer 570.

Deformation layer 590 may undergo plastic deformation, for example, by crumpling, bending, fracturing, or other irreversible changes. Accordingly, deformation layer 590 may need to be periodically replaced following impacts to helmet padding system 500, where such impacts are sufficient to cause significant plastic deformation of deformation layer 590.

The above components of helmet padding system 500 may be contained in a liner (not shown). In particular, a liner may be configured to surround and contain spacing pad 530, deflection layer 570, and deformation layer 590, to maintain their relative positioning and arrangement. The liner may be formed, for example, from a cloth or nylon material to provide a comfortable contact between the user and the components of helmet padding system 500.

FIGS. 14A-14D illustrate another exemplary helmet padding system 600 in accordance with aspects of the present invention. Helmet padding system 600 may be worn by a user during military activities, e.g., under a standard military helmet. As a general overview, system 600 includes a frame 610 and a spacing pad 630. Additional details of system 600 are described herein.

Frame 610 is configured to be positioned on a user's head. Frame 610 comprises a rigid material such as, for example, a plastic or polycarbonate material. The size of frame 610 is selected such that helmet shell 610 can accommodate spacing pad 630 while still be securely positioned on the user's head.

Spacing pad 630 is coupled to frame 610. Spacing pad 630 may be a spacing pad substantially as described with respect to spacing pad 130, and/or may be formed from any of the materials described with respect to spacing pad 130. In particular, spacing pad 630 comprises a central portion 632 and a plurality of extending portions 634 projecting outward from the central portion 632. The plurality of extending portions 634 are fixed to frame 610.

Figure 14A:
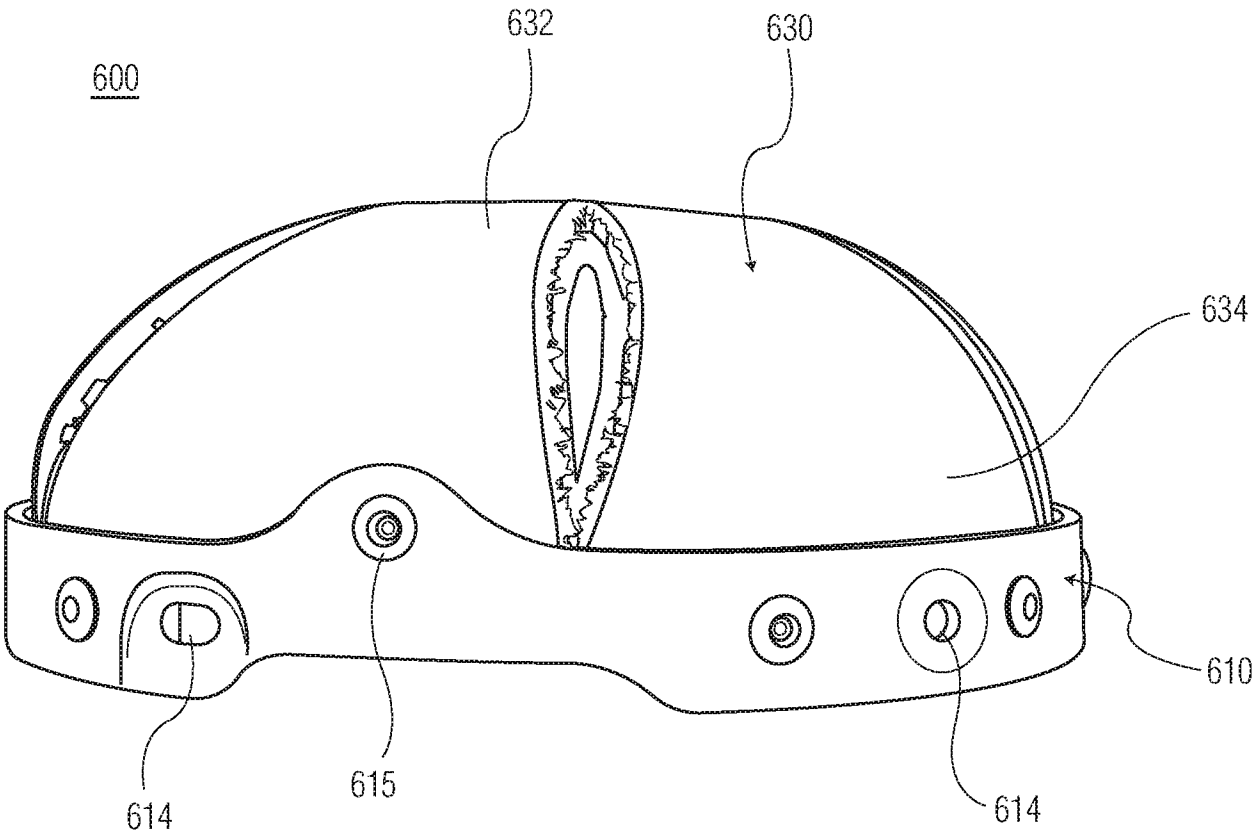
FIGS. 14A-14D are images illustrating another exemplary helmet padding system in accordance with aspects of the present invention.
Figure 14B:
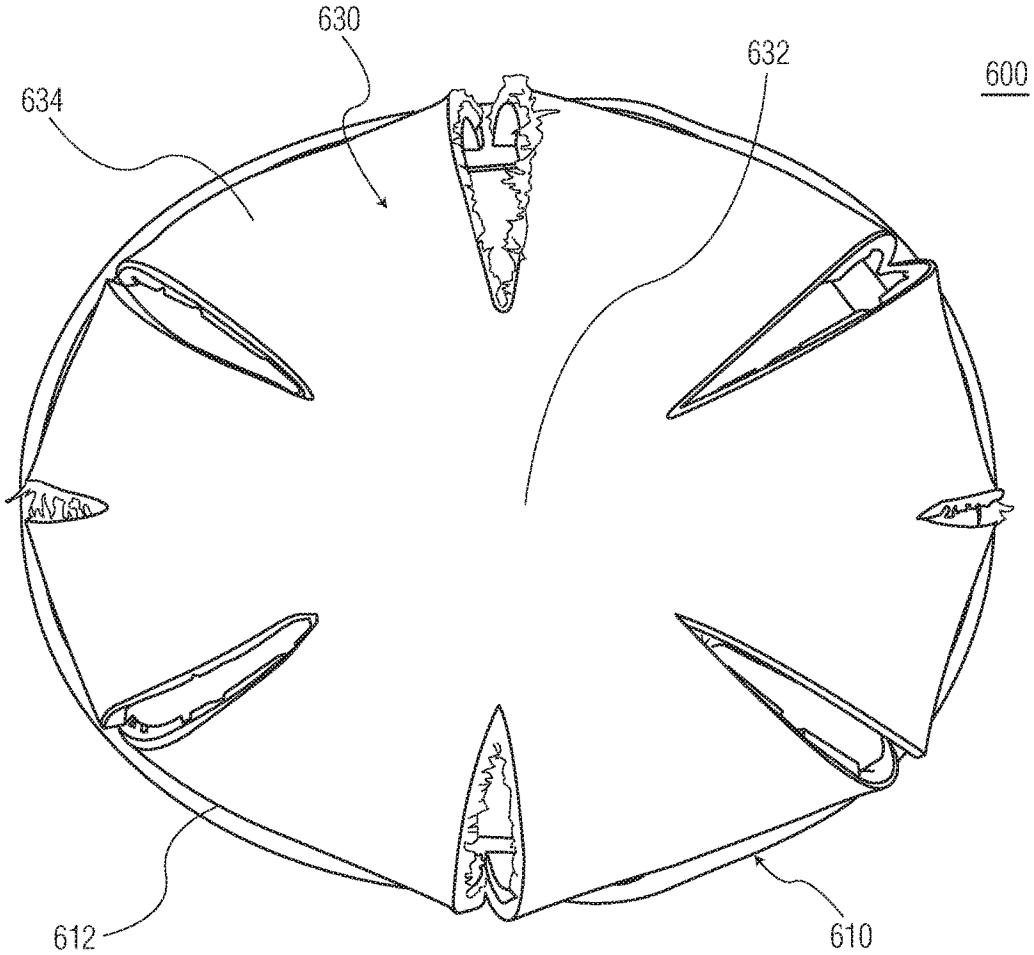

As shown in FIGS. 14A and 14B, each extending portion 630 has an end portion with a greater width than a portion of the respective extending portion coupled to central portion 632. Specifically, extending portions 630 get wider as they extend outwardly from central portion 632. The end portions of extending portions 634 are fixed to frame 610.

In an exemplary embodiment, frame 610 comprises a groove 612, as shown in FIG. 14B. The end portions of each of the plurality of extending portions 634 are inserted within groove 612. The end portions of the plurality of extending portions 634 may be additionally secured to the frame via one or more attachment mechanisms. Suitable attachment mechanisms 615 include, for example, rivets, adhesives, or stitching.

Figure 14C:
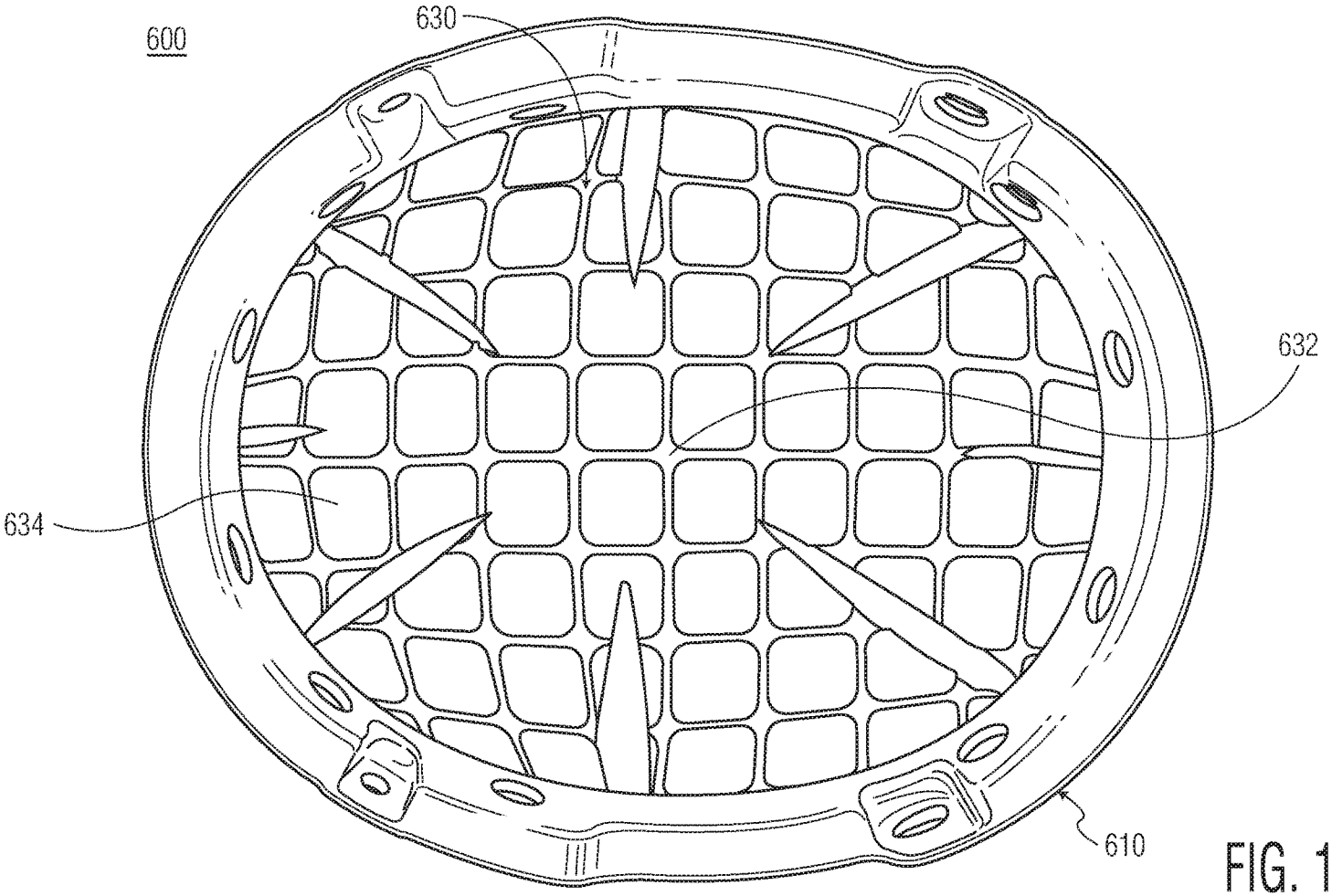
Figure 14D:
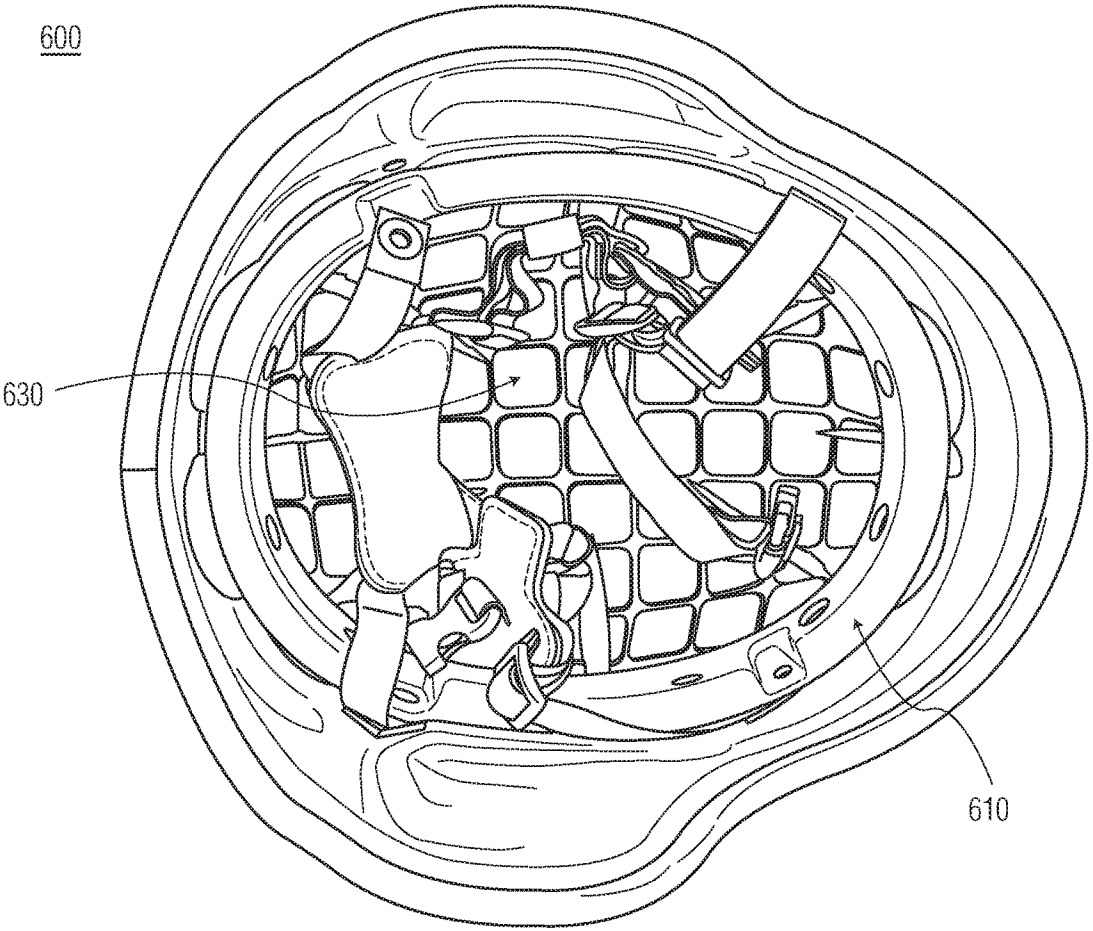

Frame 610 may be configured to be coupled to a helmet, as shown in FIG. 14D. In an exemplary embodiment, frame 610 is configured to be coupled to a standard-issue military helmet. The standard-issue military helmet includes a plurality (e.g. four) pre-arranged mounting points, such as drill holes, in the helmet. In this embodiment, frame 610 includes a plurality of through holes 614 positioned to align with the pre-arranged mounting points in the military helmet. This may desirably simplify the attachment of frame 610 to the helmet. Spacing pad 630 is fixed to frame 610 in such a way that spacing pad does not contact the helmet when frame 610 is coupled to the helmet.

In one exemplary embodiment, frame 610 has a ring shape, as shown in FIGS. 14B and 14C. The plurality of extending portions 634 extend upward from frame 610, such that central portion 623 is positioned above frame 610. This creates a cavity within frame 610 in which the top of the user's head is positioned during use.

Figure 15A:
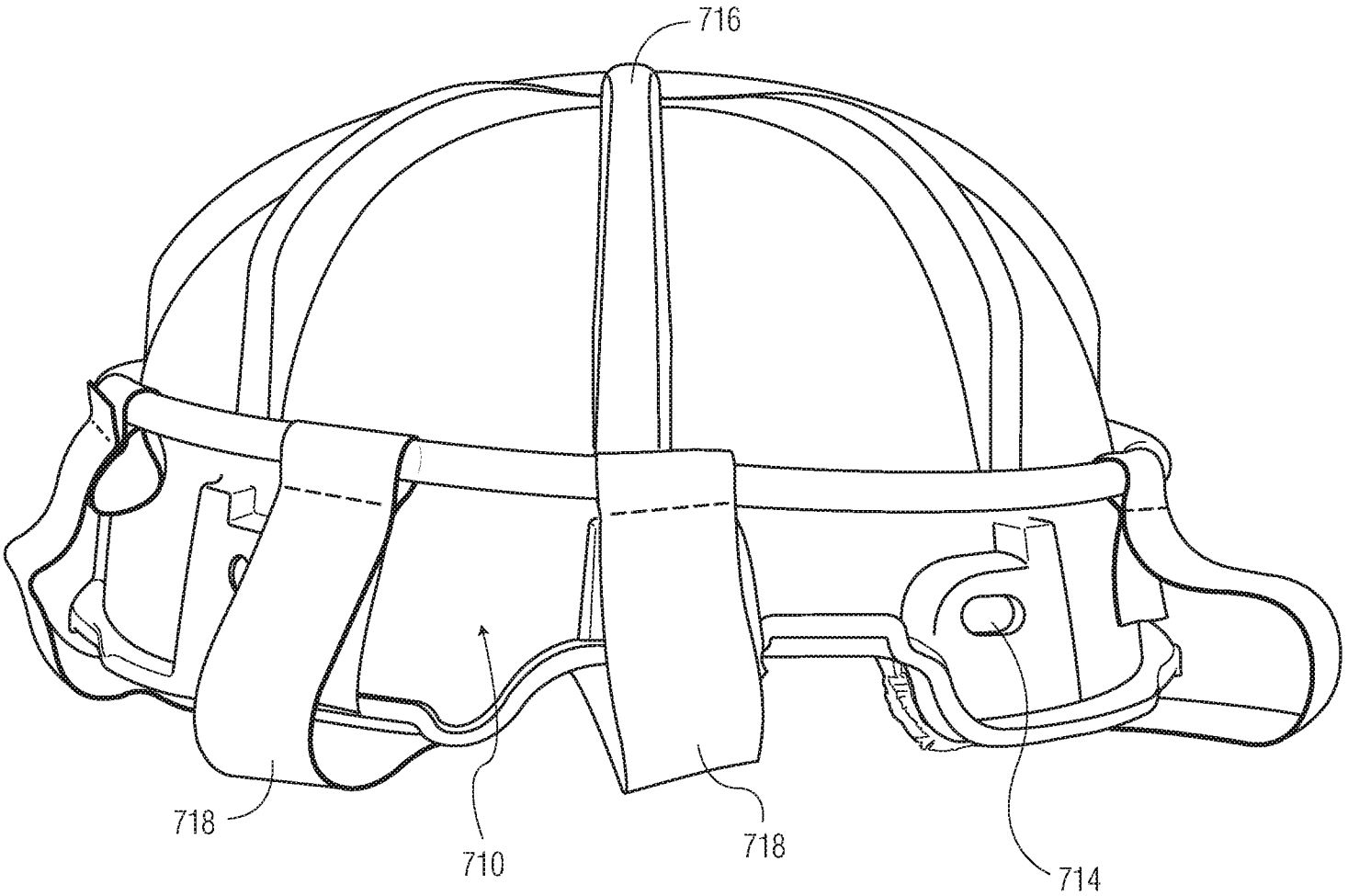
FIGS. 15A-15C are images illustrating an alternative embodiment of the exemplary helmet padding system of FIGS. 14A-14D.
Figure 15B:
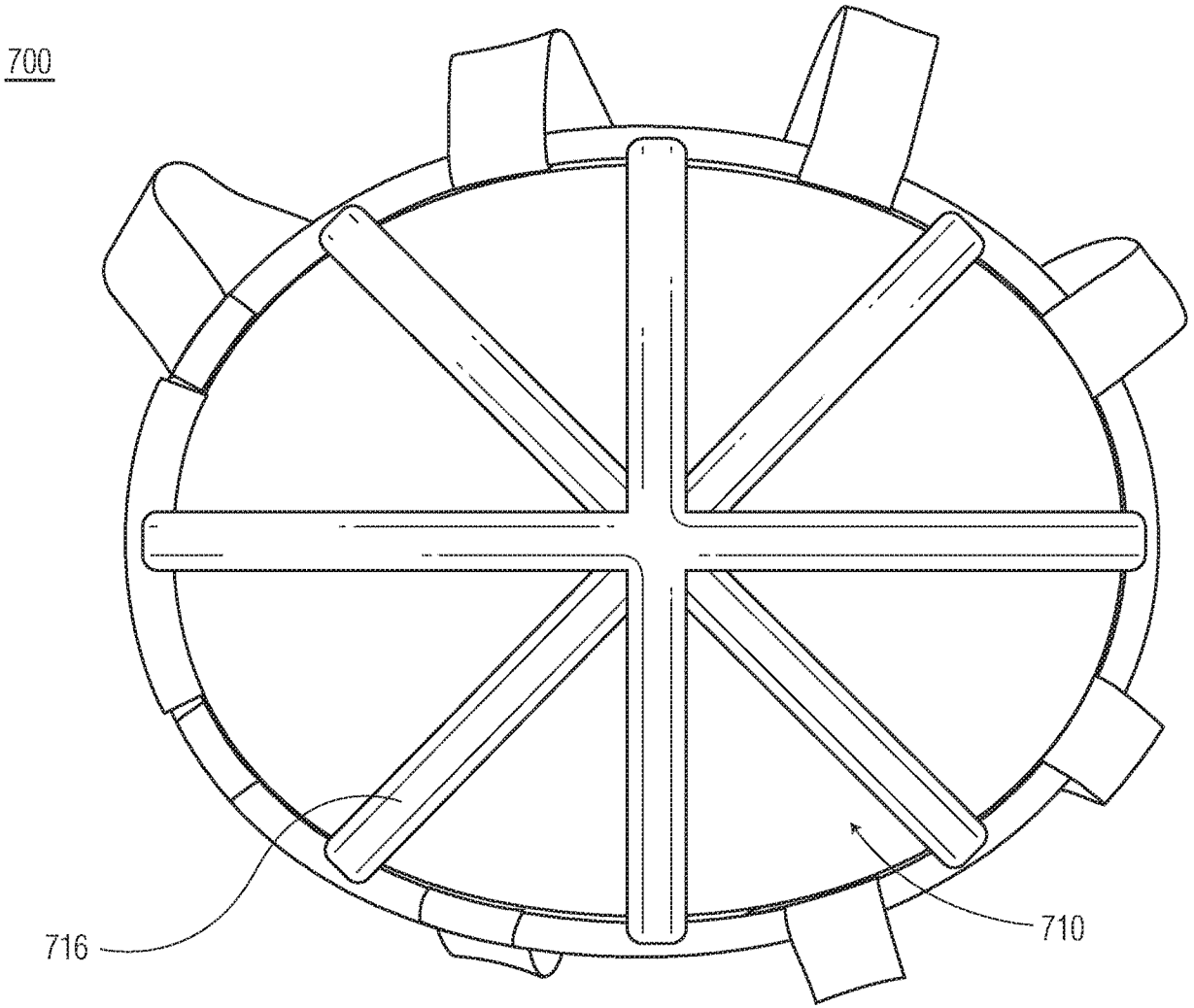
Figure 15C:
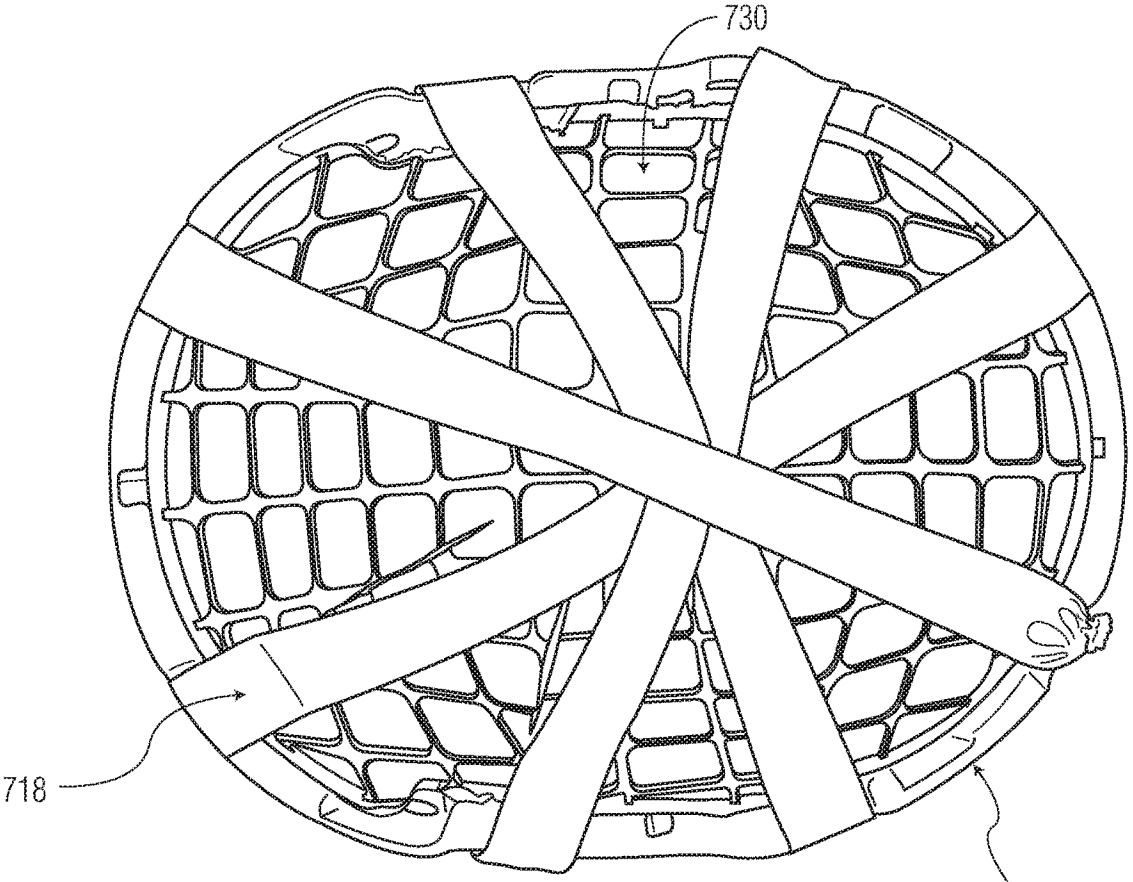

FIGS. 15A-15C illustrate another exemplary helmet padding system 700 in accordance with aspects of the present invention. The helmet padding system 700 is substantially the same as helmet padding system 600, and only the differences between those two embodiments will be described hereinafter.

In an exemplary embodiment, frame 710 of helmet padding system 700 has a dome shape, as shown in FIGS. 15A-15C. The standard-issue military helmet includes a plurality (e.g. four) pre-arranged mounting points, such as drill holes, in the helmet. In this embodiment, frame 710 includes a plurality of through holes 714 positioned to align with the pre-arranged mounting points in the military helmet.

Spacing pad 730 is positioned within the dome, and may be adhered to an inner surface of the dome. The dome-shaped frame 710 includes a plurality of ridges 716 formed on an outer surface thereof. As shown in FIGS. 15A and 15B, ridges 716 extend along frame 710 from edge to edge through a top portion of frame 710. When dome-shaped frame 710 is coupled to a helmet, frame 710 contacts the helmet only along the outermost surfaces of the plurality of ridges 716. This may be desirable in order to minimize the transfer of impact force from the helmet to frame 710. In this embodiment, frame 710 may also include a plurality of straps 718 for enhancing fit and comfort of system 700 when worn by a user, as shown in FIG. 15C.

Helmet padding systems 600 and 700 may also include a deformation layer. The deformation layer may be a layer substantially as described with respect to deformation layer 590. In one embodiment, the deformation layer is positioned between the frame and the spacing pad. In an alternative embodiment, the deformation layer is positioned such that it is between the frame and the helmet when the frame is coupled to the helmet.

As explained above with respect to FIG. 13, the helmet padding systems 800, 900, 1000 of the present invention may be used with baseball caps. In accordance with another aspect of the present invention, a helmet padding system usable with such a baseball-style cap is disclosed. New FIGS. 16-18 disclose alternative embodiments of such a system.

Figure 16:
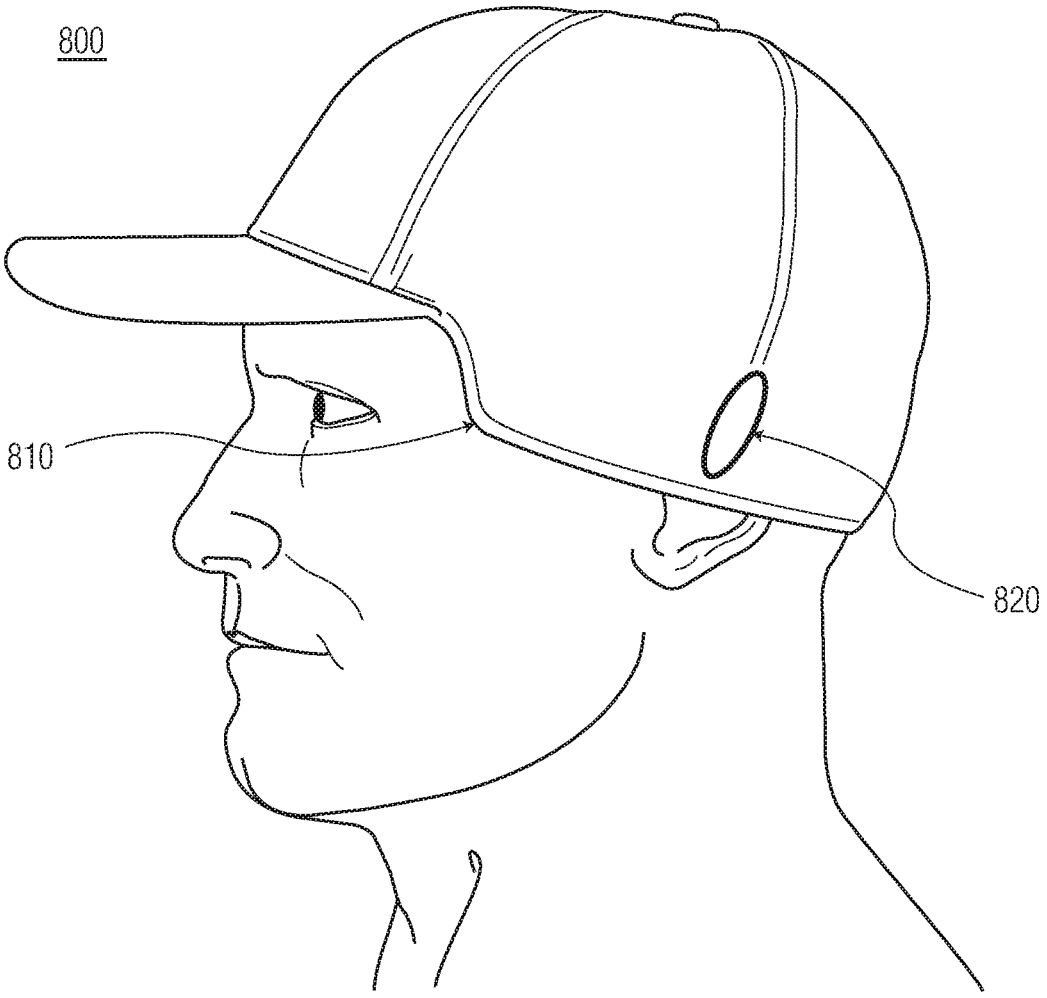
FIGS. 16-18 are images illustrating embodiments of another exemplary helmet padding system in accordance with aspects of the present invention.
Figure 17:
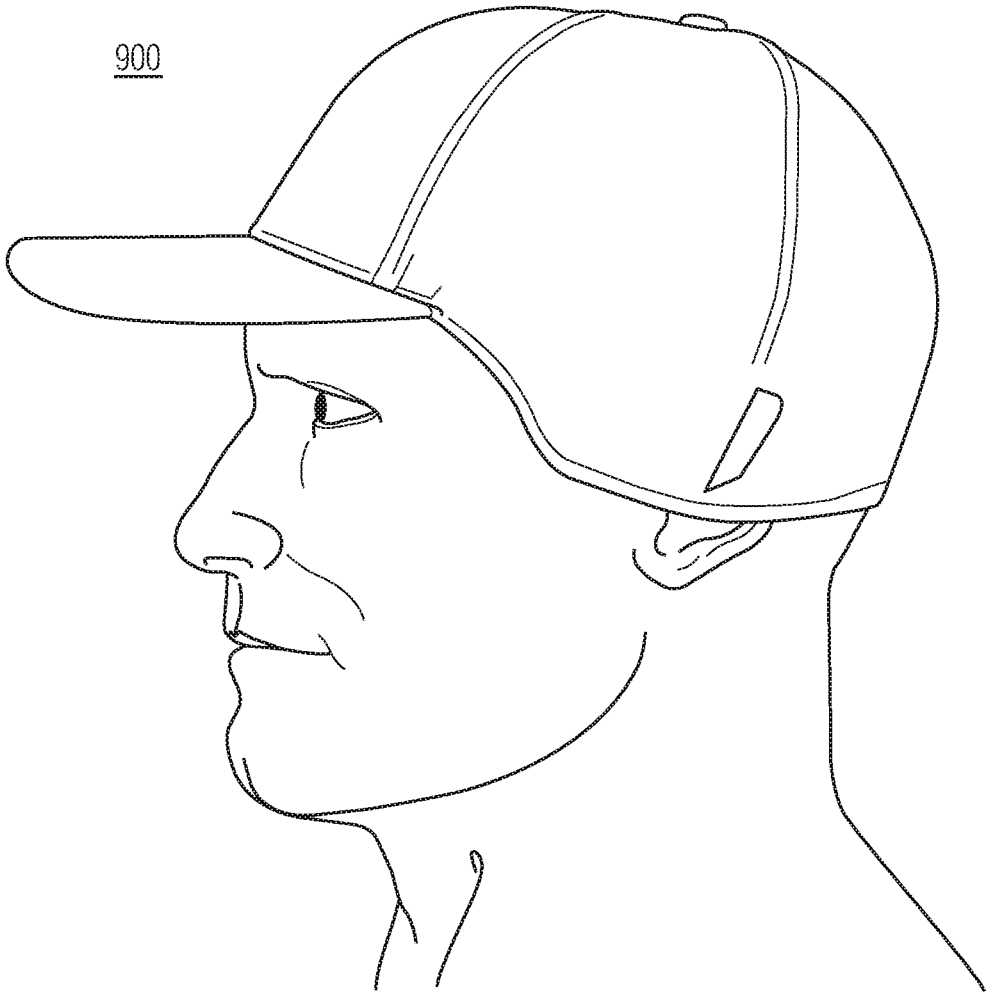
Figure 18:
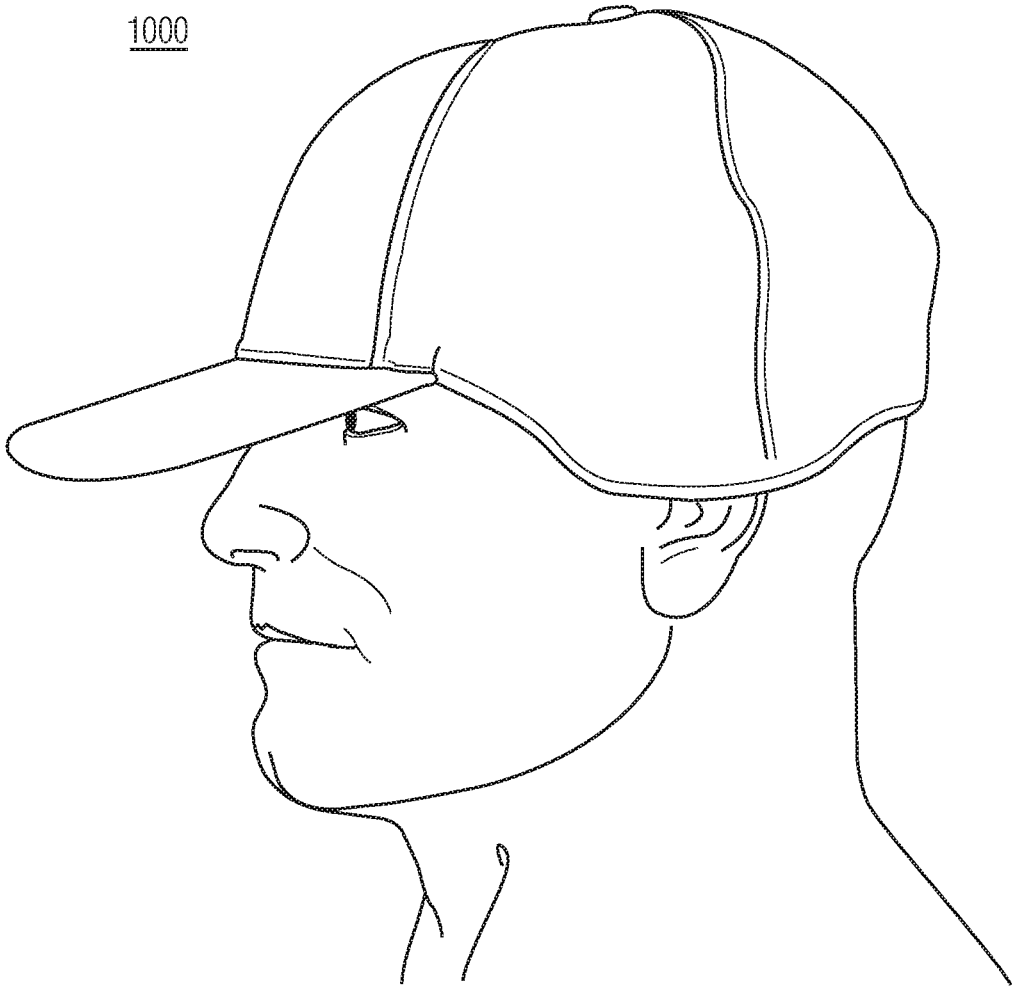

The baseball cap of this system has the style of a normal baseball cap except on sides of the cap. The body of the cap may be formed from flexible material such as cotton or synthetic textiles. The rear of the cap may be fitted to the user's head, or may include a conventional adjustable strap. As shown in FIG. 16, the side 810 of the cap extends downward to cover the user's temple, and at least a portion (preferably at least 50%) of the user's ear. A downward extended portion is formed on both sides of the cap. As shown in FIG. 16, the downward extended portion may extend across the rear of the cap. Alternatively, as shown in FIGS. 17 and 18, the downward extended portion may end (or grow more narrow) across the rear of the cap. As shown in FIG. 16, the cap body may include an opening 820 in the area of the user's ear. The opening may be desirable in order to promote aeration within the cap, and to provide the user better hearing.

Within the cap, a spacing pad is provided. In an exemplary embodiment, spacing pad 130*d* illustrated in FIG. 13 is provided. Alternatively, the cap may include any of the spacing pads and accompanying components described herein. Still further, this system may use conventional foam padding in place of the spacing pad.

The shape of the spacing pad may be selected to maximize coverage of the user's head while minimizing interference with the user's comfort (e.g., by obstructing the user's hearing). In an exemplary embodiment, the spacing pad has one extending portion that extends from the top of the cap to a position forward of the user's ear, to cover the user's temple, and another extending portion that extends from the top of the cap to a position rearward of the user's ear, to cover the base of the user's skull behind their ear. The spacing pad is shaped to leave a gap in the area of the user's ear, to avoid obstructing the user's hearing.

To protect the area of the user's ear, the cap may include a rigid frame. The rigid frame may be formed, for example, from rigid plastic. In an exemplary embodiment, the rigid frame comprises a plurality of rigid outer members extending along the periphery of the gap (adjacent the edges of the spacing pad). The frame may have a substantially round, rectangular, or triangular shape. The frame further comprises an open area between the rigid outer members. The open area in the central portion of the rigid frame is desirable in order to avoid obstructing the user's hearing.

The cap may also include a rigid liner around a peripheral edge of the cap. In an exemplary embodiment, the rigid liner comprises a thin, rigid structure extending around the peripheral edges of the cap. The rim may be formed, for example, from rigid plastic. The rim may desirably be positioned within a fold or pocket of the outer cloth body of the cap, in order to enhance the user's comfort.

Figure 19A:
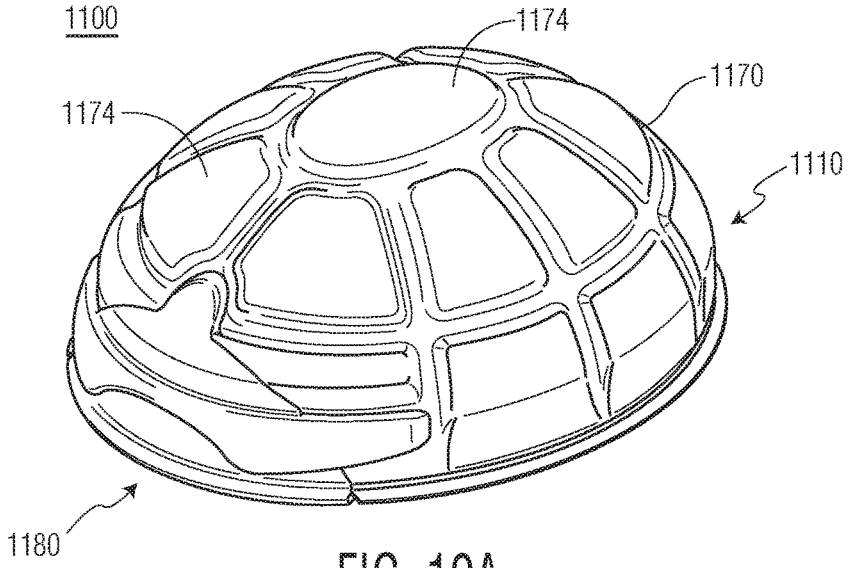
FIGS. 19A and 19B are images illustrating another exemplary helmet padding system in accordance with aspects of the present invention.
Figure 19B:
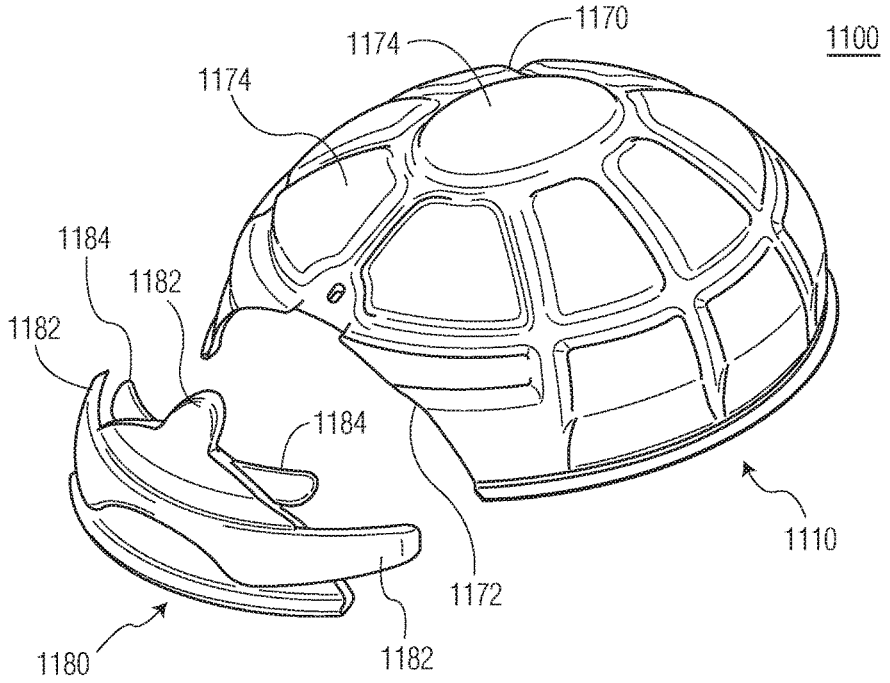

FIGS. 19A and 19B illustrate an exemplary helmet padding system 1100 in accordance with aspects of the present invention. Helmet padding system 1100 may be worn by a user during an athletic activity. Desirably, helmet padding system 1100 may be worn under another piece of headgear, such as a baseball cap. As a general overview, system 1100 includes a main portion 1110 and a removable portion 1180. FIG. 19A shows a view of helmet padding system 1100 with removable portion 1180 coupled to main portion 1110, and FIG. 19B shows a view of helmet padding system with removable portion 1180 separated from main portion 1110. Additional details of system 1100 are described herein.

When system 1100 is worn under a baseball cap having a rear cut-out (e.g., for an adjustable strap), removable portion 1180 is desirably located at the same position as the rear cut-out. In normal use, removable portion 1180 remains coupled to main portion 1110, and provides impact protection to the user in the area of the rear cut-out, in substantially the same manner as main portion 1110. However, a user may also choose to remove removable portion 1180 during use. Removal of removable portion 1180 from main portion 1110 opens up an area of the user's head directly beneath the cut-out of the baseball cap. This may be particularly desirable for users of system 1100 having long hair, who for comfort or other reasons wish their hair to extend through the air of the rear cut-out of the baseball cap. In other words, removal of removable portion 1180 desirably allows certain users to utilize the rear cut-out of their baseball cap as they normally would if they were not wearing a helmet padding system underneath their baseball cap.

Main portion 1110 is configured to be positioned on a user's head. Main portion 1110 may include a plurality of different subcomponents similar to the layers of the various helmet padding systems described herein. In an exemplary embodiment, main portion 1110 includes a spacing pad (not shown), a plurality of absorption pads 1150, and a deflection layer 1170.

The spacing pad of main portion 1110 is positioned within the interior of main portion 1110. The spacing pad may be a spacing pad substantially as described with respect to spacing pad 130. Alternatively, the spacing pad may be an impact-resistant pad substantially as described above with respect to impact-resistant pad 200. Likewise, the spacing pad may be formed from any of the materials set forth above with respect to spacing pad 130 or impact-resistant pad 200, and may take any of the shapes described above with respect to spacing pad 130 and/or impact-resistant pad 200.

In a particularly suitable embodiment, the spacing pad of main portion 1110 has a shape and structure corresponding to spacing pad 130*d*, as shown in FIG. 13. As set forth above, both system 1100 and spacing pad 130*d* may be intended for use in a baseball cap having a rear cut-out (e.g., for an adjustable strap). In this embodiment, the spacing pad of main portion 1110 has a shortened extending portion having a rounded edge relative to the other extending portions, as shown in FIG. 13. In helmet padding system 1100, this extending portion is positioned to extend toward the location of the removable portion 1180 of system 1100. Accordingly, the spacing pad of main portion 1110 does not extend into or otherwise interfere with the area covered by removable portion 1180. System 1100 may also include a separate spacing pad having the same material coupled to the interior of removable portion 1180

Figure 19C:
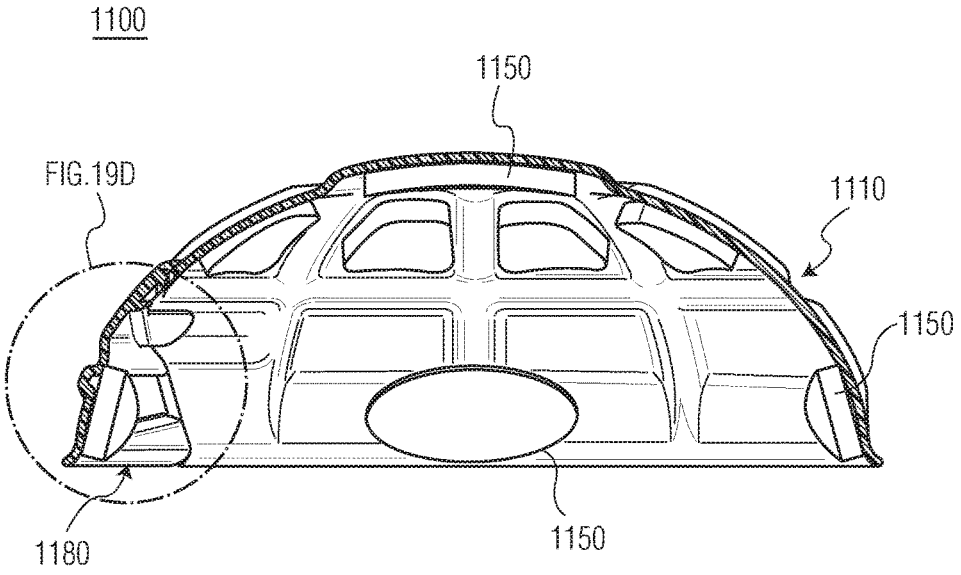
FIGS. 19C and 19D are images illustrating a cross-sectional view of the exemplary helmet padding system of FIGS. 19A and 19B.

Helmet padding system 1100 may include a plurality of absorption pads 1150 coupled to the spacing pad and/or deflection layer 1170. Absorption pads 1150 may be substantially the same as those described above with respect to absorption pads 150 (shown in FIGS. 1 and 3). As shown in FIG. 19C, system 1100 may include absorption pads 1150 on both main portion 1110 and removable portion 1180. One of ordinary skill in the art will understand that the number and positioning of absorption pads 1150 shown in FIG. 19C is done for the purposes of illustration, and is not intended to be limiting.

Deflection layer 1170 is positioned along the exterior of main portion 1110. Deflection layer 1170 may be a deflection layer substantially as described with respect to deflection layer 570 (shown in FIG. 12). In an exemplary embodiment, deflection layer 1170 is formed from polycarbonate material. Deflection layer 1170 is shaped and sized so as to accommodate the components within (including the spacing pad and absorption pads 1150) while comfortably fitting on a user's head. Deflection layer 1170 includes a cut-out portion 1172 (similar to the spacing pad) having a shape corresponding to the shape of the conventional rear cut-out of a baseball cap. Cut-out portion 1172 is sized to accommodate the removable portion 1180 therein in order to form (with removable portion 1180) an approximately continuous dome shape on the top of the user's head. Deflection layer 1170 may further include one or more projecting sections 1174 to enhance the ability of system 1100 to dissipate the force of impacts to the user's head.

Deflection layer 1170 is not adapted to be coupled to the interior of the baseball cap. As with deflection layer 570, this creates a "slip plane" between deflection layer 570 and the baseball cap, and enables relative movement between the two components. Put another way, this allows independent movement of the user's head (with which the spacing pad and deflection layer 1170 are in contact) and the baseball cap.

Removable portion 1180 is configured to be coupled to and removable from main portion 1110. Removable portion 1180 may be formed from substantially the same materials as main portion 1110. In particular, removable portion 1180 may include a spacing pad, absorption pad, and deflection layer the same as those used in the formation of main portion 1110. Removable portion 1180 is shaped to correspond to the shape of the conventional rear cut-out of a baseball cap, and is sized to be received with the cut-out portion 1172 of the deflection layer 1170 of main portion 1110.

Removable portion 1180 may be coupled to main portion 1110 by a number of different mechanisms. In an exemplary embodiment, removable portion 1180 is frictionally coupled to main portion 1110, as shown in FIGS. 19A and 19B. In this embodiment, removable portion 1180 includes tabs 1182 adapted to slide along the outer surface of main portion 1110, and tabs 1184 adapted to slide along the inner surface of main portion 1110. Tabs 1182 and 1184 sandwich main portion 1110 therebetween, thereby creating a friction fit that holds removable portion 1180 in place against main portion 1110.

Figure 19D:
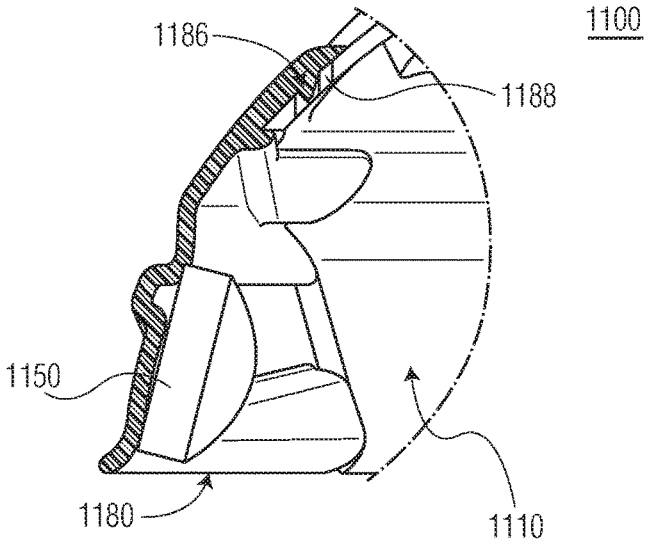

Alternatively or additionally, removable portion 1180 may be coupled to main portion 1110 using one or more snapping mechanisms, as shown in FIGS. 19C and 19D. In this embodiment, removable portion 1180 includes a projection 1186 position to mate with a corresponding aperture 1188 on main portion 1110. When removable portion 1180 is properly positioned against main portion 1110, projection 1186 is received within aperture 1188, thereby snapping removable portion 1180 in place against main portion 1110. The snapping mechanism may be configured to frictionally maintain the connection until a predetermined pressure is applied to unsnap removable portion 1180 from main portion 1110.

The above embodiments allow removable portion 1180 to be both uncoupled from and recoupled to main portion 1110. However, in some embodiments, removable portion 1180 may not be permanently recoupled to main portion 1110. In one embodiment, removable portion 1180 may be attached to main portion through one or more weakened, thinned, or perforated pieces of material (e.g., the material of deflection layer 1170). Removable portion 1180 may then be permanently removed from main portion 1110 by breaking this area of weakened material.

Figure 20A:
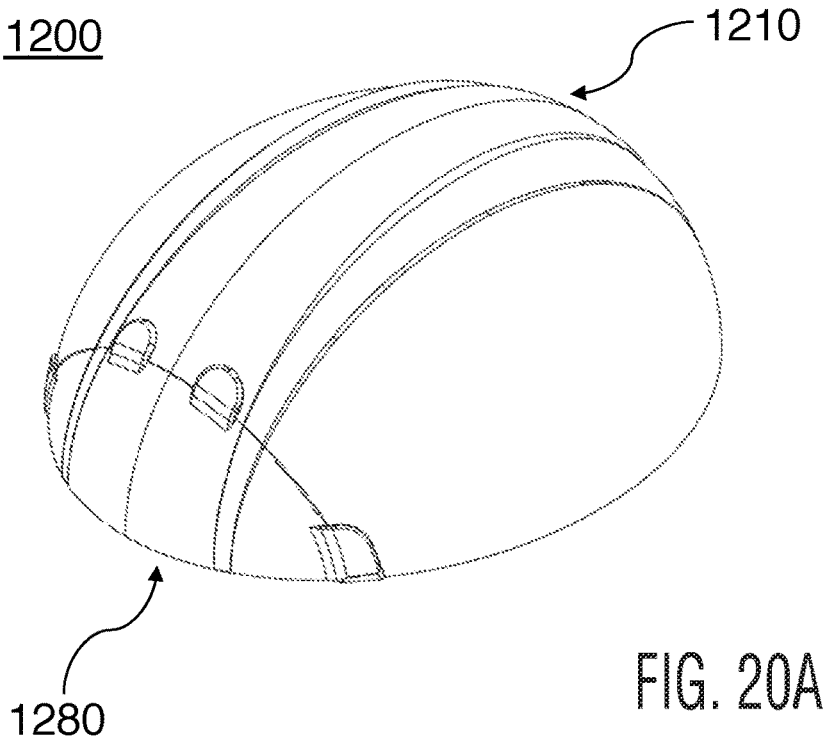
FIGS. 20A and 20B are images illustrating an alternative embodiment of the helmet padding system of FIGS. 19A and 19B.
Figure 20B:
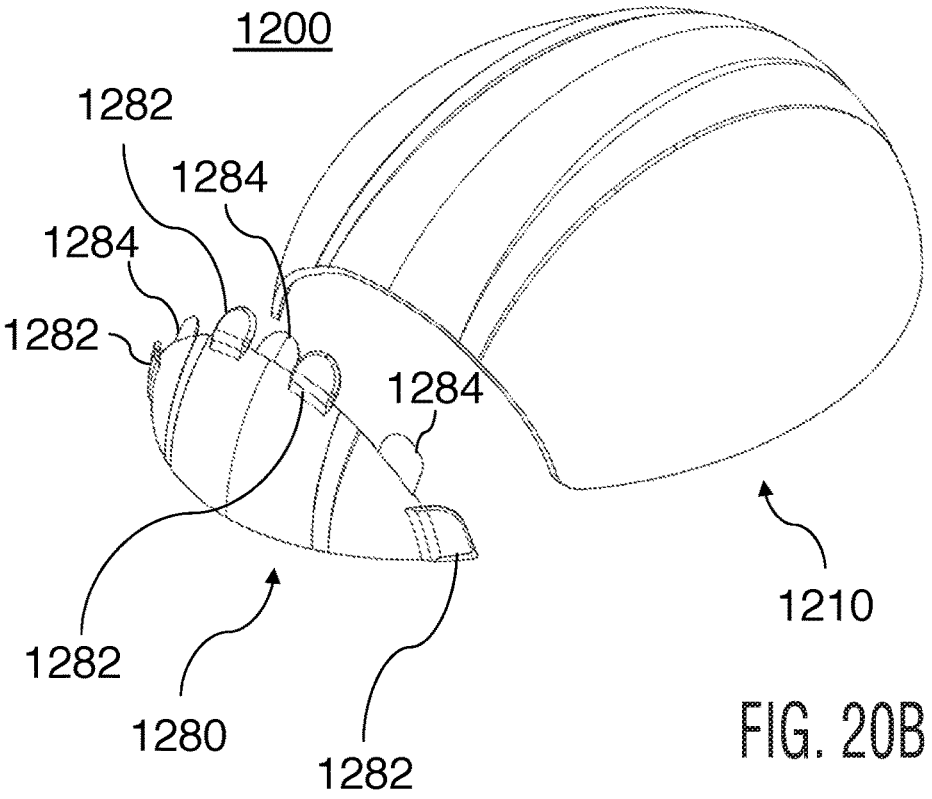
Figure 21:
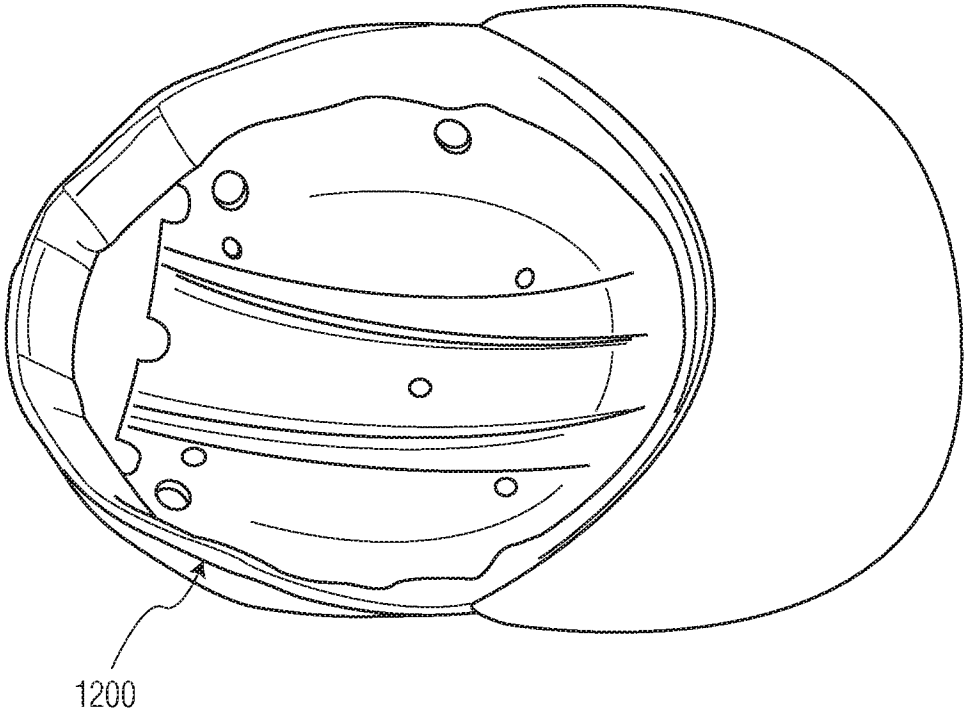
FIG. 21 is another image illustrating the embodiment of FIGS. 20A and 20B within a conventional cap.

FIGS. 20A and 20B illustrate an alternative embodiment 1200 of helmet padding system 1100. As shown in FIGS. 20A and 20B, the deflection layer of helmet padding system 1200 has a more streamlined outer surface, without the projecting sections of system 1100. This may enable helmet padding system 1200 to more easily fit within or underneath a baseball cap, as shown in FIG. 21.

As shown in FIG. 20B, removable portion 1280 is frictionally coupled to main portion 1210 by a plurality of outer surface tabs 1282 and a plurality of inner surface tabs 1284 adapted to slide along the inner surface of main portion 1110. Tabs 1282 and 1284 sandwich main portion 1210 therebetween, thereby creating a friction fit that holds removable portion 1280 in place against main portion 1210. When system 1200 is used underneath a baseball cap having a rear cut-out, removable portion 1280 may optionally be removed to allow users with long hair to extend their hair out through the cap's rear cut-out.

Figure 22:
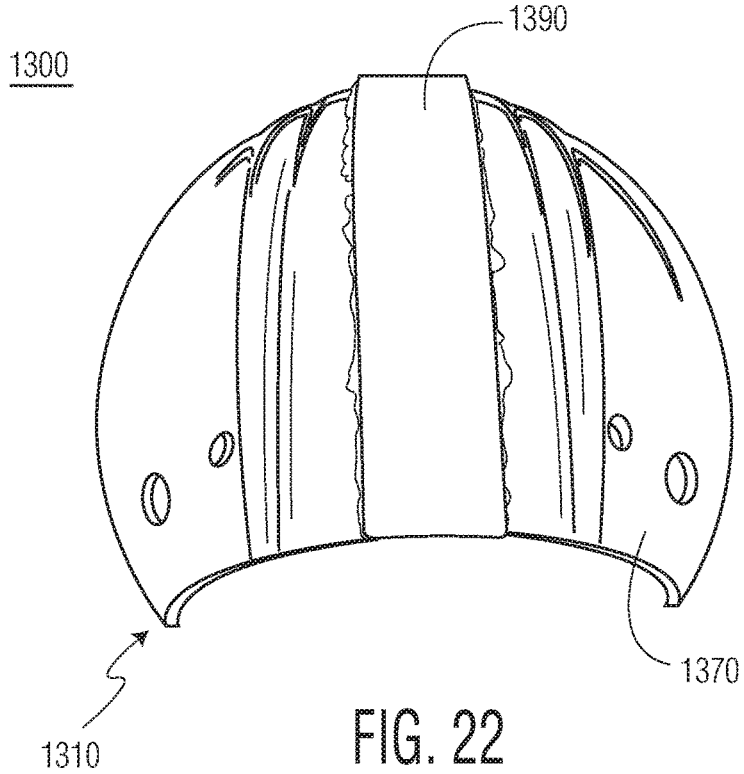
FIGS. 22 and 23 are images illustrating another exemplary helmet padding systems in accordance with aspects of the present invention.
Figure 23:
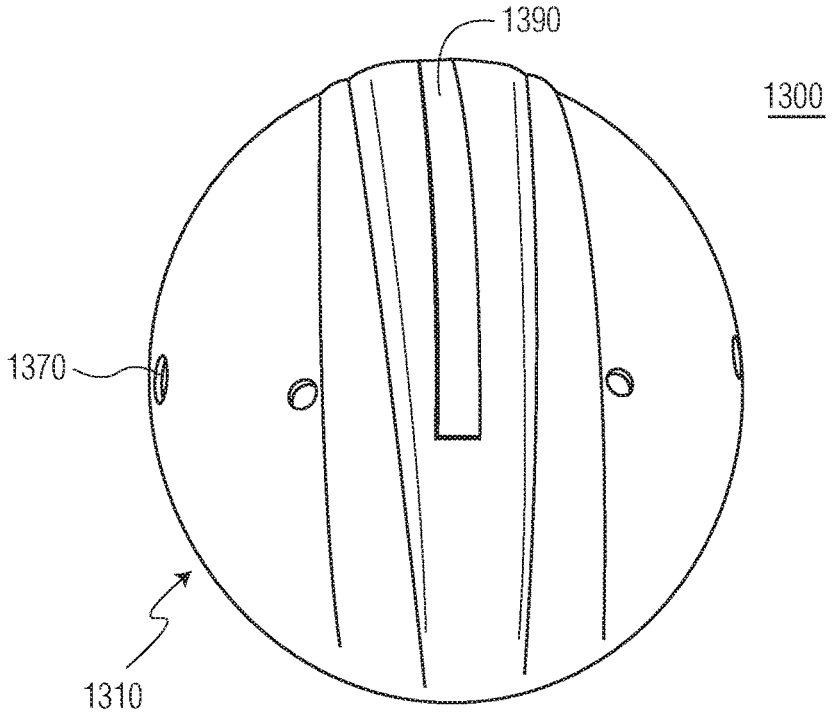

FIGS. 22 and 23 illustrate another exemplary helmet padding system 1300 in accordance with aspects of the present invention. As with systems 1100 and 1200, helmet padding system 1300 may be worn by a user during an athletic activity, and desirably, may be worn under another piece of headgear, such as a baseball cap. Generally, system 1300 includes the same components set forth above with respect to system 1100. Additional features forming part of system 1300 are set forth below.

Main portion 1310 of system 1300 includes a cushioning portion 1390. Cushioning portion 1390 extends into a cut-out area of deflection layer 1370. In an exemplary embodiment, cushioning portion 1390 extends into a cut-out area along a centerline of deflection layer 1370 from a front-most edge of deflection layer 1370 toward a rearward portion of deflection layer 1370. Cushioning portion 1390 separates opposed portions of deflection layer 1370 in order to enable movement of one side of deflection layer 1370 relative to the other side of deflection layer 1370. Such movement may desirably assist system 1300 in dissipating the force of impacts to a user's head.

Cushioning portion 1390 is formed from a material that is more flexible and/or compressible than the material of deflection layer 1370. In an exemplary embodiment, cushioning portion is formed from the same materials as absorption pads 150 or 1150.

The length of cushioning portion 1390 may be adjusted to optimize the force-dissipating effect provided. In one exemplary embodiment, cushioning portion 1390 extends along the entire length of deflection layer 1370, from the front-most edge to the rear edge of cut-out portion, as shown in FIG. 22. In an alternative embodiment, cushioning portion 1390 does not extend along the entire length of deflection layer 1370, but terminates before the rear edge, as shown in FIG. 23. Additionally, the width of cushioning portion 1390 may be adjusted to optimize the force-dissipating effect provided. In an exemplary embodiment, the width across cushioning portion 1390 may be from about 0.3 inches to about 3.0 inches.

Figure 24A:
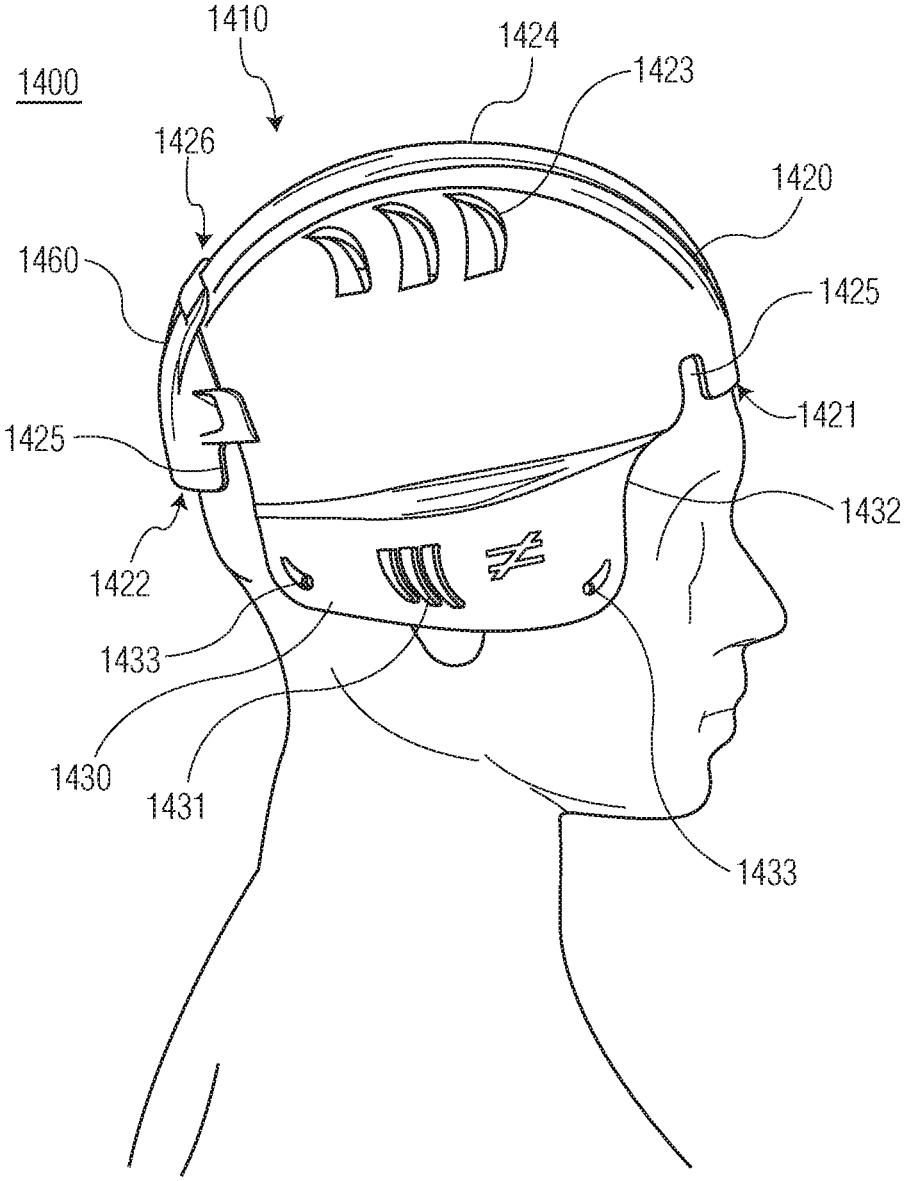
FIGS. 24A-24C are images illustrating another exemplary helmet padding system in accordance with aspects of the present invention.
Figure 24B:
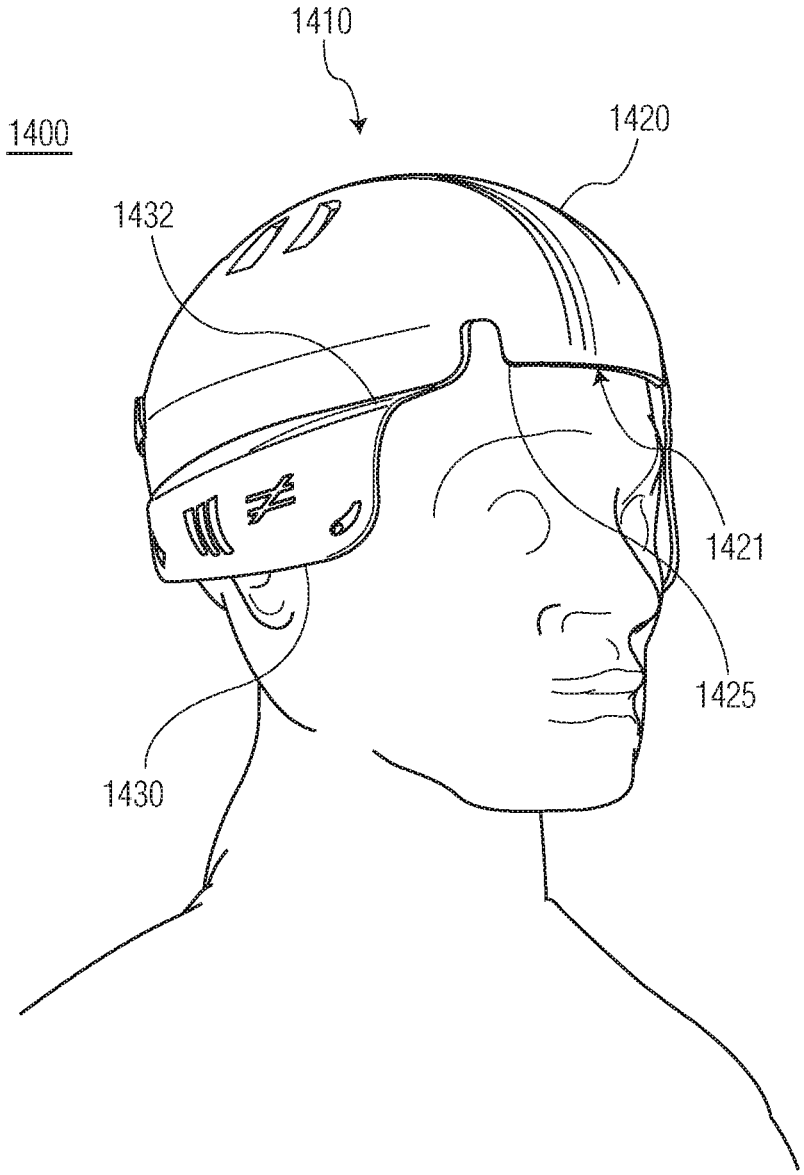
Figure 24C:
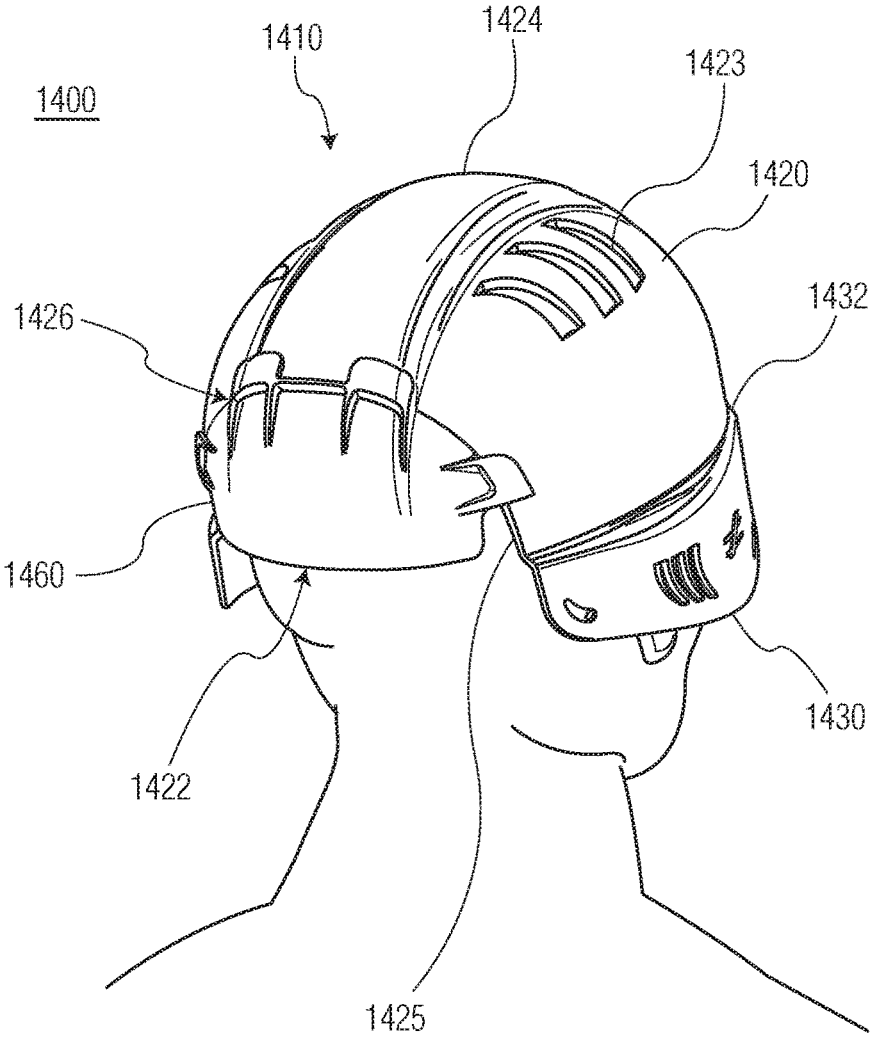

FIGS. 24A-24C illustrate an exemplary helmet padding system 1400 in accordance with aspects of the present invention. Helmet padding system 1400 may be worn by a user during an athletic activity. Desirably, helmet padding system 1400 may be worn under another piece of headgear, such as a baseball cap, knit winter cap, beanie, or other piece of aesthetic headwear. As a general overview, system 1400 includes a rigid shell 1410 and a spacing pad 1440. Additional details of system 1400 are described herein.

Rigid shell 1410 is configured to cover the top of a user's head. Rigid shell 1410 is sized to be worn under a baseball cap. Accordingly, it may be desirable that rigid shell 1410 be formed from a thin, rigid material. In an exemplary embodiment, rigid shell 1410 is formed from a polycarbonate material, as described above with respect to deflection layer 1170. The material may have a thickness of less than approximately 5 mm, and more desirably, less than approximately 3.5 mm. Forming rigid shell 1410 with a low profile (i.e. thin size) is desirable to promote use of helmet padding system 1400 by eliminating interference with the aesthetic features of the headgear (e.g., baseball cap) worn on top of rigid shell 1410.

Rigid shell 1410 includes a body portion 1420 and a pair of side portions 1430. Body portion 1420 has a lower front edge 1421 extending between the pair of side portions 1430. When worn under a baseball cap, lower front edge 1421 is positioned adjacent the brim of the baseball cap. Body portion 1420 further includes a lower rear edge 1422 extending between the pair of side portions 1430 opposite lower front edge 1421.

In one embodiment, lower rear edge 1422 of body portion 1420 has approximately the same height as lower front edge 1421, as shown in FIG. 24A. In this embodiment, lower rear edge extends along approximately the same circumferential line (around the user's head) as lower front edge 1421. In this embodiment, when rigid shell 1410 is worn under a baseball cap (such as a fitted baseball cap) lower rear edge 1422 is positioned adjacent the lower edge of the cap.

Figure 25:
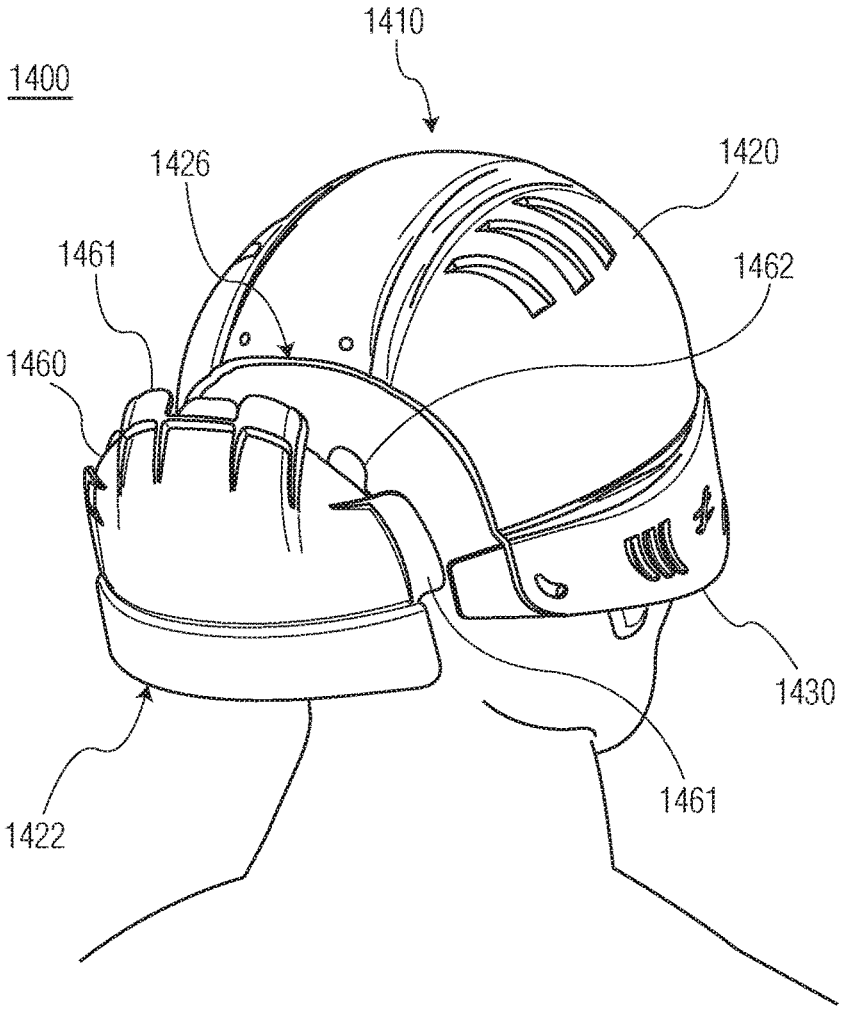
FIG. 25 is an image illustrating an exploded embodiment of the helmet padding system of FIGS. 24A-24C.
Figure 26:
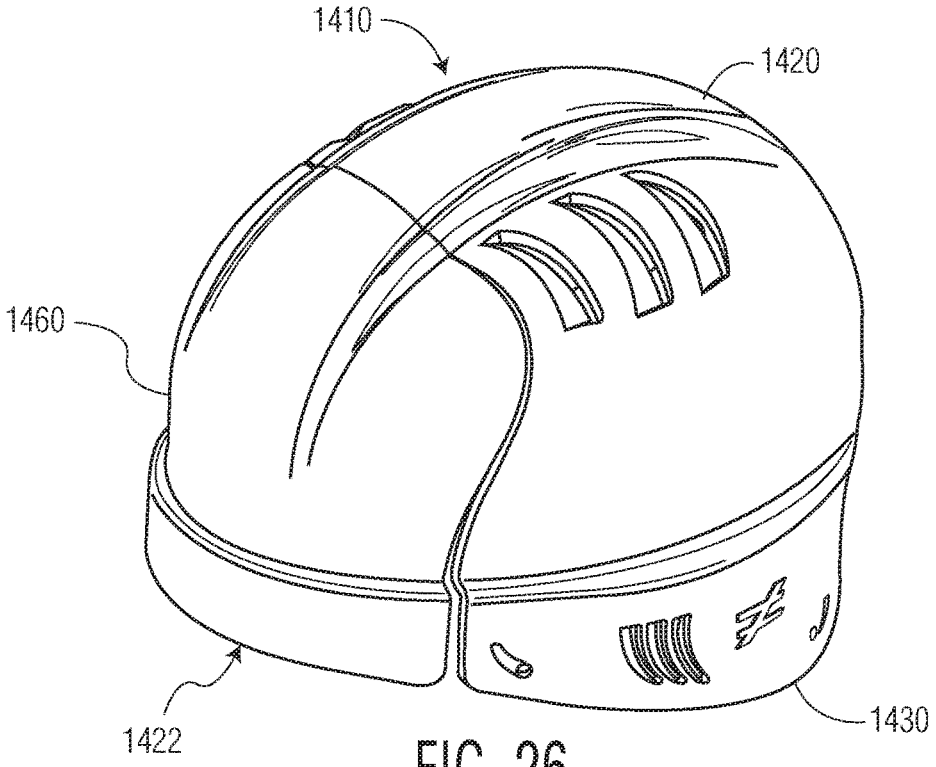
FIG. 26 is an image illustrating an alternative embodiment of a cutout of the helmet padding system of FIGS. 24A-24C.

In an alternative embodiment, lower rear edge 1422 extends down the user's head along with side portions 1430, as shown in FIGS. 25 and 26. In this embodiment, lower rear edge 1422 extends along approximately a same circumferential line as the lower edges of side portions 1430. In this embodiment, when rigid shell 1410 is worn under a baseball cap (such as a fitted baseball cap) lower rear edge 1422 extends below the lower edge of the cap.

Body portion 1420 may include at least one opening therein. The opening preferably allows breathability between the interior of rigid shell 1410 (i.e., the area adjacent the user's head) and the exterior of rigid shell 1410. In an exemplary embodiment, body portion 1420 includes a plurality of openings 1423, with at least one opening positioned between each side portion 1430 and an apex of rigid shell 1410, as shown in FIG. 24A.

Body portion 1420 may also include one or more ridges along a surface thereof. In an exemplary embodiment, body portion 1420 includes an elevated ridge 1424 extending from an area adjacent lower front edge 1421 over the apex of body portion 1420 to an area adjacent lower rear edge 1422, as shown in FIG. 24C. Ridge 1424 may provide additional structural stability to rigid shell 1410, thereby allowing shell 1410 to better dissipate the force of impacts. Ridge 1424 may further provided additional space between rigid shell 1410 and the user's head, adding to comfort and breathability for the user.

Body portion 1420 may also include a pair of cutouts 1425 on ends of front edge 1421, as shown in FIG. 24B. Cutouts 1425 are provided between front edge 1421 and side portions 1430. Body portion 1420 may further include a pair of cutouts 1425 on the ends of rear edge 1422, as shown in FIG. 24C. Cutouts 1425 desirably provide a path for coupling rigid shell 1410 to the interior of a baseball cap, as will be described below. It will be understood by one of ordinary skill in the art that the shape of cutouts 1425 shown in FIG. 24B is provided for the purposes of illustration, and is not intended to be limiting. For example, cutouts 1425 may be formed with a triangular or round shape without departing from the scope of the present invention.

Side portions 1430 extend downward below the lower front edge 1421 of body portion 1420, as shown in FIGS. 24A-24C. Side portions 1430 are sized to cover at least a portion (preferably at least 50%) of the user's ear when rigid shell 1410 is worn by the user. Side portions 1430 are also desirably sized to cover the user's temples when rigid shell 1410 is worn by the user. To this end, each side portion 1430 may have a circumferential length (along the side of the user's head) that is longer than the distance (or height) to which side portions 1430 extend below lower front edge 1421.

Side portions 1430 may include at least one opening therein. The opening may preferably be positioned over the user's ear when rigid shell 1410 is worn by the user. Such positioning allows the user to hear his or her surroundings while maintaining protection to the user's ear area from impacts. In an exemplary embodiment, each side portion 1430 comprises a set of spaced apart, elongated openings 1431, as shown in FIG. 24A.

Side portions 1430 may also include one or more flared portions. In an exemplary embodiment, side portions 1430 include flared portions 1432 extending outward relative to a surface of body portion 1420, as shown in FIG. 24C. Flared portions 1432 may provide additional space between rigid shell 1410 and the user's head and ears, adding to the user's comfort. When rigid shell 1410 is worn beneath a baseball cap, flared portions 1432 may include all of side portions 1430 that are positioned below the baseball cap.

Side portions 1430 may also include one or more attachment points. During use of helmet padding system 1400, it may be desirable to attach one or more accessories (such as straps, goggles, headphones or other accessories) to system 1400. Accordingly, rigid shell 1410 may include one or more attachment points designed to facilitate the attachment of appropriate accessories to the user's athletic activity. Such attachment points are preferably positioned on side portions 1430 so that they can be accessed even when rigid shell 1410 is worn underneath a baseball cap. In an exemplary embodiments, side portions 1430 include a pair of through-holes 1433 on either end thereof, as shown in FIG. 24A. Through-holes 1433 provide attachment points for a strap (e.g., a chin strap) to be attached to rigid shell 1410.

Figure 27:
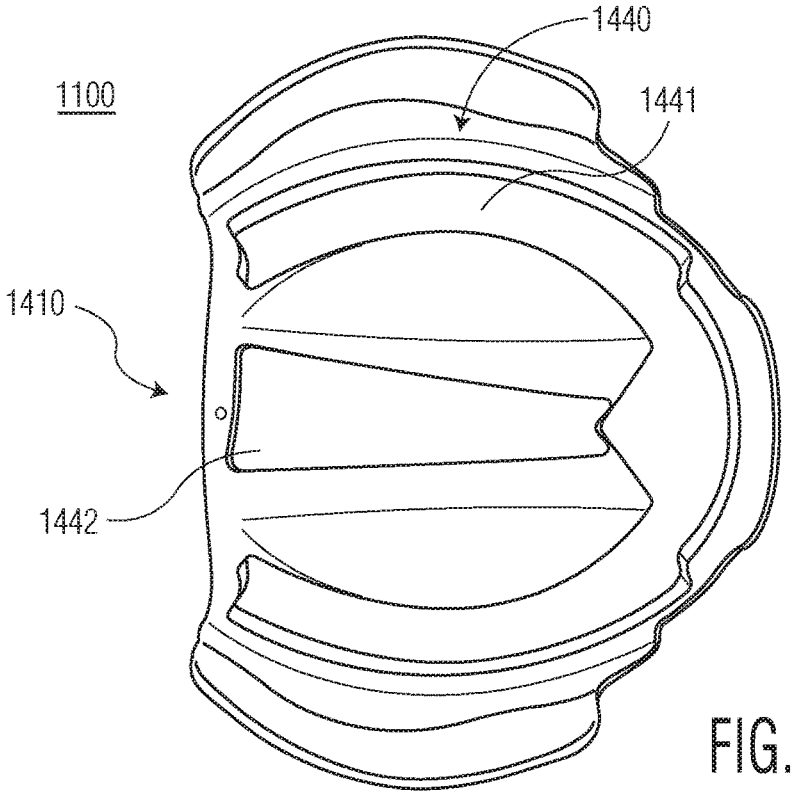
FIG. 27 is an image showing an interior of the helmet padding system of FIGS. 24A-24C.

Spacing pad 1440 is positioned within the interior of rigid shell 1410, as shown in FIG. 27. The spacing pad may be a spacing pad substantially as described with respect to spacing pad 130. Alternatively, the spacing pad may be an impact-resistant pad substantially as described above with respect to impact-resistant pad 200. Likewise, the spacing pad may be formed from any of the materials set forth above with respect to spacing pad 130 or impact-resistant pad 200, and may take any of the shapes described above with respect to spacing pad 130 and/or impact-resistant pad 200.

In a particularly suitable embodiment, the spacing pad 1440 includes a first portion 1441 extending circumferentially around a lower portion of rigid shell 1410, e.g., adjacent lower front edge 1421 and lower rear edge 1422, as shown in FIG. 27. In this embodiment, spacing pad 1440 includes a second portion 1442 extending from an area adjacent lower front edge 1421 over the apex of body portion 1420 to an area adjacent lower rear edge 1422.

Where helmet padding system 1400 is used with a fitted baseball cap, rigid shell 1410 may have a continuous, uninterrupted rear body portion. However, when helmet padding system 1400 is used with an adjustable baseball cap, rigid shell 1410 may include a cutout as shown in FIGS. 24A-26, and as set forth below.

Rigid shell 1410 may include a cutout 1426 in an area of body portion 1420 opposite lower front edge 1421. When rigid shell 1410 is worn beneath a baseball cap, cutout 1426 is provided in an area of body portion 1420 adjacent a rear of the baseball cap. In this embodiment, the baseball cap may be an adjustable baseball cap an opening for accommodating the adjustable strap. Accordingly, cutout 1426 has a shape corresponding to the shape of the opening in the rear of the adjustable baseball cap.

When rigid shell 1410 incorporates a cutout 1426, helmet padding system 1400 may further comprise a removable portion 1460 configured to fit within cutout 1426 of rigid shell 1410. Removable portion 1460 is formed from the same material as rigid shell 1410, in order to provide similar protection from the force of impacts. Thus, when removable portion 1460 is coupled to rigid shell 1410, the components form an approximately continuous dome shape on the top of the user's head.

Both cutout 1426 and removable portion 1460 may have a shape different from the semicircular cutout shape shown in FIG. 25. For example, as shown in FIG. 26, cutout 1426 and removable portion 1460 may cover a substantially larger portion of body portion 1420 of rigid shell 1410. Providing a larger cutout 1426 and removable portion 1460 may be desirable in order to provide a size or contour adjustability to rigid shell 1410 to accommodate users having different sized heads.

Figure 28B:
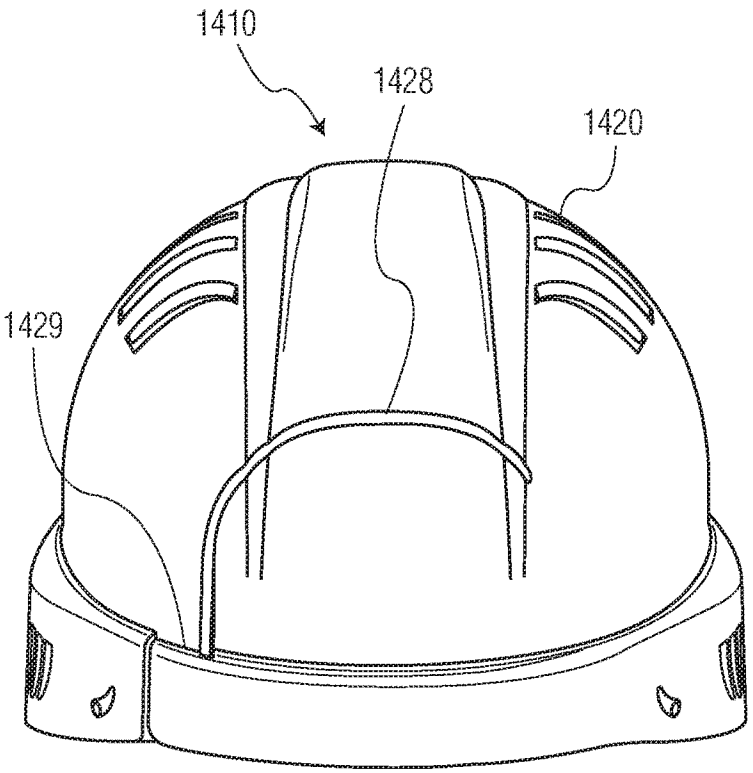
FIGS. 28A and 28B are images illustrating alternative embodiments of the helmet padding system of FIGS. 24A-24C.
Figure 28A:
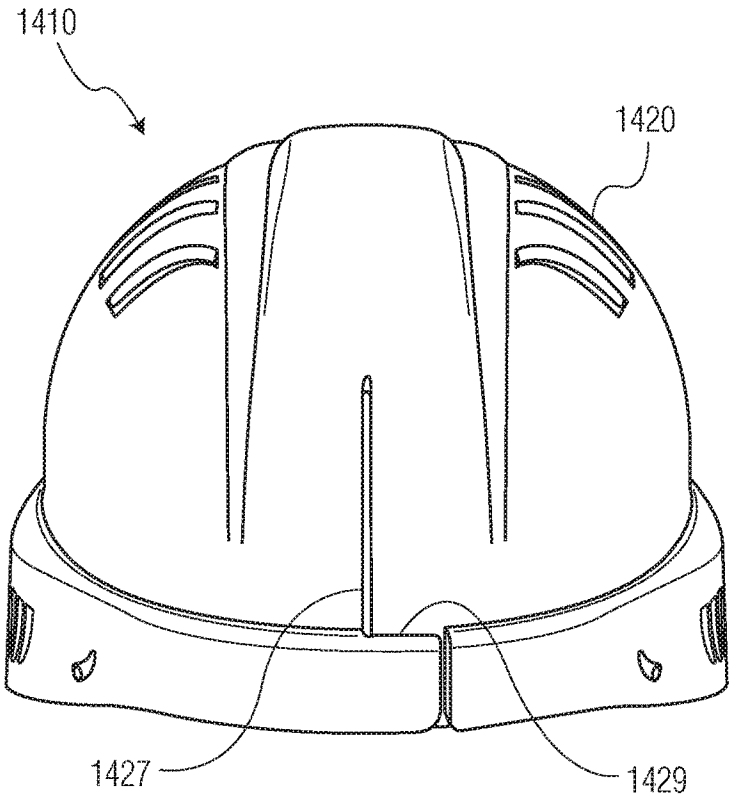

Removable portion 1460 is configured to be coupled to and removable from rigid shell 1410. Removable portion 1460 may be coupled to rigid shell 1410 by a number of different mechanisms, as described above with respect to removable portion 1180. In an exemplary embodiment, removable portion 1460 is frictionally coupled to rigid shell 1410, as shown in FIG. 24C. In this embodiment, removable portion 1460 includes tabs 1461 adapted to slide along the outer surface of rigid shell 1410, and tabs 1462 adapted to slide along the inner surface of rigid shell 1410, as shown in FIG. 25. Tabs 1461 and 1462 sandwich rigid shell 1410 therebetween, thereby creating a friction fit that holds removable portion 1460 in place against rigid shell 1410. Removable portion 1460 may be coupled to rigid shell 1410 using alternative mechanisms as discussed above with respect to removable portion 1180.

Where rigid shell 1410 does not include a cutout as set forth above, body portion 1420 may nonetheless include one or more slits in a lower portion thereof to accommodate users having different sized heads. The inclusion of slits in rigid shell 1410 may allow for adjustability of size between opposite sides of body portion 1420 without opening gaps that could negatively impact the protection provided by rigid shell 1410. In an exemplary embodiment, body portion 1420 includes a vertical slit 1427 at an approximate midpoint of a rear portion of body portion 1420 extending upward from lower rear edge 1422, as shown in FIG. 28A. In another exemplary embodiment, body portion 1420 includes a J-shaped slit 1428 along the rear portion of body portion 1420, as shown in FIG. 28B. As shown in FIGS. 28A and 28B, body portion 1420 may include a tab 1429 on one side of the slit 1427 or 1428 that extends overtop a surface of the body portion on the other side of the slit 1427 or 1428. Tab 1429 desirably allows the sides of body portion 1420 to move circumferentially with respect to one another (depending on the size of the user's head), while preventing relative inward or outward movement of the opposing sides of body portion 1420.

Figure 29:
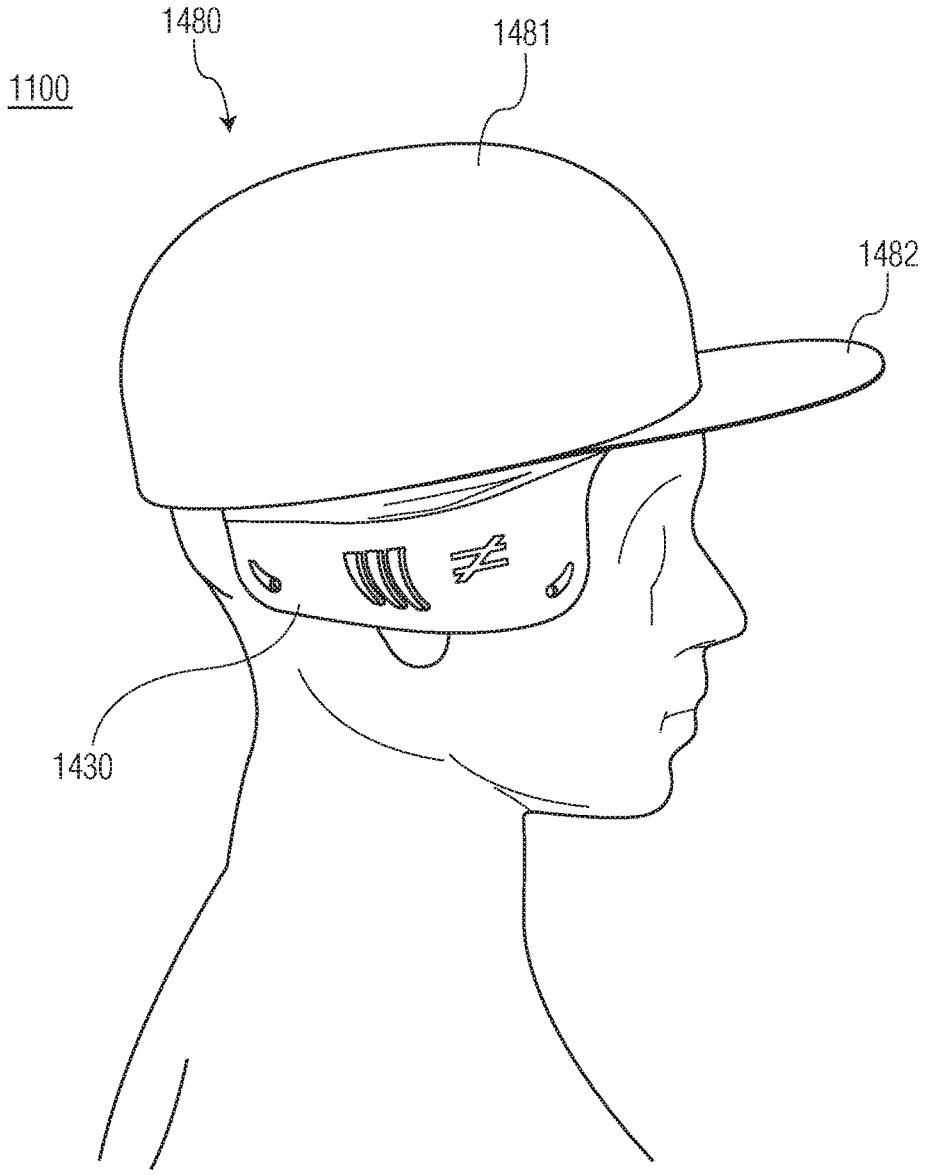
FIG. 29 is an image illustrating the helmet padding system of FIGS. 24A-24C worn beneath a baseball cap.

As shown in FIG. 29, helmet padding system 1400 may further include a baseball cap 1480. Baseball cap 1480 has a body portion 1481 and a brim portion 1482. As set forth above, rigid shell 1410 is configured to be worn beneath baseball cap 1480. Side portions 1430 of rigid shell 1410 are configured to extend downward below the lower edge of body portion 1481 of baseball cap 1480, as shown in FIG. 29. In this embodiment, side portions 1430 provide protection for the user's head beneath the lower edge of conventional baseball caps, including the user's temples and ears, which are normally left uncovered by conventional baseball caps.

Additionally, the extension of side portions 1430 beneath the lower edge of baseball cap 1480 provides a visual indication to others that the user is wearing increased head protection relative to that offered by a normal baseball cap. Such visual indication may be useful, e.g., to promote compliance with requirements of head protection during athletic activities.

Baseball cap 1480 may include an interior flap of material adjacent the front or rear lower edges thereof. Such a flap of material may be used for providing a connection between baseball cap 1480 and rigid shell 1410. In an exemplary embodiment, body portion 1420 may also include a pair of cutouts 1425, as shown in FIG. 24B. In this embodiment, the flap on baseball cap 1480 passes through cutouts 1425, such that a portion of the flap is positioned adjacent an interior surface of rigid shell 1410 (as opposed to outside of rigid shell 1410). Tucking a portion of the flap through cutouts 1425 may be useful to secure baseball cap 1480 to rigid shell 1410, and to provide additional comfort and/or sweat absorbency to the user's forehead.

Figure 30A:
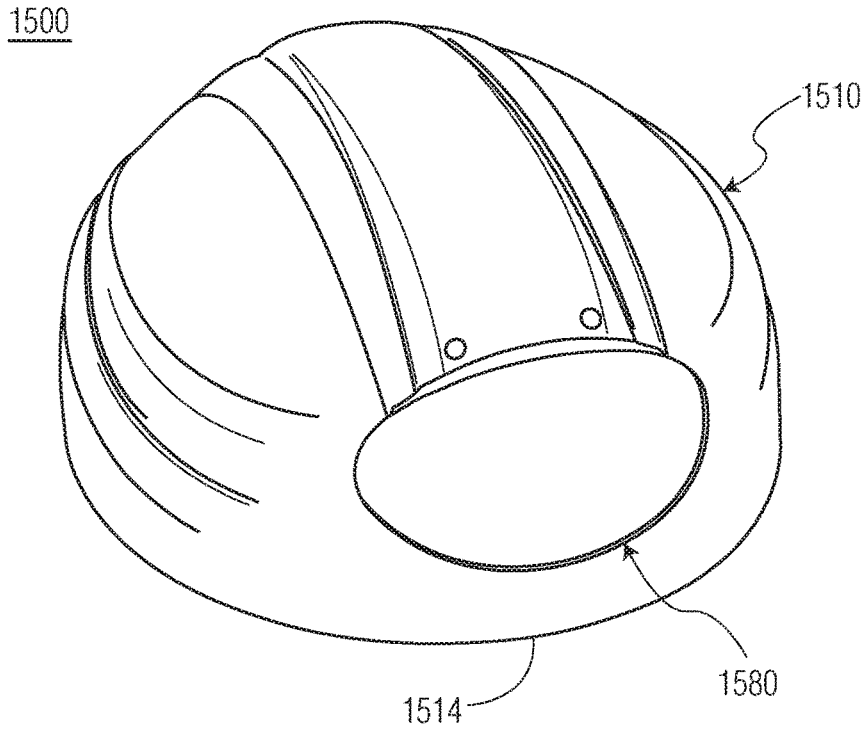
FIGS. 30A and 30B are images illustrating an alternative embodiment of the helmet padding system of FIGS. 20A and 20B.
Figure 30B:
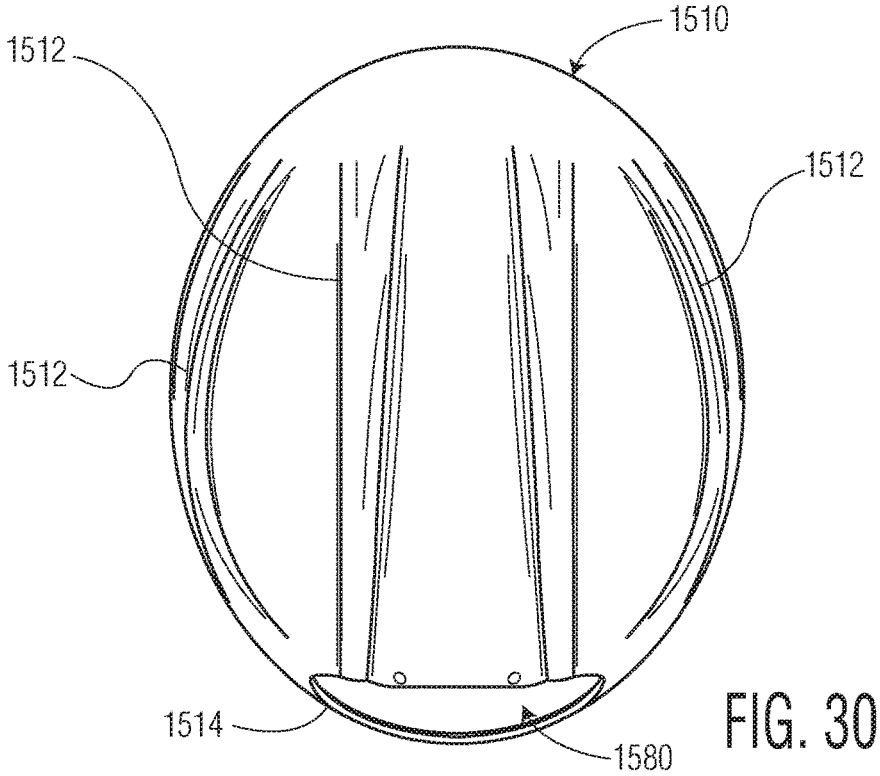

FIGS. 30A and 30B illustrate an alternative embodiment 1500 of helmet padding system 1200 in accordance with aspects of the present invention. Helmet padding system 1500 may be worn by a user during an athletic activity. Like helmet padding system 1200, helmet padding system 1500 may be worn under another piece of headgear, such as a baseball cap. As a general overview, system 1500 includes a main portion 1510 and an opening 1580. Helmet padding system 1500 includes substantially the same features as helmet padding system 1100 and/or 1200, except as described herein.

Main portion 1510 is configured to be positioned on a user's head. Main portion 1510 may include a plurality of different subcomponents corresponding to the layers of the various helmet padding systems described herein. In an exemplary embodiment, main portion 1510 includes a spacing pad, a plurality of absorption pads, and a deflection layer. Other components or layouts for dissipating the force of impacts may be selected based on the various embodiments described herein.

As shown in FIG. 30B, main portion 1510 of helmet padding system 1500 has a streamlined outer surface similar in design to helmet padding system 1200. This streamlined outer surface may enable helmet padding system 1500 to more easily fit within or underneath a baseball cap, as described above. The streamlined outer surface may include one or more elevated ridges 1512 extending along the surface thereof. As shown in FIG. 30B, the elevated ridges 1512 extend in a direction from a front of the user's head to the back of the user's head. These ridges provide additional structural support to main portion 1510, and assist in dissipating the force of impacts to the user's head.

Unlike systems 1100 and 1200, the opening 1580 of helmet padding system 1500 does not extend down to the lower edge of main portion 1510. Instead, main portion 1510 includes a bridge 1514 extending below opening 1580, as shown in FIGS. 30A and 30B. Thus, opening 1580 is completely surrounded by parts of main portion 1510. This layout improves the structural stability of helmet padding system 1500, by limiting relative movement of the left and right sides of main portion 1510 relative to one another. For example, bridge 1514 may be formed from a substantially rigid material (such as the deflection layer material described above) in order to prevent inward and outward movement of the left and right sides of main portion 1510 relative to one another.

Bridge 1514 also allows helmet padding system 1500 to maintain a continuous, uninterrupted lower edge, as shown in FIG. 30B. This continuous lower edge may improve protection and comfort for the user. Moreover, bridge 1514 may include one or more of the interior padding layers described herein to improve impact resistance. For example, the main portion 1510 of helmet padding system 1500 may include a continuous padding layer along the entire lower circumferential edge thereof to improve protection of the user from impacts.

When system 1500 is worn under a baseball cap having a rear cut-out (e.g., for an adjustable strap), opening 1580 is desirably located at the same position as the rear cut-out. Thus, opening 1580 reveals an area of the user's head directly beneath the cut-out of the baseball cap. This may be particularly desirable for users of system 1500 having long hair, who for comfort or other reasons wish their hair to extend through the rear cut-out of the baseball cap. In other words, opening 1580 desirably allows certain users to utilize the rear cut-out of their baseball cap as they normally would if they were not wearing a helmet padding system underneath their baseball cap.

Figure 31A:
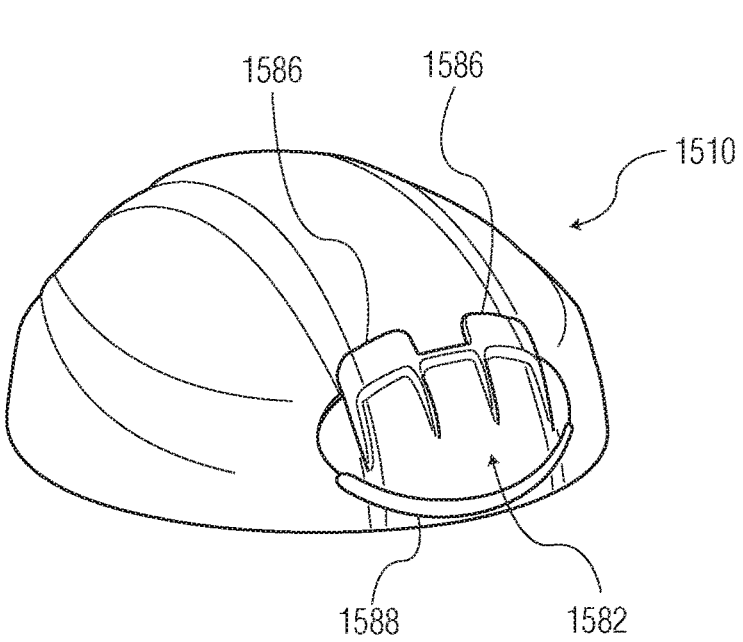
FIGS. 31A-31C are images illustrating the helmet padding system of FIGS. 30A and 30B with a removable plate.
Figure 31B:
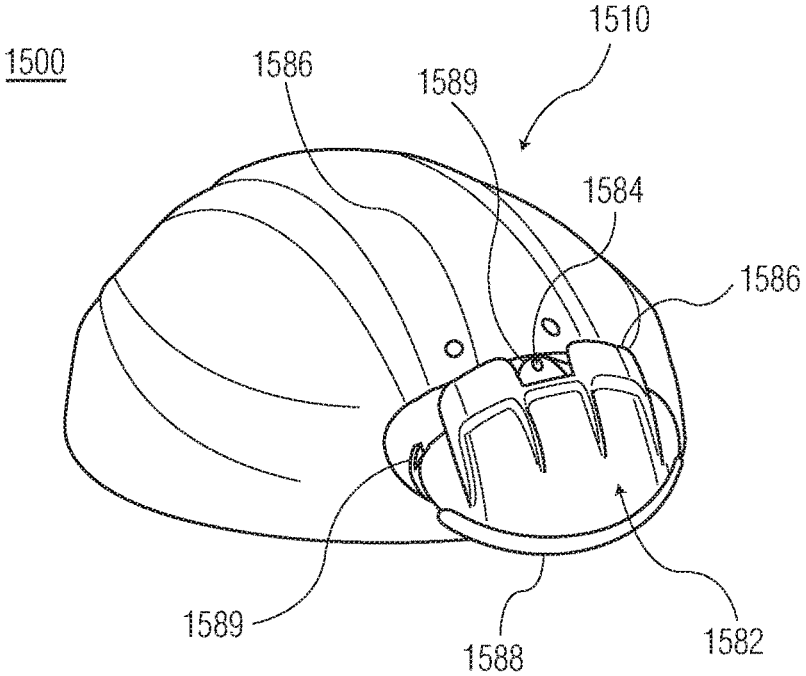
Figure 31C:
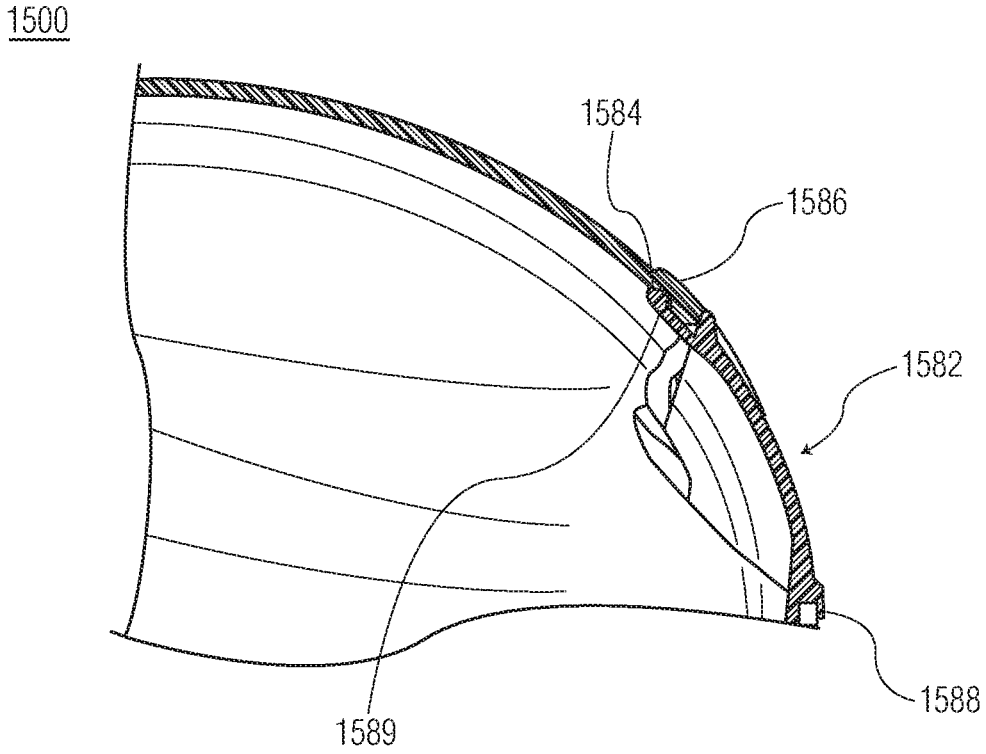

System 1500 may further include a removable plate 1582 sized to fit within opening 1580, as shown in FIGS. 31A-31C. Removable plate 1582 may have an approximately oval shape corresponding to the shape of opening 1580, in order to be easily received within and fill opening 1580. When received within the opening, removable plate 1582 provides impact protection to the user in the area of opening 1580, in substantially the same manner as main portion 1510. To this end, removable plate 1582 may be formed from the same material as main portion 1510 of system 1500, and may include one or more of the interior padding layers described herein to improve impact resistance.

Removable plate 1582 may be coupled to the main portion 1510 when it is received in opening 1580 using any of the attachment methods set forth above with respect to removable portions 1180 and 1280. In an exemplary embodiment, the removable plate includes a plurality of snapping mechanisms 1584 that snap onto main portion 1510 of system 1500, as shown in FIG. 31C. Snapping mechanisms 1584 may snap onto main portion 1510 on an outer surface thereof and/or on an inner surface thereof. To this end, snapping mechanisms may be formed as tabs that are configured to extend along an outer or inner surface of main portion 1510 when removable plate 1582 is positioned within opening 1580. Removable plate 1582 can then be removed from main portion 1510 at the user's discretion.

In an exemplary embodiment, removable plate 1582 includes a pair of outer tabs 1586 extending from an upper edge, and an outer ridge 1588 extending along the lower edge thereof. Tabs 1586 and ridge 1588 are positioned to rest on or contact an outer surface of main portion 1510, as shown in FIG. 31A. Removable plate 1582 further includes at least one inner tab 1589 extending from the upper edge and positioned to rest on or contact an inner surface of main portion 1510. In this embodiment, to couple removable plate 1582 to main portion 1510, plate 1582 is slid into opening 1580 from a lower angle, in order to sandwich main portion 1510 between tabs 1586 and 1589, and allow ridge 1588 to rest on the lower edge of opening 1580, as shown in FIG. 31C.

Figure 32A:
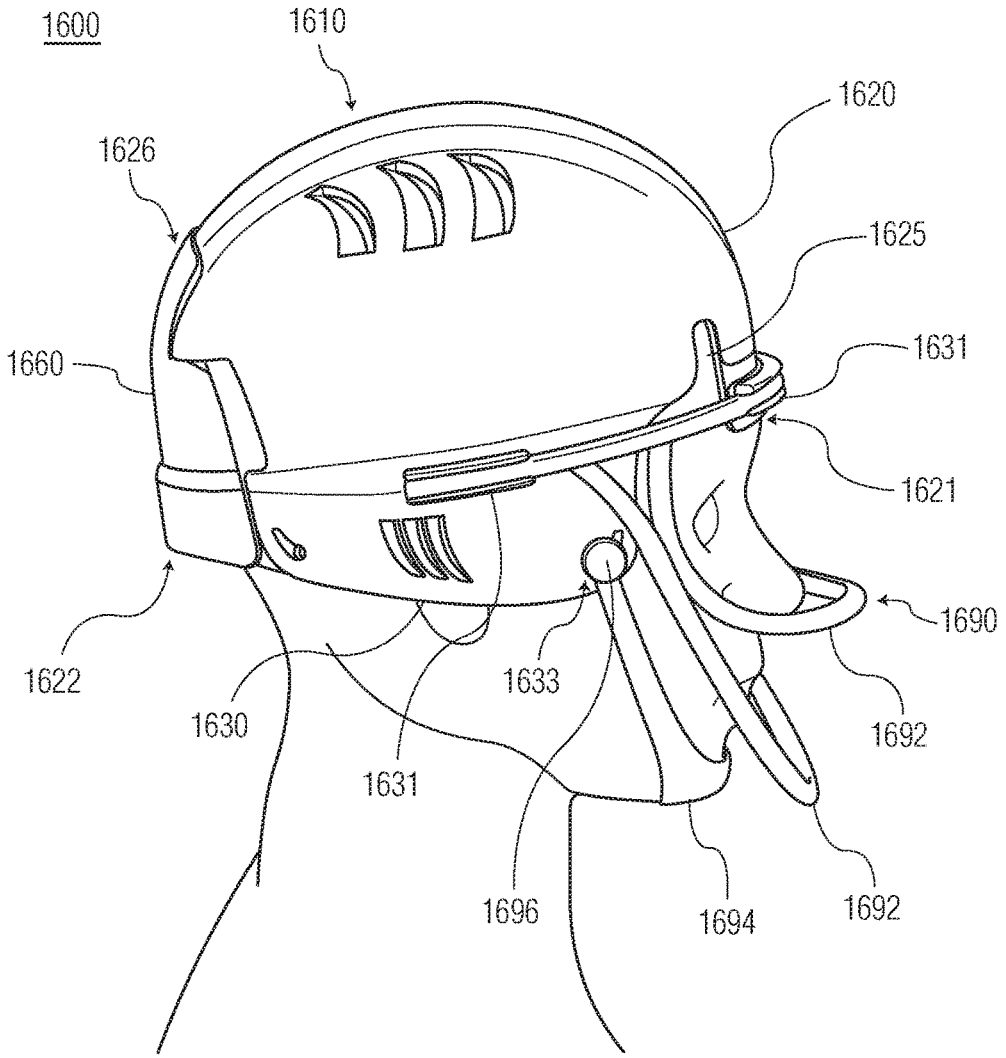
FIGS. 32A and 32B are images illustrating an alternative embodiment of the helmet padding system of FIGS. 24A-24C.
Figure 32B:
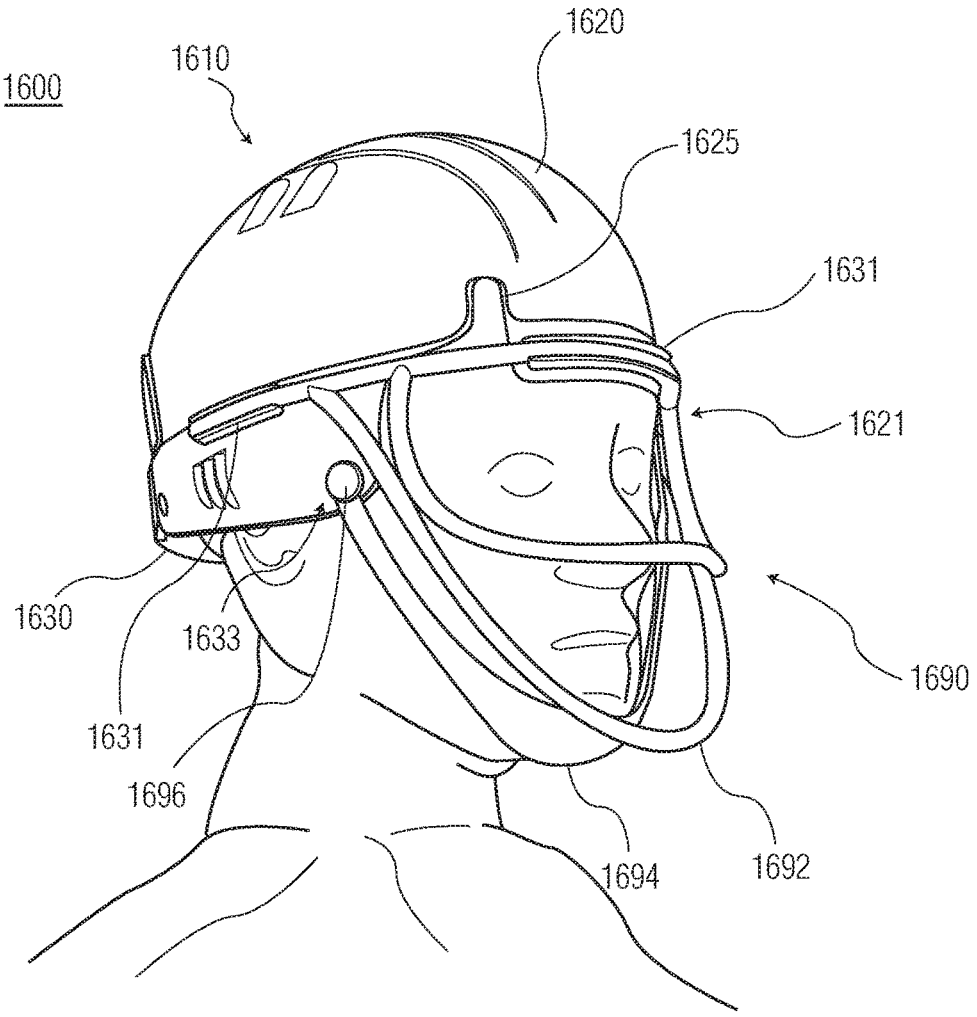

FIGS. 32A and 32B illustrate an alternative embodiment 1600 of helmet padding system 1400 in accordance with aspects of the present invention. Helmet padding system 1600 may be worn by a user during an athletic activity. Like helmet padding system 1400, helmet padding system 1600 may be worn under another piece of headgear, such as a baseball cap. As a general overview, system 1600 includes a rigid shell 1610, a spacing pad, and a facemask 1690. Helmet padding system 1600 includes substantially the same features as helmet padding system 1400, except as described herein.

Rigid shell 1610 is configured to cover the top of a user's head. Rigid shell 1610 is sized to be worn under a baseball cap. Rigid shell 1610 includes a body portion 1620 and a pair of side portions 1630. Body portion 1620 has a lower front edge 1621 extending between the pair of side portions 1630. Body portion 1620 further includes a lower rear edge 1622 extending between the pair of side portions 1630 opposite lower front edge 1621.

When worn under a baseball cap, lower front edge 1621 extends below the brim of the baseball cap. In an exemplary embodiment, lower front edge 1621 of rigid shell 1610 extends approximately one inch below the brim of the baseball cap. This protruding lower front edge 1621 may be desirable in order to provide added protection to the user, as well as to provide a location for attaching facemask 1690, as will be discussed below.

As shown in FIG. 32A, lower rear edge 1622 of body portion 1620 extends down the user's head along with side portions 1630. In this embodiment, lower rear edge 1622 extends along approximately a same circumferential line as the lower edges of side portions 1630. In this embodiment, when rigid shell 1610 is worn under a baseball cap (such as a fitted baseball cap) lower rear edge 1622 extends below the lower edge of the cap, in order to provide additional protection to the neck of the user.

Body portion 1620 may also include a pair of cutouts 1625 on ends of front edge 1621, one of which is shown in FIG. 32B. Cutouts 1625 are provided between front edge 1621 and side portions 1630. It will be understood by one of ordinary skill in the art that the shape of cutouts 1625 shown in FIG. 24B is provided for the purposes of illustration, and is not intended to be limiting.

Side portions 1630 extend downward below the lower front edge 1621 of body portion 1620, as shown in FIGS. 32A and 32BC. Side portions 1630 are sized to cover at least a portion (preferably at least 50%) of the user's ear when rigid shell 1610 is worn by the user. Side portions 1630 are also desirably sized to cover the user's temples when rigid shell 1610 is worn by the user.

Side portions 1630 may also include one or more attachment points. attachment points designed to facilitate the attachment of appropriate accessories to the user's athletic activity. Such attachment points are preferably positioned on side portions 1630 so that they can be accessed even when rigid shell 1610 is worn underneath a baseball cap.

In an exemplary embodiment, side portions 1630 include one or more grooves 1631. Grooves 1631 provide attachment points for facemask 1690 to be coupled to rigid shell 1610. In a preferred embodiment, lower front edge 1621 also includes one or more grooves 1631 for coupling facemask 1690 to rigid shell 1610. Groove 1631 on lower front edge 1621 may be accessible to facemask 1690 without removing the user's cap due to lower front edge 1621 extending below the lower edge of the brim of the cap, as described above.

In another exemplary embodiment, side portions 1630 include one or more snaps 1633. Snaps 1633 provide attachment points for a strap (e.g., a chin strap) to be attached to rigid shell 1610. Snaps 1633 may be movable within slots on side portions 1630 in order to adjust the fitting of the chin strap.

Rigid shell 1610 may include a cutout 1626 in an area of body portion 1620 opposite lower front edge 1621. When rigid shell 1610 incorporates a cutout 1626, helmet padding system 1600 may further comprise a removable portion 1660 configured to fit within cutout 1626 of rigid shell 1610. Removable portion 1660 is formed from the same material as rigid shell 1610, in order to provide similar protection from the force of impacts.

Facemask 1690 is configured to protect the user's face from impacts or projectiles (such as baseballs or softballs) commonly in play during the course of an athletic activity. Facemask 1690 may be permanently coupled to rigid shell 1610, or may be removably coupled to rigid shell 1610. Preferably, facemask 1690 is removable from rigid shell 1610 without removable of rigid shell 1610 from the user's head, and without removing any components from rigid shell 1610. In this manner, that facemask 1690 need not be worn throughout an entire athletic activity, and may be removed (e.g., when impacts to a user's face are not likely to occur) without removal of the user's baseball cap or the remaining components of system 1600.

In an exemplary embodiment, facemask 1690 is formed from a plurality of rigid bars 1692 that protect the user's face without substantially obstructing the user's vision. Bars 1692 may have portions sized to mate with corresponding attachment points on rigid shell 1610 in order to couple facemask 1690 to rigid shell 1610. In a preferred embodiment, one or more portions of bars 1692 are sized to mate with corresponding grooves 1631 formed on side portions 1630 and/or on lower front edge 1621. Grooves 1631 are sized to provide a snug, secure fit to the portions of bars 1692, while allowing facemask 1690 to be removed (e.g., by sliding) from grooves 1631 when facemask 1690 is not in use.

System 1600 may further include a chin strap 1694. Chin strap 1694 is configured to secure system 1600 on the user's head during the course of an athletic activity. Chin strap 1694 has ends which are coupled to the respective side portions 1630 of rigid shell 1610, and is sufficiently long to circle underneath the user's chin when rigid shell 1610 is worn by the user. Chin strap 1694 may be permanently coupled to rigid shell 1610, or may be removably coupled to rigid shell 1610. Preferably, chin strap 1694 is removable from rigid shell 1610 without removable of rigid shell 1610 from the user's head, and without removing any components from rigid shell 1610. In this manner, that chin strap 1694 need not be worn throughout an entire athletic activity, and may be removed (e.g., when the user is not active engaged in the athletic activity) without removal of the user's baseball cap or the remaining components of system 1600.

In an exemplary embodiment, chin strap 1694 is formed from a flexible material such as rubber or fabric that is flexible or soft enough to be comfortable to the user while remaining strong enough to secure system 1600 on the user's head. Chin strap 1694 has mating structures 1696 sized to mate with corresponding attachment points on rigid shell 1610 in order to couple chin strap 1694 to rigid shell 1610. In a preferred embodiment, mating structures 1696 are configured to snap onto corresponding snaps 1633 formed on side portions 1630 of rigid shell 1610. Snaps 1633 are configured to provide a snug, secure connection to the mating structures 1696 on chin strap 1694. Snaps 1633 may also be positioned within slots on side portions 1630 to allow chin strap 1694 to be adjusted to ensure the user's comfort and security.

FIGS. 33A-35 illustrate an exemplary helmet padding system 1700 in accordance with aspects of the present invention. Helmet padding system 1700 may be worn by a user during an athletic activity. Desirably, helmet padding system 1700 may be worn under another piece of headgear, such as a baseball cap, knit winter cap, beanie, or other piece of aesthetic headwear. As a general overview, system 1700 includes a rigid shell 1710 and a spacing pad 1740. Additional details of system 1700 are described herein.

Rigid shell 1710 is configured to cover the top of a user's head. Rigid shell 1710 is sized to be worn under a baseball cap. Accordingly, it may be desirable that rigid shell 1710 be formed from a thin, rigid material. In an exemplary embodiment, rigid shell 1710 is formed from a polycarbonate material, as described above. The material may have a thickness of less than approximately 5 mm, and more desirably, less than approximately 3.5 mm. Forming rigid shell 1710 with a low profile (i.e. thin size) is desirable to promote use of helmet padding system 1700 by eliminating interference with the aesthetic features of the headgear (e.g., baseball cap) worn on top of rigid shell 1710.

Rigid shell 1710 includes a body portion 1720 and a pair of side portions 1730. Body portion 1720 has a lower front edge 1721 extending between the pair of side portions 1730. When worn under a baseball cap, lower front edge 1721 is positioned adjacent the brim of the baseball cap. Body portion 1720 further includes a lower rear edge 1722 extending between the pair of side portions 1730 opposite lower front edge 1721.

Figure 33A:
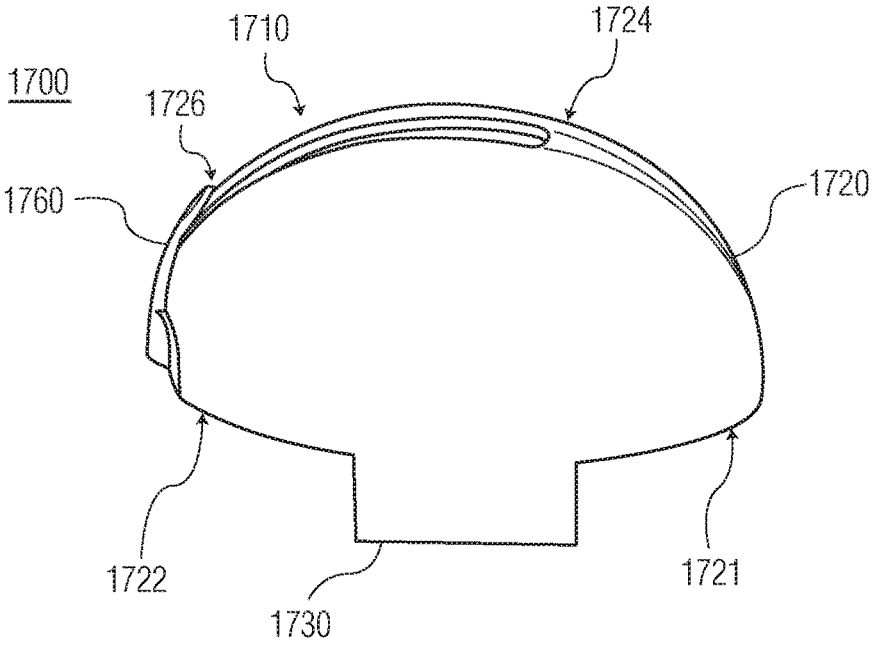
FIGS. 33A and 33B are images illustrating another exemplary helmet padding system in accordance with aspects of the present invention.

In one embodiment, lower rear edge 1722 of body portion 1720 has approximately the same height as lower front edge 1721, as shown in FIG. 33A. In this embodiment, lower rear edge extends along approximately the same circumferential line (around the user's head) as lower front edge 1721. In this embodiment, when rigid shell 1710 is worn under a baseball cap (such as a fitted baseball cap) lower rear edge 1722 is positioned adjacent the lower edge of the cap.

Body portion 1720 may include at least one slot therein. The slot may preferably assist in the ability of rigid shell 1710 to protect against the force of impacts, e.g., by allowing portions of rigid shell 1710 to move relative to one another. The slot also preferably allows breathability between the interior of rigid shell 1710 (i.e., the area adjacent the user's head) and the exterior of rigid shell 1710.

Figure 33B:
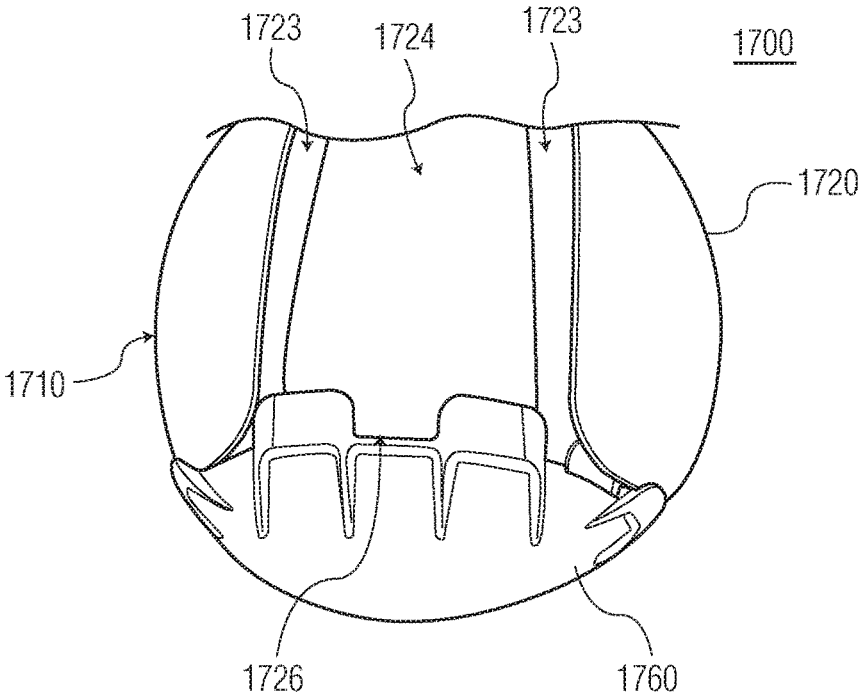
Figure 34:
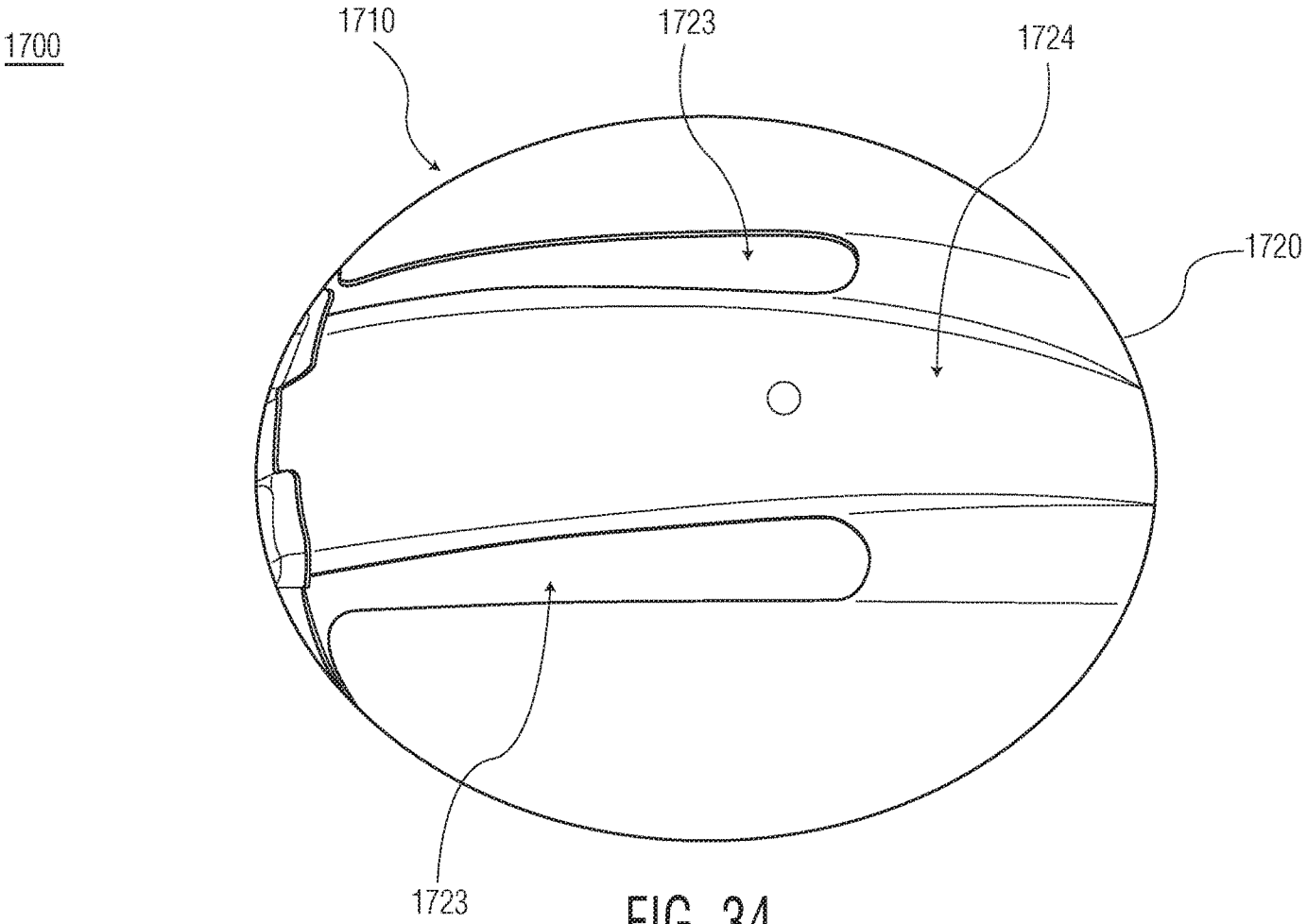
FIG. 34 is an image illustrating a top view of the helmet padding system of FIGS. 33A and 33B.

In an exemplary embodiment, body portion 1720 of rigid shell 1710 includes a pair of slots 1723 positioned between each side portion 1730 and an apex of rigid shell 1710. As shown in FIG. 33A, a length of the removable portion 1760 from a base adjacent lower rear edge 1722 to an edge of the rigid shell 1710 defined by the cutout 1726 is less than a length of the extension of each slot of the pair of slots 1723. As shown in FIGS. 33B and 34, slots 1723 are positioned on either side of an apex of rigid shell 1710. The pair of slots 1723 are configured to extend in a direction from a back of the user's head to the front of the user's head when rigid shell 1710 is worn on the user's head.

Body portion 1720 may also include one or more ridges along a surface thereof. In an exemplary embodiment, body portion 1720 includes an elevated ridge 1724 extending from an area adjacent lower front edge 1721 over the apex of body portion 1720 to an area adjacent lower rear edge 1722, as shown in FIG. 33B. Ridge 1724 may provide additional structural stability to rigid shell 1710, thereby allowing shell 1710 to better dissipate the force of impacts. Ridge 1724 may further provided additional space between rigid shell 1710 and the user's head, adding to comfort and breathability for the user. In this embodiment, the pair of slots 1723 are positioned on either side of ridge 1724.

Side portions 1730 extend downward below the lower front edge 1721 and lower rear edge 1722 of body portion 1720, as shown in FIG. 33A. Side portions 1730 are sized to cover at least a portion (preferably at least 50%) of the user's ear when rigid shell 1710 is worn by the user. Side portions 1730 are also desirably sized to cover the user's temples when rigid shell 1710 is worn by the user. In an exemplary embodiment, each side portion 1730 has a pair of sidewalls extending downward from body portion 1720 at a perpendicular angle to the lower front and rear edges 1721 and 1722 of body portion 1720. Further, as shown in FIG. 33A, each side portion 1730 may have a rectangular shape.

Figure 35:
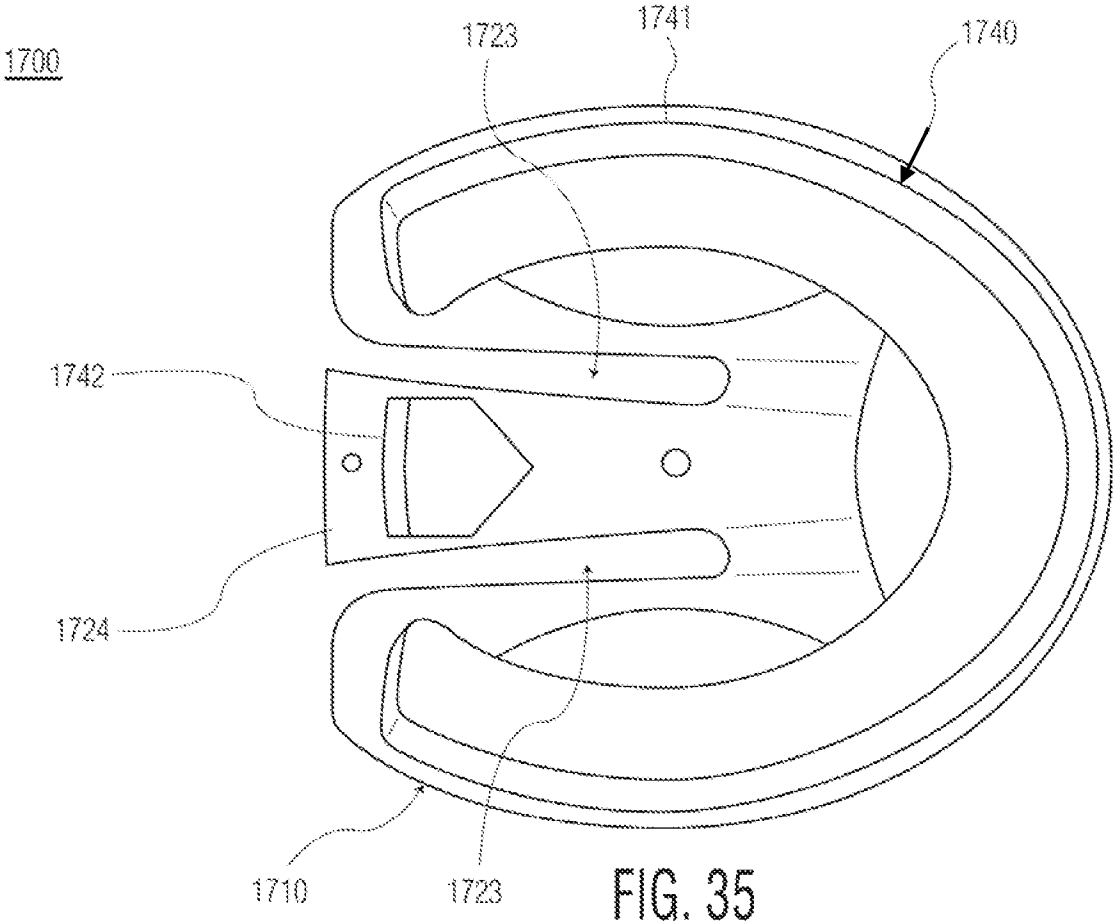
FIG. 35 is an image showing an interior of the helmet padding system of FIGS. 33A and 33B.

Spacing pad 1740 is positioned within the interior of rigid shell 1710, as shown in FIG. 35. The spacing pad 1740 may be a spacing pad substantially as described with respect to spacing pad 130. Alternatively, the spacing pad 1740 may be an impact-resistant pad substantially as described above with respect to impact-resistant pad 200. Likewise, the spacing pad may be formed from any of the materials set forth above with respect to spacing pad 130 or impact-resistant pad 200, and may take any of the shapes described above with respect to spacing pad 130 and/or impact-resistant pad 200.

In a particularly suitable embodiment, the spacing pad 1740 includes a first portion 1741 extending circumferentially around a lower portion of rigid shell 1710, as shown in FIG. 35. In this embodiment, spacing pad 1740 includes a second portion 1742 positioned between slots 1723, as set forth in greater detail below.

Where helmet padding system 1700 is used with a fitted baseball cap, rigid shell 1710 may have a continuous, uninterrupted rear body portion. However, when helmet padding system 1700 is used with an adjustable baseball cap, rigid shell 1710 may include a cutout as shown in FIGS. 33A-33B, and as set forth below.

Rigid shell 1710 may include a cutout 1726 in an area of body portion 1720 opposite lower front edge 1721. When rigid shell 1710 is worn beneath a baseball cap, cutout 1726 is provided in an area of body portion 1720 adjacent a rear of the baseball cap. In this embodiment, the baseball cap may be an adjustable baseball cap an opening for accommodating the adjustable strap. Accordingly, cutout 1726 has a shape corresponding to the shape of the opening in the rear of the adjustable baseball cap.

When rigid shell 1710 incorporates a cutout 1726, helmet padding system 1700 may further comprise a removable portion 1760 configured to fit within cutout 1726 of rigid shell 1710. Removable portion 1760 is formed from the same material as rigid shell 1710, in order to provide similar protection from the force of impacts. Thus, when removable portion 1760 is coupled to rigid shell 1710, the components form an approximately continuous dome shape on the top of the user's head. Removable portion 1760 is configured to be coupled to and removable from rigid shell 1710. Removable portion 1760 may be coupled to rigid shell 1710 by a number of different mechanisms, as described above with respect to removable portion 1180 or 1460.

When rigid shell 1710 incorporates a cutout 1726, both slots 1723 and ridge 1724 may extend to cutout 1726. Likewise, the second portion 1742 of spacing pad 1740 may be coupled to the interior of ridge 1724 between slots 1723 and adjacent cutout 1726.

Although the invention is illustrated and described herein with reference to specific embodiments, the invention is not intended to be limited to the details shown. Rather, various modifications may be made in the details within the scope and range of equivalents of the claims and without departing from the invention. In particular, any of the features described herein with respect to one embodiment may be provided in any of the other embodiments.

What is claimed:

1. A helmet padding system comprising: a rigid shell configured to cover a top of a user's head and be worn under a baseball cap, the rigid shell including a cutout formed in an area of the rigid shell opposite the front of the user's head when the rigid shell is worn on the user's head, the cutout defining an edge of the rigid shell; and a spacing pad positioned within the rigid shell, the spacing pad including a layer of elastomeric material, wherein the rigid shell comprises a pair of slots, each slot of the pair of slots having an open terminal end at the edge of the rigid shell defined by the cutout, each slot of the pair of slots having a slot extension extending from the edge of the rigid shell defined by the cutout in a direction configured to extend from a back of the user's head to the front of the user's head when the rigid shell is worn on the user's head, and further comprising a removable portion configured to fit within and fill the cutout of the rigid shell, the removable portion formed of the same material as the rigid shell, wherein a length of the removable portion from a base of removable portion to the edge of the rigid shell defined by the cutout is less than a length of the slot extension of each slot of the pair of slots.

2. The helmet padding system of claim 1, wherein the removable portion is configured to be attached to the rigid shell.

3. The helmet padding system of claim 1, wherein the rigid shell comprises a body portion and a pair of side portions, the body portion having a lower front edge between the pair of side portions, the pair of side portions extending downward below the lower front edge of the body portion.

4. The helmet padding system of claim 3, wherein the side portions are sized to cover the user's temples when the rigid shell is worn by the user.

5. The helmet padding system of claim 3, wherein a lower rear edge of the body portion opposite the lower front edge of the body portion extends in a same plane as the lower front edge of the body portion.

6. The helmet padding system of claim 3, wherein each side portion has a pair of sidewalls extending downward from the body portion at a perpendicular angle to a lower edge of the body portion.

7. The helmet padding system of claim 6, wherein each side portion has a rectangular shape.

8. The helmet padding system of claim 1, wherein the rigid shell comprises at least one elevated ridge extending from an area adjacent a lower front edge of the rigid shell toward a lower rear edge of the rigid shell.

9. The helmet padding system of claim 1, wherein the spacing pad comprises a portion extending circumferentially around a lower circumferential edge of the rigid shell.

10. The helmet padding system of claim 1, wherein the spacing pad consists of a single layer of the elastomeric material.

11. The helmet padding system of claim 1, further comprising:

the baseball cap, wherein the baseball cap has a further cutout in a rear portion thereof;

and wherein the baseball cap is configured to be worn such that the further cutout is directly over the cutout in the rigid shell.

12. The helmet padding system of claim 11, further comprising a removable portion configured to fit within the cutout of the rigid shell, the removable portion formed of the same material as the rigid shell.

13. The helmet padding system of claim 12, wherein the removable portion is configured to be attached to the rigid shell.

14. The helmet padding system of claim 11, wherein the cap is an adjustable baseball cap, and the further cutout in the cap is formed in an area adjacent an adjustable strap of the adjustable baseball cap.

15. The helmet padding system of claim 11, wherein the rigid shell comprises a body portion and a pair of side portions, the pair of side portions extending downward below a lower edge of the cap.

16. The helmet padding system of claim 15, wherein the side portions are sized to cover the user's temples when the rigid shell is worn by the user.

17. The helmet padding system of claim 1, wherein the pair of slots are positioned on either side of an apex of the rigid shell.

18. The helmet padding system of claim 1, wherein the spacing pad comprises a portion coupled to the rigid shell between the pair of slots.

19. The helmet padding system of claim 18, wherein the portion of the spacing pad coupled to the rigid shell between the pair of slots is positioned adjacent the cutout formed in the rigid shell.

20. The helmet padding system of claim 1, wherein the rigid shell comprises at least one elevated ridge extending from an area adjacent a lower front edge of the rigid shell over an apex of the rigid shell toward a lower rear edge of the rigid shell, and wherein the pair of slots are positioned on either side of the at least one elevated ridge.

21. The helmet padding system of claim 1, wherein the spacing pad comprises a portion extending circumferentially around at least a portion of a lower circumferential edge of the rigid shell.

* * * * *